US008965248B2

(12) United States Patent
Kobayashi et al.

(10) Patent No.: US 8,965,248 B2
(45) Date of Patent: Feb. 24, 2015

(54) IMAGE FORMATION UNIT AND IMAGE FORMATION APPARATUS

(71) Applicant: Oki Data Corporation, Tokyo (JP)

(72) Inventors: Atsushi Kobayashi, Tokyo (JP); Shinichi Otani, Tokyo (JP); Yukiyoshi Oda, Tokyo (JP); Yasushi Nakasone, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/928,408

(22) Filed: Jun. 27, 2013

(65) Prior Publication Data

US 2014/0003841 A1 Jan. 2, 2014

(30) Foreign Application Priority Data

Jun. 28, 2012 (JP) ..... 2012-145253
Jun. 28, 2012 (JP) ..... 2012-146111

(51) Int. Cl.
*G03G 15/00* (2006.01)
*G03G 21/18* (2006.01)

(52) U.S. Cl.
CPC ..... *G03G 15/757* (2013.01); *G03G 21/1821* (2013.01)
USPC ..... 399/167; 399/159

(58) Field of Classification Search
None
See application file for complete search history.

(56) References Cited

U.S. PATENT DOCUMENTS 6,163,666 A * 12/2000 Hosokawa et al. ..... 399/111

FOREIGN PATENT DOCUMENTS

| | | | |
|---|---|---|---|
| JP | H2-23381 | A | 1/1990 |
| JP | H2-48959 | U | 4/1990 |
| JP | H11-327299 | A | 11/1999 |
| JP | 2002-040903 | A | 2/2002 |
| JP | 2006-048018 | A | 2/2006 |
| JP | 2007-148287 | A | 6/2007 |
| JP | 2011-170130 | A | 9/2011 |
| JP | 2011-191403 | A | 9/2011 |

* cited by examiner

*Primary Examiner* — Clayton E Laballe
*Assistant Examiner* — Jas Sanghera
(74) *Attorney, Agent, or Firm* — Marvin A. Motsenbocker; Mots Law, PLLC

(57) ABSTRACT

An image formation unit includes a first unit rotatably supporting an image carrier on which an electrostatic latent image is to be formed, and a second unit rotatably supporting a developer carrier configured to develop the electrostatic latent image with a developer. The first unit includes a first engagement portion formed at one end in the direction of the rotational axis of the image carrier, and a second engagement portion provided at a predetermined distance from the first engagement portion at the one end side. The second unit includes a first engaged portion engaged with the first engagement portion, a second engaged portion engaged with the second engagement portion, and a drive input portion provided between the first and second engaged portions and configured to rotate the developer carrier.

20 Claims, 50 Drawing Sheets

IMAGE FORMATION UNIT AND IMAGE FORMATION APPARATUS

CROSS REFERENCE TO RELATED APPLICATIONS

This application claims priority based on 35 USC 119 from prior Japanese Patent Applications No. 2012-145253 filed on Jun. 28, 2012, entitled "IMAGE FORMATION UNIT AND IMAGE FORMATION APPARATUS" and No. 2012-146111 filed on Jun. 28, 2012, entitled "IMAGE FORMATION UNIT AND IMAGE FORMATION APPARATUS", the entire contents of which are incorporated herein by reference.

BACKGROUND OF THE INVENTION

1. Field of the Invention

This disclosure relates to an image formation unit for use in a copier, an electrophotographic printer, a facsimile, a multifunction printer (MFP), or the like and an image formation apparatus including the same.

In a conventional image formation unit of this type, a drum unit including a photosensitive drum and a development unit including a development roller are separately formed. The drum unit supports the development unit so that the development unit can rotate around a predetermined fulcrum of rotation. The development unit is biased toward the drum unit by a bias force produced by a bias member, and thereby is brought into contact with the photosensitive drum at a predetermined pressure (see Patent Document 1, for example).

Patent Document 1: Japanese Patent Laid-open Publication No. 2006-48018 (p. 6, FIG. 2)

SUMMARY OF THE INVENTION

However, with the above-described method, the pressure of contact between the photosensitive drum and development roller is affected by the force caused by the rotation load torque of the development unit in addition to the bias force of the bias member. Accordingly, the pressure of contact sometimes changes due to variations and changes in rotation load torque.

An aspect of the invention is an image formation unit that includes: a first unit rotatably supporting an image carrier on which an electrostatic latent image is to be formed; and a second unit rotatably supporting a developer carrier configured to develop the electrostatic latent image with a developer. The first unit includes: a first engagement portion formed at one end in the direction of the rotational axis of the image carrier; and a second engagement portion provided at a predetermined distance from the first engagement portion at the one end side. The second unit includes: a first engaged portion engaged with the first engagement portion; a second engaged portion engaged with the second engagement portion; and a drive input portion provided between the first and second engaged portions and configured to rotate the developer carrier.

According to the above aspect, the pressure of contact between the image carrier and developer carrier is less likely to be influenced by external factors, other than the bias member configured to bring the image and developer carriers into contact with each other.

DETAILED DESCRIPTION OF EMBODIMENTS

Figure 1:
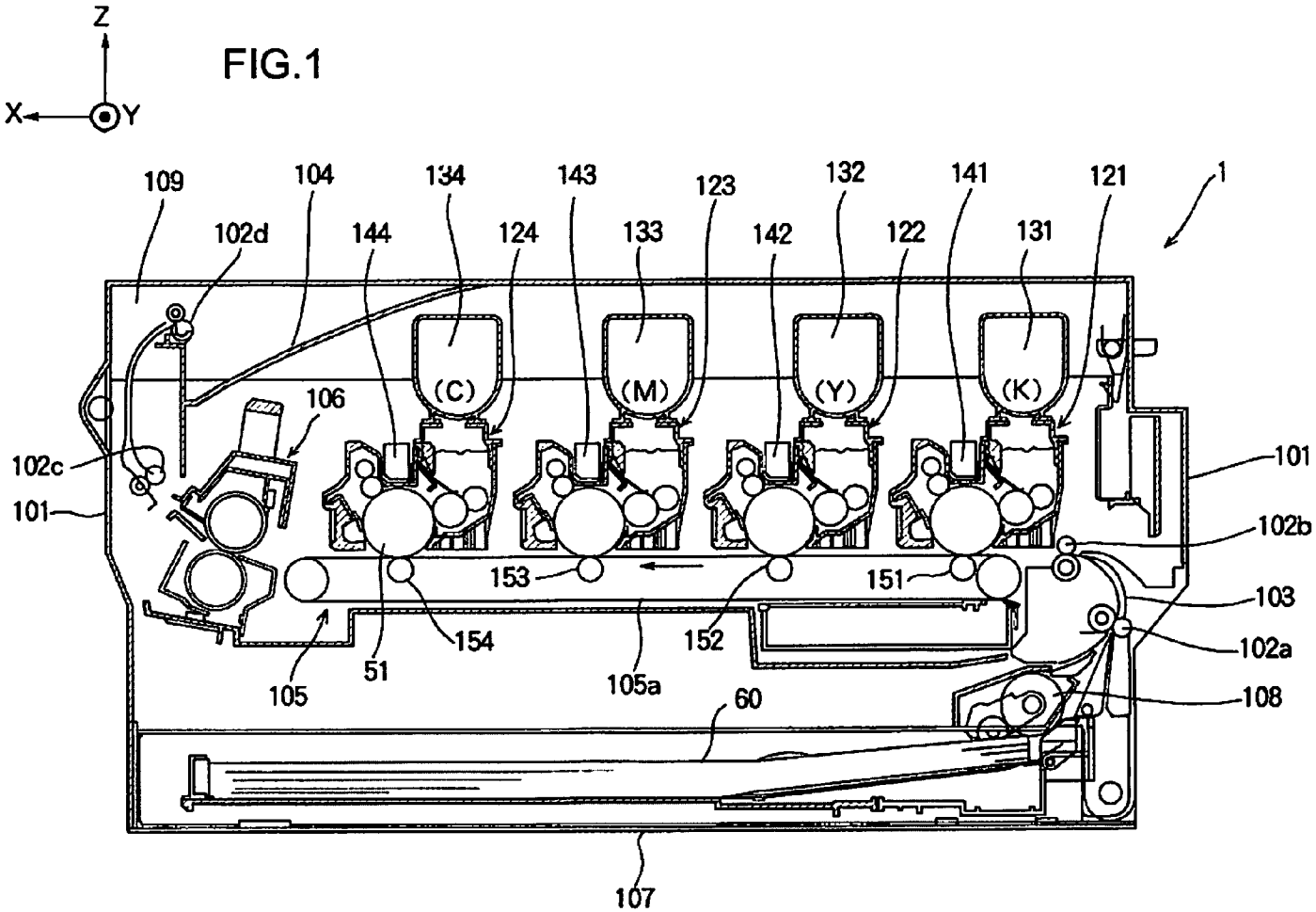
FIG. 1 is a configuration view of a main part of an image formation apparatus of a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(First Embodiment)

FIG. 1 is a configuration view of a main part of an image formation apparatus including an image formation unit according to the first embodiment of the invention.

In FIG. 1, image formation apparatus 1 includes a configuration as a color electrophotographic printer capable of printing four colors including black (K), yellow (Y), magenta (M), and cyan (C). Image formation apparatus 1 includes lower frame 101 and body cover or top cover 109. Image formation apparatus 1 further includes substantially s-shaped sheet transport path 103 having paper transport rollers 102*a* to 102*d*. At an end of paper transport path 103 on the upstream side, paper feed cassette 107 accommodating recording paper 60 is provided, and at an end thereof on the downstream side, stacker 104 is provided.

Paper transport path 103 is provided with paper feeder 108, a transfer belt unit 105, and a fixer 106. Paper feeder 108 feeds recording paper 60 from paper feed cassette 107. Transfer belt unit 105 attaches recording paper 60 to transfer belt 105*a* with an electrostatic effect and transports recording paper 60 in the direction of the arrow in the drawing. Fixer 106 fixes a toner image onto recording paper 60.

Image formation units 121 to 124 are arranged in line starting from the upstream side in the direction of transport of recording paper 60 so as to face transfer belt unit 105. Image formation units 121 to 124 are configured to form toner images of black (K), yellow (Y), magenta (M), and cyan (C), respectively. In other words, recording paper 60, that is attached to the transfer belt 105*a* and transported, is sandwiched between image formation units 121 to 124 and transfer belt unit 105. These image formation units 121 to 124 are detachable from the body of image formation apparatus 1. In contrast with individual constituent elements, like image formation units 121 to 124 of image formation apparatus 1, part of image formation apparatus 1 other than the individual constituent elements is referred to as the body of image formation apparatus 1 in some cases.

In the upper part of image formation unit 121, a later-described toner supply unit 801 (FIG. 2) is provided. Developer cartridge 131, that is replaceable by users, is detachably attached to toner supply unit 801. In image formation unit 121, exposure apparatus 141 is provided to face photosensitive drum 51. In a similar manner, in image formation units 122 to 124, developer cartridges 132, 133, and 134 and exposure apparatuses 142, 143, and 144 are provided to face image formation units 122, 123, and 124, respectively.

As for axes X, Y, and Z in FIG. 1, the axis X extends in the transporting direction of recording paper 60 as it passes through image formation units 121 to 124; the axis Y extends in the direction of the rotational axis of photosensitive drum 51 described later; and the axis Z extends in a direction orthogonal to the axes X and Y. In other drawings, the axes X, Y, and Z indicate the same directions as the axes X, Y, and Z indicate in FIG. 1, respectively. That is to say, the axes X, Y, and Z in each drawing indicate directions of the positions of portions in the drawing, where the portions constitute image formation apparatus 1 illustrated in FIG. 1. Herein, the axis Z extends in the vertical direction.

In the first embodiment, image formation units 121 to 124 have the same configuration other than the color of toner as the used developer. Similarly, developer cartridges 131 to 134 have the same configuration other than the color of toner as the developer, and exposure apparatuses 141 to 144 have the same configuration other than the color of toner as the developer. Herein, image formation unit 121 for black (K) toner is taken as an example to describe the internal structure of the image formation unit.

Figure 2:
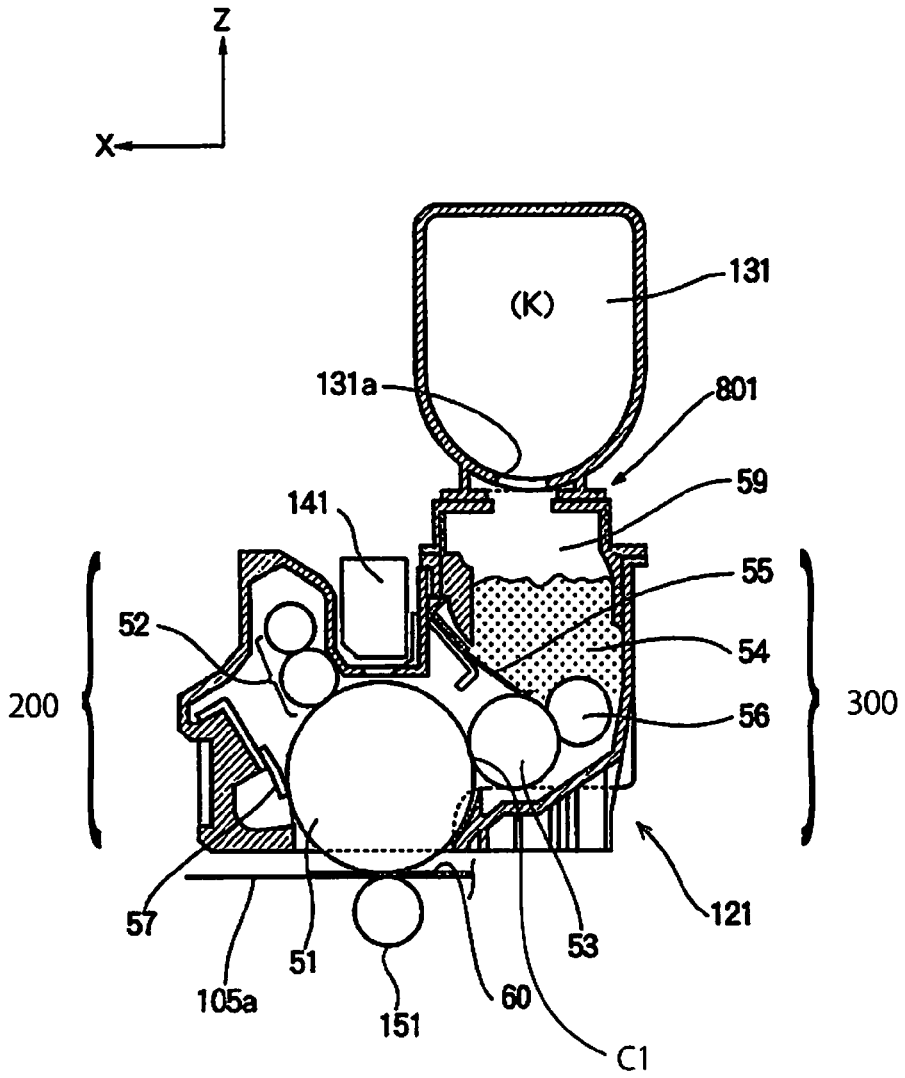
FIG. 2 is a schematic configuration view illustrating internal configurations of main parts of an image formation unit and a developer cartridge in the image formation apparatus.
Figure 3:
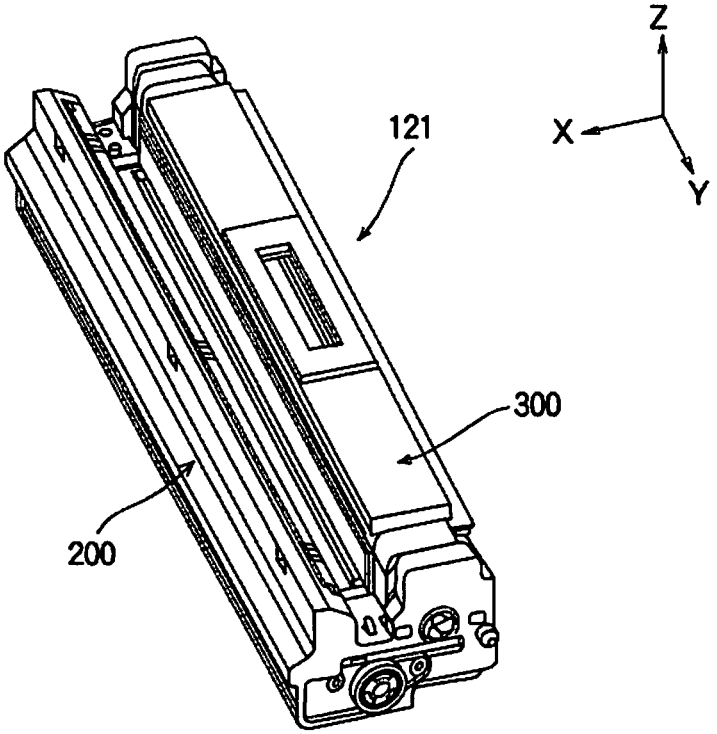
FIG. 3 is an external perspective view of the image formation unit.

FIG. 2 is a schematic configuration view illustrating the internal structure of main part of image formation unit 121 and developer cartridge 131. FIG. 3 is an external perspective view of image formation unit 121, and FIG. 4 is an exploded perspective view illustrating the state where the image formation unit 121 is divided into drum unit 200 and development unit 300.

Figure 4:
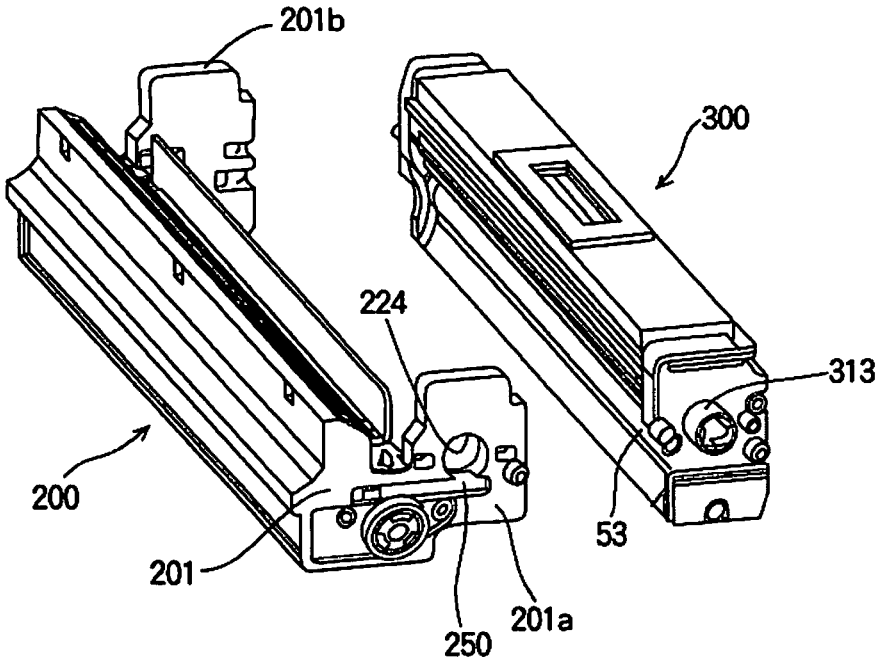
FIG. 4 is an exploded perspective view of the image formation unit, illustrating a state where the image formation unit is divided into a drum unit and a development unit.

As illustrated in FIGS. 2 to 4, image formation unit 121 includes two units: drum unit 200 as a first unit having photosensitive drum 51 as an image carrier and development unit 300 as a second unit having development roller 53 as a developer carrier. Development unit 300 is engaged with the frame of drum unit 200 so as to be integrated with drum unit 200.

Drum unit 200 includes: photosensitive drum 51, charge device 52, and cleaner 57. An electrostatic latent image is formed on the surface of photosensitive drum 51 by exposure device 141. Charge device 52 charges photosensitive drum 51. Cleaner 57 removes residual toner on photosensitive drum 51. Development unit 300 includes development roller 53, development blade 55, supply roller 56, and developer accommodation chamber 59.

Development roller 53 is configured to come into pressure contact with photosensitive drum 51. Development blade 55 is placed in pressure contact with development roller 53 and is configured to form a thin layer of toner 54 as the developer on the surface of development roller 53. Supply roller 56 supplies toner 54. Developer accommodation chamber 59 accommodates toner 54 supplied from developer cartridge 131 through toner supply unit 801, described later. In image formation unit 121, development roller 53 supplies toner 54 to the electrostatic latent image on photosensitive drum 51 for development of the electrostatic latent image, that is, for the formation of a toner image.

At the position opposite to the photosensitive drum 51, a transfer roller 151 is provided in pressure contact with the photosensitive drum 51 with transfer belt 105*a* interposed therebetween. The toner image formed on photosensitive drum 51 is transferred by the electrostatic force of transfer roller 151 onto recording paper 60 transported by transfer belt 105*a*. As illustrated in FIG. 1, in a similar manner, transfer rollers 152 to 154 are located corresponding to image formation units 122 to 124, respectively.

Drum unit 200 and development unit 300 extend in an axial direction of photosensitive drum 51.

Herein, a description is given of the outline of the print operation of image formation apparatus 1.

When the print operation is started, image formation apparatus 1 feeds recording paper 60 from paper feed cassette 107 by paper feeder 108 as shown in FIG. 1 and transports recording paper 60 to the downstream direction along paper transport path 103. In the transporting process by transfer belt 105*a*, image formation apparatus 1 sequentially transfers and overlays toner images, individually formed by image formation units 121 to 124, onto the recording surface of recording paper 60 by respective transfer rollers 151 to 154. After fixing the toner images onto the recording surface by fixer 106, image formation apparatus 1 transports printed recording paper 60 to stacker 104.

During the printing operation, in the image formation unit 121, black toner 54 supplied from developer cartridge 131 through later-described toner supply unit 801 is supplied to development roller 53 by supply roller 56. Black toner 54 supplied onto development roller 53 is leveled by development blade 55 into a uniform thickness. The electrostatic latent image formed on photosensitive drum 51 by exposure device 141 is visualized, that is, is developed by toner 54 having a uniform thickness into a toner image.

The toner image formed on photosensitive drum 51 is electrically transferred to recording paper 60 by transfer roller 151 as described above. The residual toner which is not transferred onto recording paper 60 and remains on the surface of photosensitive drum 51 is removed by cleaner 57 and is collected in a not-illustrated toner collection portion. In other image formation units 122 to 124, the same operation is performed when the individual toner images of respective colors are sequentially transferred in an overlapping manner.

Figure 5:
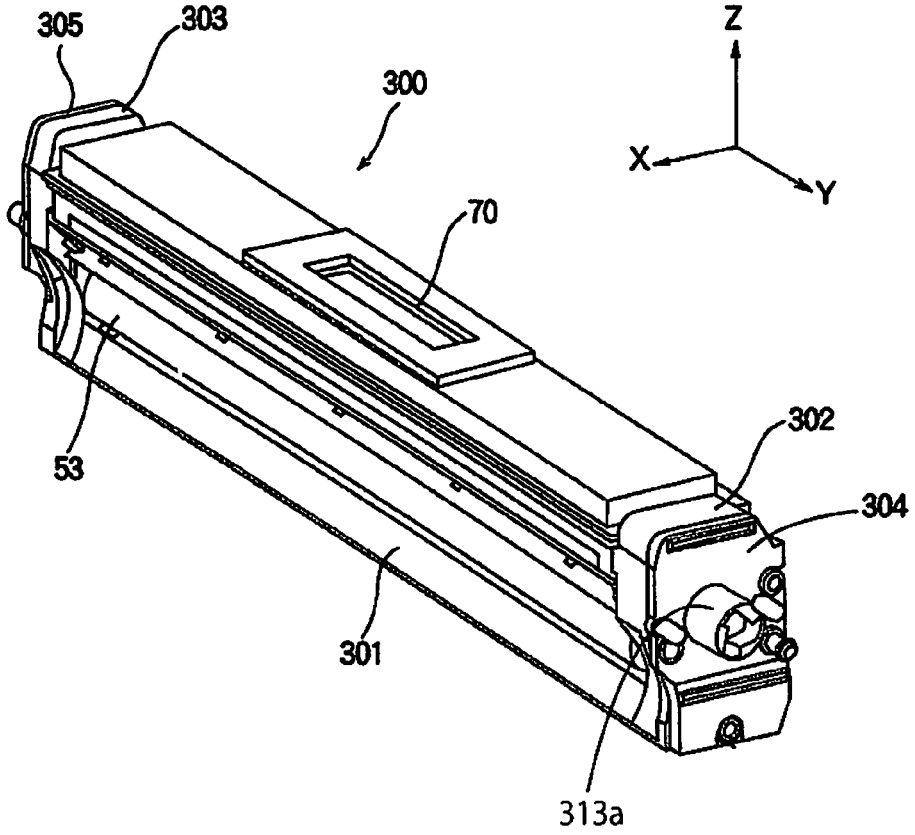
FIG. 5 is an external perspective view of the development unit.
Figure 6:
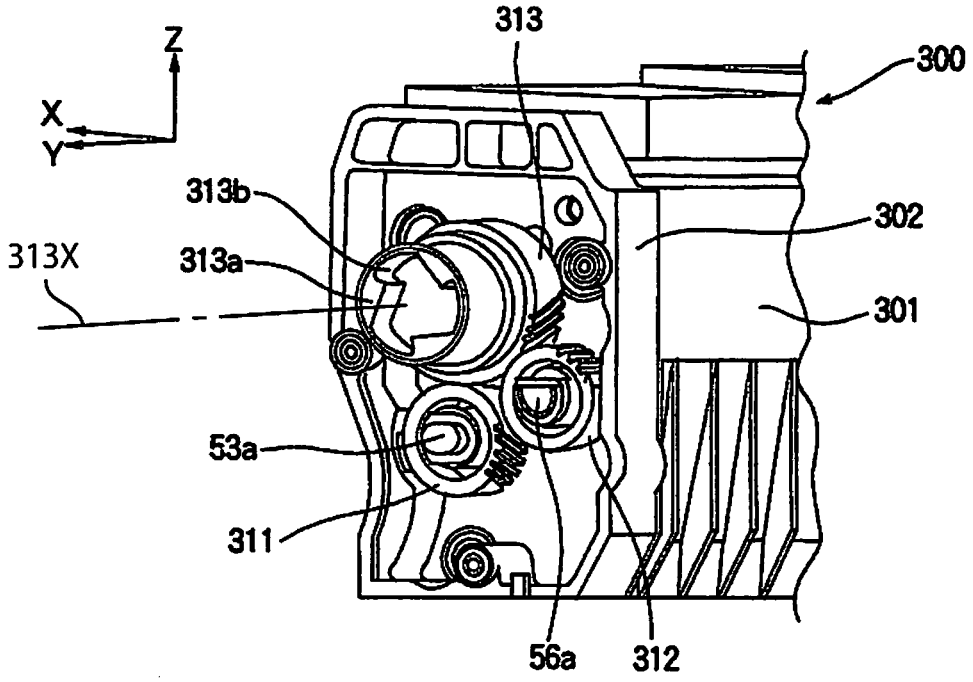
FIG. 6 is an external perspective view illustrating a drive portion provided for one end of the development unit, illustrating a state where an end frame at the one end is removed.
Figure 7:
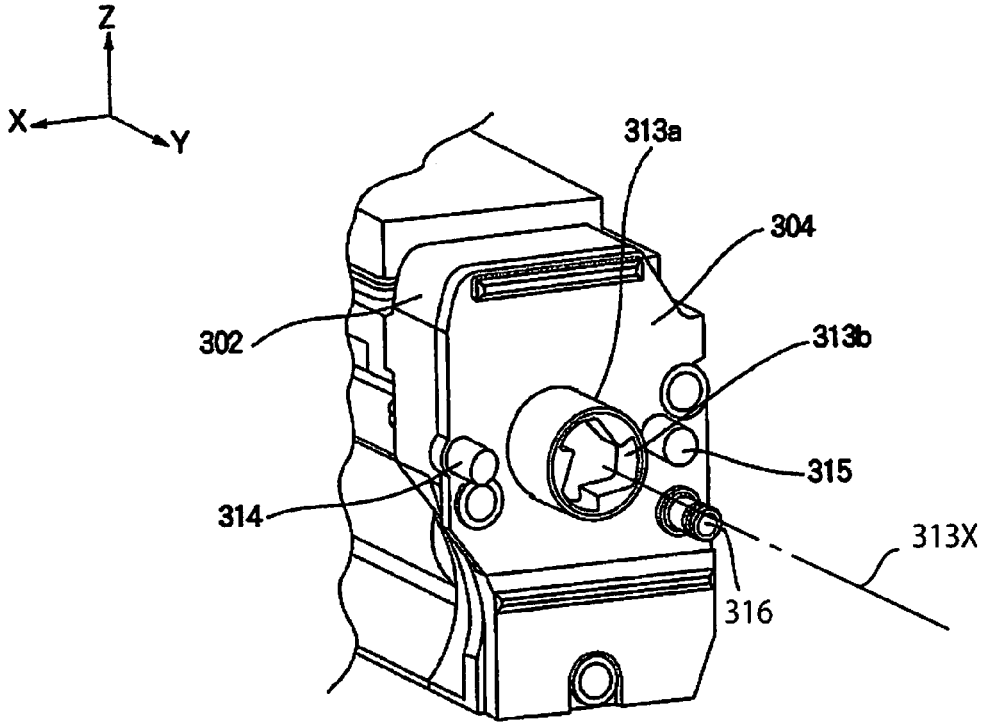
FIG. 7 is an external perspective view of the one end of the development unit, illustrating a state where the drive portion illustrated in FIG. 6 is covered with the end frame.
Figure 8:
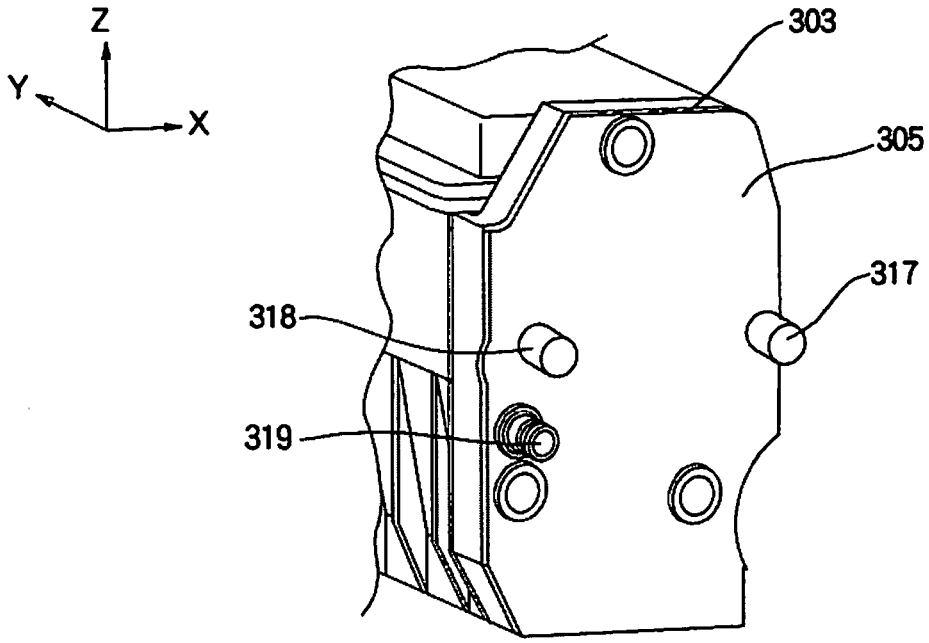
FIG. 8 is an external perspective view of the other end of the development unit, illustrating a state where the other end of the development unit is covered with an end frame.
Figure 12:
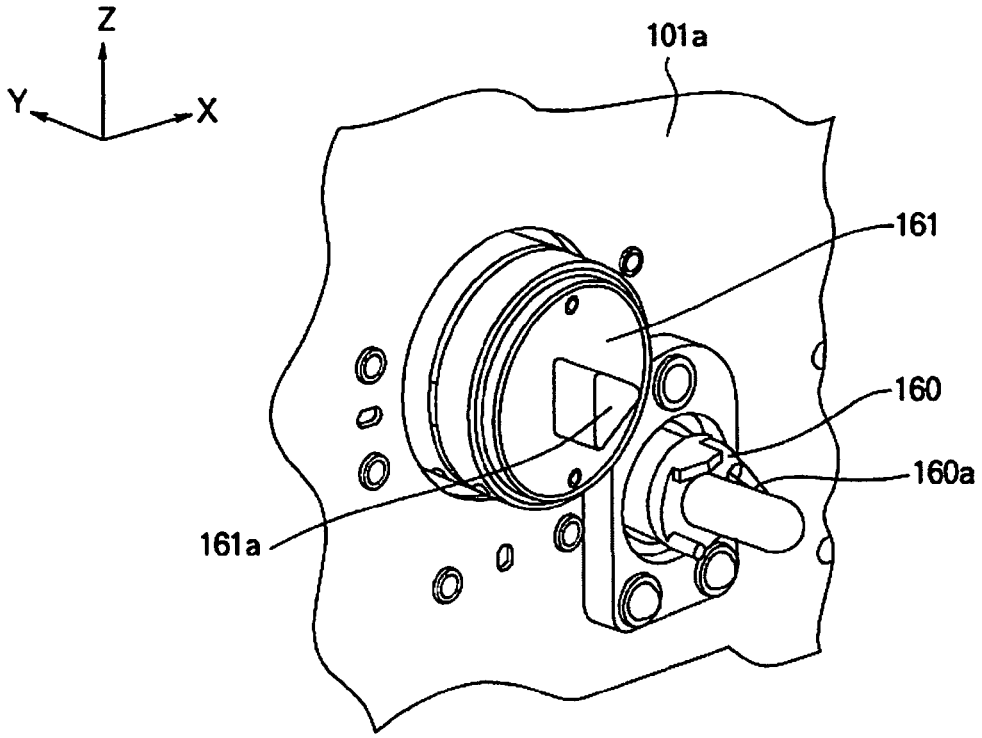
FIG. 12 is an external perspective view illustrating a drive force transmission unit provided for the body of the image formation apparatus.

Next, with reference to FIGS. 5 to 8 and 12, a description is further given of the configuration of development unit 300. FIG. 5 is an external perspective view of development unit 300. FIG. 6 is an external perspective view illustrating a drive portion provided at one end of development unit 300 with one of unit end frames 304 removed. FIG. 7 is an external perspective view illustrating a state where the drive portion is covered with development unit end frame 304. FIG. 8 is an external perspective view illustrating a state where the other end of development unit 300 is covered with development unit end frame 305. FIG. 12 is an external perspective view illustrating a driving force transmission portion provided on the body of image formation apparatus 1.

Development unit 300 includes development main frame 301 and development unit side frames 302 and 303. Development main frame 301 covers development roller 53 and supply roller 56 (FIG. 2) with a predetermined gap provided from each outer circumferential surface thereof, and forms a space of developer accommodation chamber 59 (FIG. 2). Development unit side frames 302 and 303 are provided at both ends of development main frame 301 and are configured to support development and supply rollers 53 and 56 so that development and supply rollers 53 and 56 can rotate. In the upper surface of development unit 300, toner supply port 70 is formed communicating with developer accommodation chamber 59.

On the outer side surface of development unit side frame 302, a drive gear train that rotates development and supply rollers 53 and 56 is located. The gear train includes development roller gear 311, supply roller gear 312, and drive receiving gear 313 as a drive input portion. Development roller gear 311 is fixed to an end of rotation axle 53*a* of development roller 53. Supply roller gear 312 is fixed to an end of rotation axle 56*a* of supply roller 56. Drive receiving gear 313 is rotatably held by a not-illustrated rotation axle formed on development unit side frame 302, and is engaged with development roller gear 311 and supply roller gear 312.

Drive receiving gear 313 includes joint portion 313*a* protruding in the direction of the rotational axis. Recesses 313*b* are formed in the joint portion 313*a*. As described later, when image formation unit 121, including integrated development and drum units 300 and 200, is attached to the body of image formation apparatus 1 and top cover 109 is then closed, protrusions 161*a* of development unit drive output portion 161 (FIG. 12) provided for the body of image formation apparatus 1 are inserted in respective recesses 313*b* of joint portion 313*a*.

A description is next given of a method of attaching image formation unit 121 to the body of image formation apparatus 1. As illustrated in FIG. 1, development unit drive output portion 161 and drum unit drive output coupling 160 are formed on left sidewall 101*a* (FIG. 12) located on the near side (the positive side of the axis Y) of lower frame 101 of image formation apparatus 1. Development unit drive output portion 161 is configured to transmit a drive to development unit 300. Drum unit drive output coupling 160 is configured to transmit a drive to photosensitive drum 51. On the other hand, a right sidewall (not illustrated) is formed on the far side (the negative side of the axis Y) of lower frame 101 of image formation apparatus 1 illustrated in FIG. 1 so as to be freely opened and closed.

Accordingly, to attach image formation unit 121 to the body of image formation apparatus 1, at first, the right sidewall of lower frame 101 is opened, and the image formation unit 121 is slid in the positive direction of the axis Y and is pressed into the body of image formation apparatus 1 until protrusions 161*a* (FIG. 12) of development unit drive output portion 161 fit in recesses 313*b* formed in joint portion 313. Left sidewall 101*a* is then closed to position image formation unit 121 in image formation apparatus 1.

Development unit drive output portion 161, which includes protrusions 161*a* fitting into recesses 313*b* of joint portion 313*a* of drive receiving gear 313, also includes a general Oldham' coupling mechanism (not illustrated) inside. The general Oldham' coupling mechanism performs a drive transmission in which no self-aligning mechanism would work even if there is a slight misalignment between the centers of development unit drive output portion 161 and joint portion 313*a* of drive receiving gear 313.

Development unit drive output portion 161 and drum-unit drive output coupling 160, which is coupled to the later-described drum joint portion 210 (FIG. 10), work with the opening and closing operation of top cover 109 by a not-illustrated link mechanism.

The position of drum-unit drive output coupling 160 in the direction of the rotational axis of photosensitive drum 51, and the position of development unit drive output portion 161 in the direction of the rotational axis of drive receiving gear 313, differ between when the top cover 109 is opened and when the top cover 109 is closed.

To be specific, when the top cover 109 is opened, drum unit drive output coupling 160 is moved to a position where drum unit drive output coupling 160 is separated from drum-unit joint portion 210 and does not transmit a rotational force to the same. Likewise when the top cover 109 is opened, development unit drive output portion 161 is moved to a position where development unit drive output portion 161 is separated from drive receiving gear 313 and does not transmit the rotational force to the same. When the top cover 109 is closed, drum unit drive output coupling 160 is moved to a position where drum unit drive output coupling 160 is engaged with drum unit joint portion 210 and transmits a rotational force to the same. Likewise when the top cover 109 is closed, development unit drive output portion 161 is moved to a position where development unit drive output portion is engaged with drive receiving gear 313 and transmits the rotational force to the same.

As illustrated in FIG. 7, development unit side frame 302 is covered with development unit end frame 304 from the outside in the direction of the rotational axis and is fixed. Development unit end frame 304 includes an opening through which only joint portion 313 of drive receiving gear 313 penetrates to the outside and covers the other portion including the gear train. As illustrated in FIG. 8, development unit side frame 303 is covered with development unit end frame 305 from the outside in the direction of the rotational axis and is fixed. Development unit end frame 305 covers bearings for development roller 53 and supply roller 56 that are formed in development unit side frame 303.

In development unit end frame 304, support post 314 as a first engaged portion and support post 315 as a second engaged portion are formed integrally on end frame 304. Support posts 314 and 315 protrude from end frame 304 to the outside in parallel to the direction of the rotational axis of development roller 53. Moreover, support posts 314 and 315 are located on both sides of joint portion 313*a* of drive receiving gear 313. Paired support posts 314 and 315 are located on both sides of the center of gravity of development unit 300 on a same horizontal line, which passes through the center of the rotation axle of drive receiving gear 313 and is substantially vertical to the direction of gravity. Herein, the substantially vertical direction is a direction at an angle of 80° to 100°.

Moreover, the rotational axis of drive receiving gear 313 is provided substantially at the middle between the centers of support posts 314 and 315. This means that the distance between the rotational axis of drive receiving gear 313 and support post 314 is in a range of 35 to 65% of the distance between the centers of support posts 314 and 315.

In this case, the horizontal positions of support posts 314 and 315 do not need to be equally distant from the rotational center of drive receiving gear 313. Moreover, if support posts 314 and 315 are arranged at equal distances from the rotation center of drive receiving gear 313 on the same straight line passing through the rotational center of drive receiving gear 313, the same straight line may be at an angle from the horizontal line. The reasons therefor are described later.

Below support post 315, bias member support post 316 made of metal is provided. A later-described bias member 250 (FIG. 10) is hooked on bias member support post 316.

On the other hand, as illustrated in FIG. 8, support posts 317 and 318 formed on development unit end frame 305 and bias member support post 319 are plane-symmetrical to support posts 314 and 315 formed on development unit end frame 304 and bias member support post 316 with respect to a virtual plane perpendicularly intersecting the rotational axis of development roller 53 at the center of development unit 300.

In the first embodiment, support posts 314 and 315 are integrally formed on development unit end frame 304. However, support posts 314 and 315 may be formed as metallic posts, for example, to be attached to development unit end frame 304 or may be formed on development unit side frame 302. Support posts 317 and 318 may be configured in a similar fashion.

Figure 9:
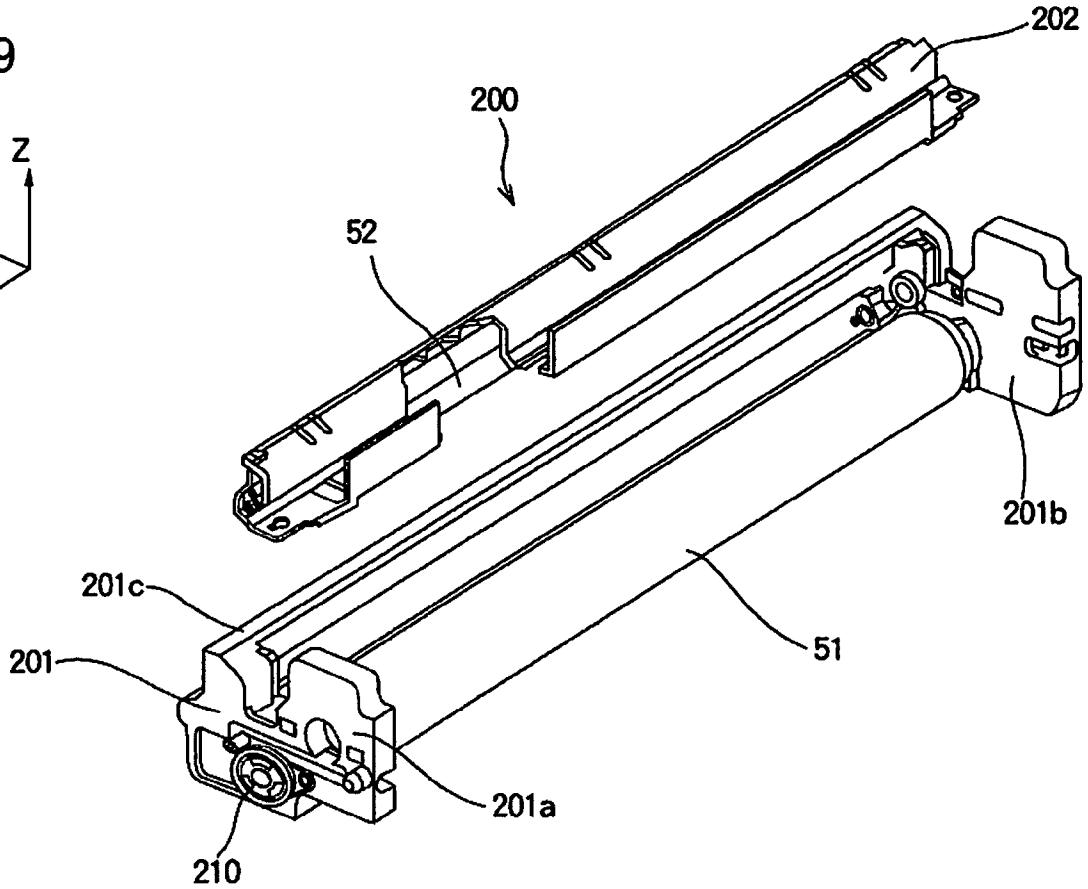
FIG. 9 is an exploded perspective view of the drum unit.
Figure 10:
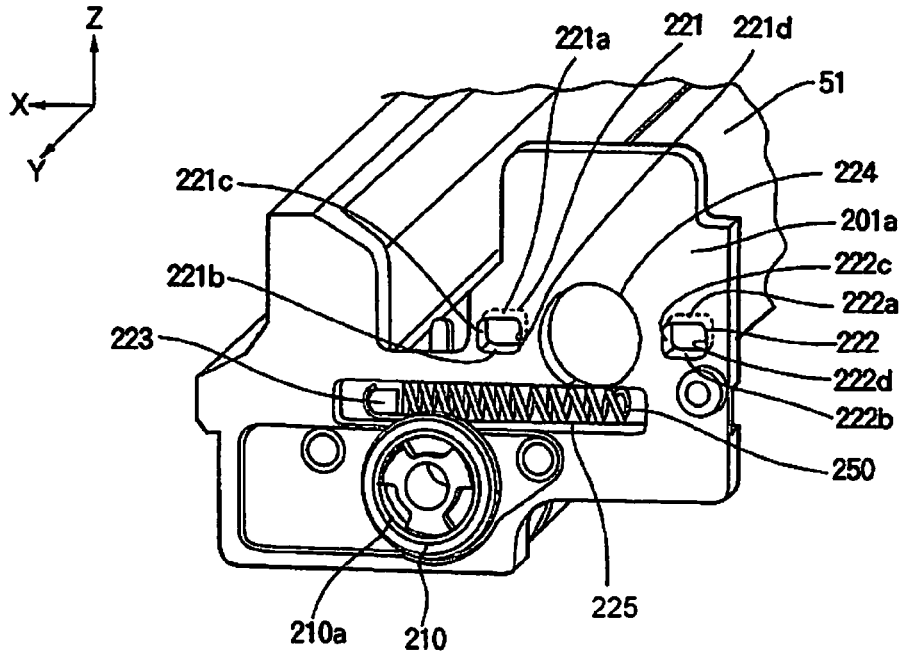
FIG. 10 is an enlarged external perspective view of a part including one sidewall portion of a main frame of the drum unit illustrated in FIG. 9.
Figure 11:
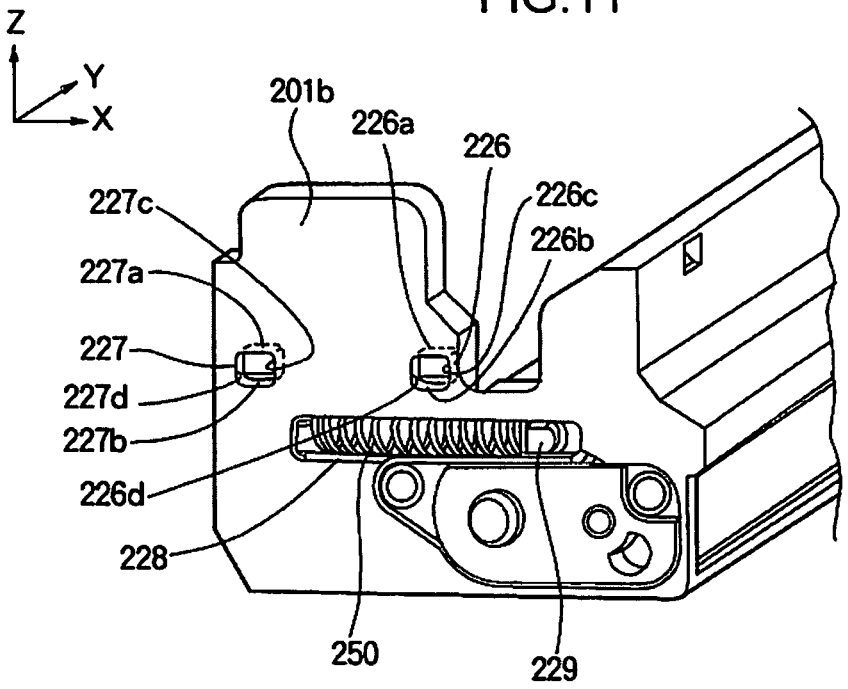
FIG. 11 is an external perspective view of a part including the other sidewall portion of the main frame of the drum unit illustrated in FIG. 9, viewed in the opposite direction to that of FIG. 10.

Next, with reference to FIGS. 9 to 11 and 12, a description is further given of the configuration of drum unit 200. FIG. 9 is an exploded perspective view of drum unit 200. FIG. 10 is an enlarged external perspective view illustrating one sidewall portion 201*a* of main frame 201 of drum unit 200 illustrated in FIG. 9. FIG. 11 is an external perspective view of the other sidewall portion 201*b* of main frame 201 of drum unit 200, as seen in the direction opposite to that of FIG. 10.

Drum unit 200 includes sub-frame 202 and main frame 201. Sub-frame 202 is provided with charge device 52 and cleaner 57 (FIG. 2). Main frame 201 holds photosensitive drum 51 so that photosensitive drum 51 can freely rotate. Sub-frame 202 is attached to main frame 201. Sub-frame 202 is formed so as to cover charge device 52 and cleaner 57 and is attached to base portion 201*c* of main frame 201. Main frame 201 includes base portion 201*c* and sidewall portions 201*a* and 201*b* and has a substantially squared U-shape as a whole. Base portion 201*c* extends in the direction of the rotational axis of photosensitive drum 51. Sidewall portions 201*a* and 201*b* are formed at both ends in the direction of the rotational axis of photosensitive drum 51 so as to face each other and sandwich base portion 210*c*. The sidewall portions are configured to hold both ends of the rotation axle of photoreceptor drum 51 so that photoreceptor drum 51 can rotate.

As illustrated in FIG. 3, when sub-frame 202 is attached to main frame 201, charge device 52 and cleaner 57 extend in parallel to photosensitive drum 51 and are in contact with photosensitive drum 51 with predetermined contact pressures.

As illustrated in FIG. 10, at one end of the rotation axle of photosensitive drum 51, drum joint portion 210 is fixed to the outside of sidewall portion 201*a* supporting the photosensitive drum 51. In drum joint portion 210, three recesses 210*a* are formed into which respective three protrusions 160*a* (FIG. 12) of drum-unit drive output coupling 160, provided for in the body of image formation apparatus 1, are fit when top cover 109 is closed after development unit 300 and drum unit 200 are integrated and then attached to the body of image formation apparatus 1.

In drum sidewall 201*a* of main frame 201, through-hole 224 is formed, through which joint portion 313*a* of drive receiving gear 313 located in development unit 300 penetrates when development unit 300 is attached to drum unit 200. The inner diameter of through-hole 224 is slightly larger than the outer diameter of penetrating joint portion 313*a*, so that a predetermined gap is formed therebetween. On both sides of through-hole 224, position limiting hole 221 as a first engagement portion and position limiting hole 222 as a second engagement portion are formed. Support post 314 (FIG. 7) provided in development unit 300 fits in position limiting hole 221. Support post 315 (FIG. 7) provided in development unit 300 fits in position limiting hole 222.

The position limiting holes 221 and 222 as the first and second engagement portions are provided substantially point symmetrically with respect to the center of rotation of drive input portion 313 (FIG. 10). Position limiting holes 221 and 222 are provided side by side with a predetermined distance therebetween in the short-side direction (in the direction orthogonal to the axial direction of photosensitive drum 51).

Upper surface 221*a* and lower surface 221*b* of position limiting hole 221 are parallel to each other and are configured to extend substantially vertically to the direction of gravity (substantially horizontally) when image formation unit 121 is attached to the body of image formation apparatus 1, as described later. The distance between upper and lower surfaces 221*a* and 221*b* is set slightly larger than the outer diameter of support post 314 that is inserted into position limiting hole 221. The other position limiting hole 222 is formed in a similar fashion. To be specific, upper surface 222*a* and lower surface 222*b* of position limiting hole 222 are parallel to each other and are configured to extend substantially vertically to the direction of gravity (substantially horizontally) when image formation unit 121 is attached to the body of image formation apparatus 1 as described later. Moreover, the distance between upper and lower surfaces 222*a* and 222*b* is set slightly larger than the outer diameter of support post 315 that is inserted into position limiting hole 222. Desirably, the gaps formed between position limiting hole 221 and support post 314, and formed between position limiting hole 222 and support post 315, are about 0.01 to 0.05 mm in the vertical direction.

Surfaces 221*c* and 221*d* of position limiting hole 221 face each other so as to limit the movement of support post 314 moving along upper or lower surface 221*a* or 221*b* of position limiting hole 221. The distance between surfaces 221*c* and 221*d* is set larger than the outer diameter of support post 314 so that development roller 53 is biased toward photosensitive drum 51 by the biasing of bias member 250 as described later. Herein, the distance between surfaces 221*c* and 221*d* is set 1 to 5 mm larger than the outer diameter of support post 314. The shapes of surfaces 222*c* and 222*d* of position limiting hole 222 and the relationship of the same with support post 315 are the same as those of position limiting hole 221. Accordingly, position limiting holes 221 and 222 are elongated holes with the longitudinal direction set to the substantially horizontal direction, which is substantially perpendicular to the direction of gravity. More specifically, position limiting holes 221 and 222 are elongated holes with the longitudinal direction thereof set to the horizontal direction that is perpendicular to the direction of gravity (at 90 degrees).

Under position limiting hole 221, groove 225 accommodating bias member 250 and bias member fixing post 223, to which an end of bias member 250 is fixed, are formed, as illustrated in FIG. 10.

On the other hand, as illustrated in FIG. 11, position limiting holes 226, 227, groove 228, and bias member fixing post 229, that are formed on sidewall portion 201*b*, are plane-symmetric to position limiting holes 221 and 222, groove 225, and bias member fixing post 223, that are formed on sidewall portion 201*a*, with respect to a virtual plane that perpendicularly intersects the rotational axis of photosensitive drum 51 at the center of drum unit 200. Accordingly and similar to position limiting holes 221 and 222, position limiting holes 226 and 227 are substantially point-symmetric with respect to the center of rotation of drive input portion (see FIG. 10). Moreover, it is desirable that the gap between position limiting hole 226 and support post 317 and the gap between position limiting hole 227 and support post 318 are about 0.01 to 0.05 mm in the vertical direction. Position limiting holes 226 and 227 are elongated holes, like position limiting holes 221 and 221, with the longitudinal direction thereof set substantially to the horizontal direction that is perpendicular to the direction of gravity. More specifically, position limiting holes 226 and 227 are elongated holes with the longitudinal direction thereof set to the horizontal direction that is perpendicular to the direction of gravity (at 90 degrees).

Figure 13:
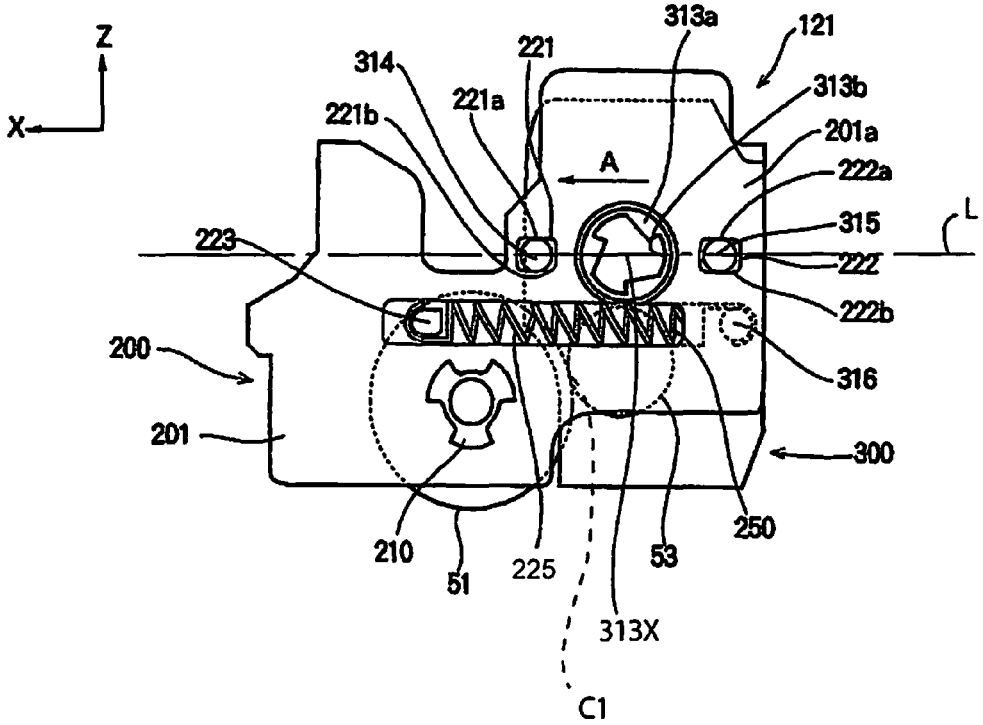
FIG. 13 is a state explanatory view illustrating a state where the development unit is attached to and is engaged with the drum unit.

FIG. 13 is a state explanatory view illustrating image formation unit 121, that is, the drum unit 200 and development unit 300 attached and engaged with each other. The state explanatory view of FIG. 13 illustrates the state where the image formation unit 121 is attached to the body of image formation apparatus 1.

At this time, support posts 314 and 315 (317 and 318) are respectively fit in position limiting holes 221 and 222 (226 and 227) of drum unit 200 and come into contact with vertically lower surfaces 221*b* and 222*b* (226*b* and 227*b*) of position limiting holes 221 and 222 (226 and 227) to slid on the same, so that development unit 300 is supported so as to move in the horizontal direction (the direction that development roller 53 moves close to or away from photosensitive drum 51). An end of bias member 250 (250) is fixed to bias member fixing post 223 (229) of drum unit main frame 201, and the other end thereof is fixed to bias member fixing post 316 (319) of drum unit 300. Reference numerals in brackets indicate the relationship between sidewall portion 201*b* and development unit end frame 305, not illustrated in FIG. 13.

The operation between sidewall portion 201*b* and development unit end frame 305 is the same as that between sidewall portion 201*a* and development unit end frame 304. Hereinafter, only the operation between sidewall portion 201*a* and development unit end frame 304 is described below as an example.

At this time, bias member 250 extends and stretches in the substantially horizontal direction and is located between the positions of support posts 314 and 315 and the position of the contact between photosensitive drum 51 and development roller 53 in the vertical direction. By biasing development unit 300 by the bias member being located at the above-described position, development unit 300 can be moved without being influenced by any force due to new rotational moment. Accordingly, development unit 300 is subjected to a bias force in the direction of arrow A in the drawing to move in the horizontal direction with respect to drum unit 200, and photosensitive drum 51 and development roller 53 come into contact with a predetermined pressure.

As image formation unit 121 is used to the end of its life, development roller 53 and supply roller 56 become worn at the outer circumferences. Support posts 314 and 315 therefore move toward photosensitive drum 51 in position limiting holes 221 and 222, respectively. For allowing such movement, position limiting holes 221 and 222 need to have widths larger than the respective outer diameters of support posts 314 and 315 by the amounts of movement of the support posts due to wearing.

Next, a description is given of forces generated during operation of image formation unit 121. There are three kinds of forces acting on development unit 300: a rotational force generated around drive receiving gear 313 by the load torque of development unit 300; a gravity force from the weight of development unit 300; and a frictional force at the contact between photosensitive drum 51 and development roller 53. As for the magnitudes of the forces acting on development roller 53 due to each type of force, the force due to the rotational force is about 1.5 to 2.5 Kgf; the force due to gravity is about 1 to 2 Kgf, and the frictional force is about 0.3 Kgf. Among the three forces, the rotational and gravity forces are large, and the frictional force is very small. The variation and fluctuation of the frictional force are further small, and there is no problem even if the influence of the frictional force on the pressure of contact between photosensitive drum 51 and development roller 53 is ignored. The force influencing the pressure of contact between photosensitive drum 51 and development roller 53 can, therefore, be considered to include the rotational and gravity forces. Accordingly, by eliminating the influence of the rotational force and gravity, the pressure of contact between photosensitive drum 51 and development roller 53 can be prevented from changing.

Figure 14:
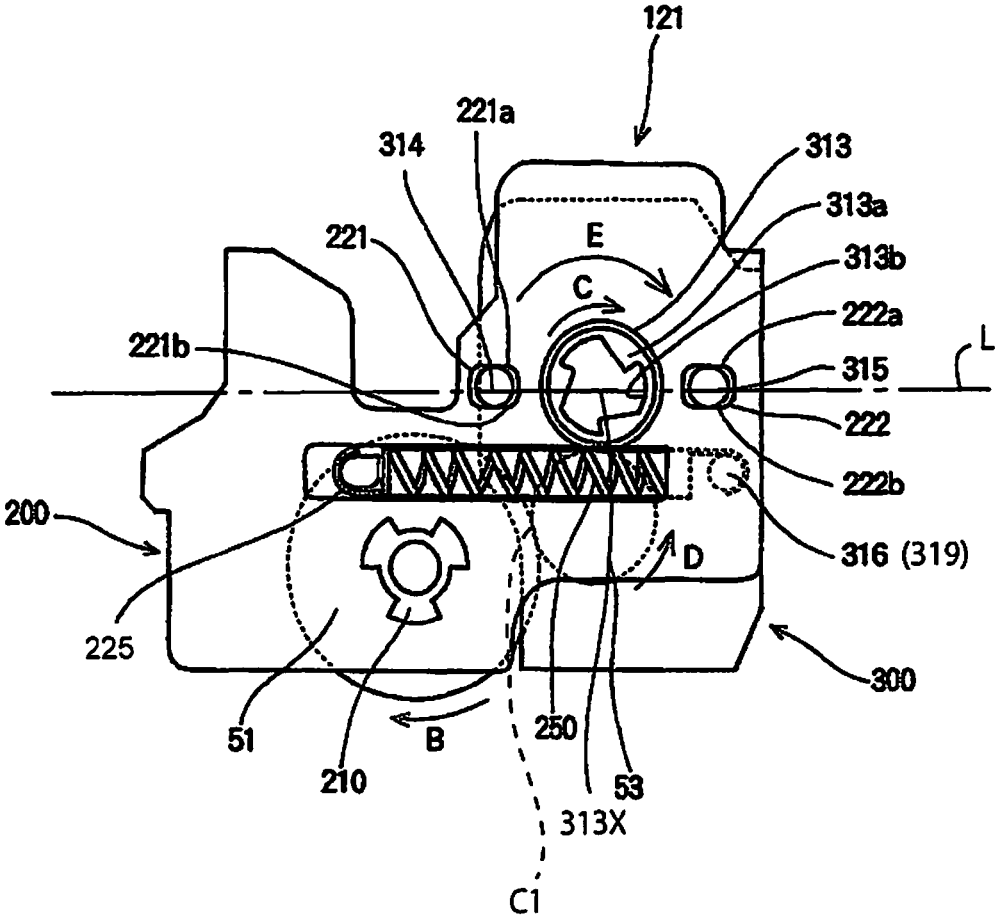
FIG. 14 is a view for explaining the influence of forces produced during operation of the image formation unit on the image formation unit in the first embodiment.

Herein, a description is given of an influence of the forces generated during operation of image formation unit 121 on image formation unit 121 with reference to FIG. 14.

When image formation unit 121 is attached to the body of image formation apparatus 1 and top cover 109 is then closed, as described above, drum-unit drive output coupling 160 of the drive force transmission portion (FIG. 12) provided for the body of image formation apparatus 1 is mechanically connected to drum joint portion 210 of image formation unit 121, and development unit drive output portion 161 of the body is mechanically connected to joint portion 313*a* of drive receiving gear 313 of image formation unit 121. Accordingly, upon receiving drive force from the body of image formation apparatus 1 according to the printing operation of image formation apparatus 1, photosensitive drum 51 and drive receiving gear 313 rotate in directions of arrows B and C at predetermined rotation speeds, respectively.

As illustrated in FIG. 6, development roller 53, that includes development roller gear 311 mated with drive receiving gear 313, receives a drive transmitted by the rotation of drive receiving gear 313 in the direction of arrow C and rotates in a direction of arrow D to start the printing operation. At this time, development unit 300 is subjected to the gravity force of its own weight and the force due to the rotational moment that is generated by its own load torque and tries to rotate development unit 300 around drive receiving gear 313 in the direction of arrow E.

Figure 15A:
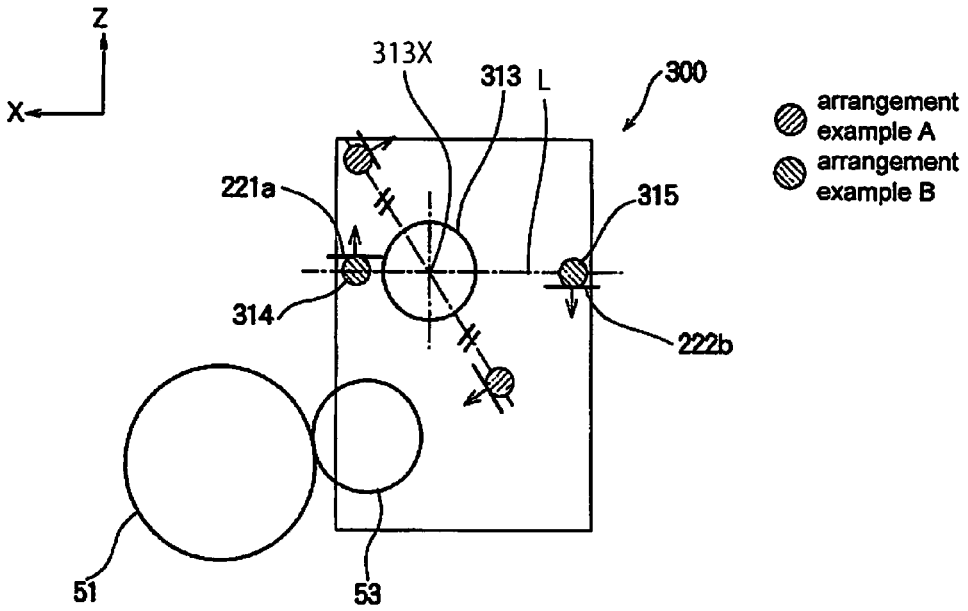
FIGS. 15A and 15B are schematic views for explaining factors of variation influencing the pressure of contact between the photosensitive drum and development roller which varies on the positions of support posts with respect to the center of rotation of a drive receiving gear, with FIG. 15A illustrating an influence of force due to rotation moment, and FIG. 15B illustrating an influence of its own weight.
Figure 15B:
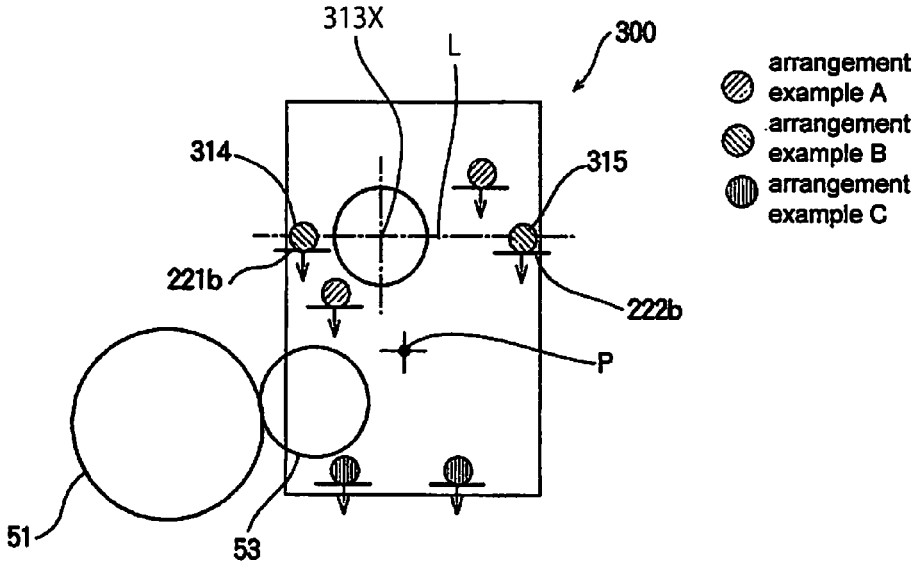

FIGS. 15A and 15B are schematic views for explaining factors of change in pressure of contact between photosensitive drum 51 and development roller 53 depending on the positions of support posts 314 and 315 with respect to the center of rotation of drive receiving gear 313.

Hereinafter, with reference to FIGS. 15A and 15B, a description is given of a method to reduce the influence of the factors for variation in the pressure of contact between photosensitive 51 and development roller 53 due to the forces by the aforementioned rotation moment and gravity. The operation between sidewall portion 201*b* (FIG. 9) and development unit end frame 305 (FIG. 8) is the same as that between sidewall portion 201*a* (FIG. 9) and development unit end frame 304 (FIG. 7). The following description takes into account only the operation between sidewall portion 201*a* and development unit end frame 304 as an example.

In the first embodiment, image formation unit 121 is detachably provided for the body of image formation apparatus 1, and development unit 300, which holds development roller 53 so that development roller 53 can rotate, is slidably attached to drum unit 200 to constitute image formation unit 121 together with drum unit 200. Accordingly, when drive receiving gear 313 illustrated in FIG. 14 rotates in the direction of arrow C, by the rotational load torque of development roller 53, the force due to the rotation moment in the direction of arrow E, illustrated in FIG. 14, acts on development unit 300 and is transmitted to drum unit 200 via support posts 314 and 315 and position limiting holes 221 and 222 into which support ports 314 and 314 are fitted.

Accordingly, the first condition to be considered is that the resultant of forces that are produced by the force due to rotation moment and act in the sliding direction on support posts 314 and 315, that are respectively fit into position limiting holes 221 and 222, should not occur in the sliding direction (in the horizontal direction herein). For the resultant force changes with change in rotation load torque, the resultant force produced in the sliding force influences the pressure of contact between photosensitive drum 51 and development roller 53 and changes that contact pressure.

The second condition to be considered is that the resultant of forces that are generated by gravity from the weight of development unit 300 and act in the sliding direction on support posts 314 and 315, respectively fitting into position limiting holes 221 and 222, should not occur in the sliding direction (in the horizontal direction herein). For the resultant force changes with change in the gravity force of development unit 300 associated with the consumption or replenishment of toner, the pressure of contact between photosensitive drum 51 and development roller 53 changes if the resultant force acts in the sliding direction in a similar manner.

As illustrated in FIG. 14, first, drive receiving gear 313 as the drive input portion is provided between the portion at which the position limiting holes 221 as the first engagement portion is engaged with support post 314 as the first engaged portion, and the portion at which the position limiting holes 222 as the second engagement portion is engaged with support post 315 as the second engaged portion. This can reduce the force which is generated in the drive receiving gear 313 itself and acts to change the position of the same when the drive receiving gear 313 rotates. Accordingly, the change in pressure of contact between the photosensitive drum 51 and development roller 53 caused by the above force can be reduced.

Furthermore, in the first embodiment, as illustrated as arrangement example B in FIG. 15A, the center of drive receiving gear 313 and support posts 314 and 315 are aligned on a straight line in the horizontal direction. Moreover, upper surface 221*a* of position limiting hole 221 and lower surface 222*b* of position limiting hole 222, which are parallel to the direction of the radius of drive receiving gear 313 passing through the center thereof and the centers of support posts 314 and 315, are subjected to forces due to the rotation moment by support posts 314 and 315. At each engagement portion, therefore, forces act only in the vertical direction, which satisfies the first condition to be considered. This prevents generation of forces that press development roller 53 against photosensitive drum 51 or separate the same from photosensitive drum 51, thus reducing the change in pressure of contact between drum 51 and development roller 53.

When the surfaces of position limiting holes 221 and 222 which are subjected to the forces due to rotation moment are formed as described above, as illustrated as arrangement example A in FIG. 15A, for example, no force acts in the sliding direction at each engagement portion even if the center of drive receiving gear 313 and support posts 314 and 315 are aligned on the same straight line which is inclined from the horizontal direction. Such an arrangement satisfies the first condition to be considered. The center of drive receiving gear 313 is located at an equal distance from support posts 314 and 315 in the example illustrated in the drawing but may be located at different distances.

Next, in arrangement examples A, B, and C illustrated in FIG. 15B, the center P of gravity of development unit 300 is located between support posts 314 and 315 in the horizontal direction, and lower surfaces 221*b* and 222*b* of position limiting holes 221 and 222, that are horizontal, are subjected to the gravity of image formation unit 121 from support posts 314 and 315, respectively. This satisfies the second condition to be considered and prevents the occurrence of forces that press development roller 53 against photosensitive drum 51 or separate the same from photosensitive drum 51, thus reducing the change in pressure of contact between drum 51 and development roller 53.

Next, consideration is made for an arrangement that simultaneously satisfies the aforementioned first and second conditions.

Figure 16A:
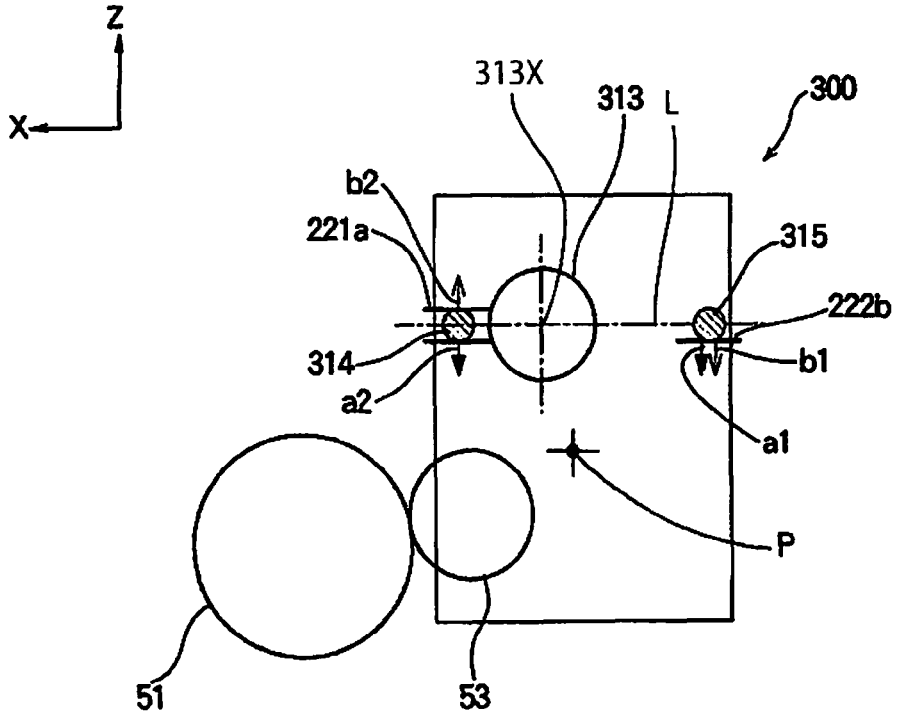
FIGS. 16A and 16B are views illustrating examples of the arrangement where the pressure of contact between the photosensitive drum and development roller is not influenced by the force due to the rotation moment or by the force due to its own weight.

In order to satisfy the second condition, as illustrated in FIG. 15B, lower surfaces 221*b* and 222*b* of position limiting holes 221 and 222 are positioned horizontally, and are formed so that development unit 300 can slide in the horizontal direction. Furthermore, in order to satisfy the first condition, the position limiting holes 221 and 222 are arranged as illustrated in FIG. 16A. This arrangement is the same as arrangement example B, the description of which is thus omitted, but such an arrangement can satisfy the first condition. In this case, as illustrated in the drawing, the center of drive receiving gear 313 does not need to be equally distant from the support posts 314 and 315. Reference numerals a1 and a2 in FIG. 16A indicate gravity forces acting on the limiting surfaces at the respective engagement portions in the vertical direction. Reference numerals b1 and b2 in FIG. 16A indicate forces due to the rotation moment acting on the limiting surfaces at the respective engagement portions in the vertical direction.

Herein, it is preferable that the center of rotation of drive receiving gear 313 is provided near line L connecting the centers of support posts 314 and 315 as the first and second engaged portions. To be specific, it is preferable that distance D2 between the center of rotation of drive receiving gear 313 and straight line L is not more than 20% of distance D1 between support posts 314 and 315. It was confirmed by experiments that such an arrangement can provide a substantially similar effect to the arrangement where the support posts 314 and 315 and the center of rotation of drive receiving gear 313 are aligned on a same line.

Figure 16B:
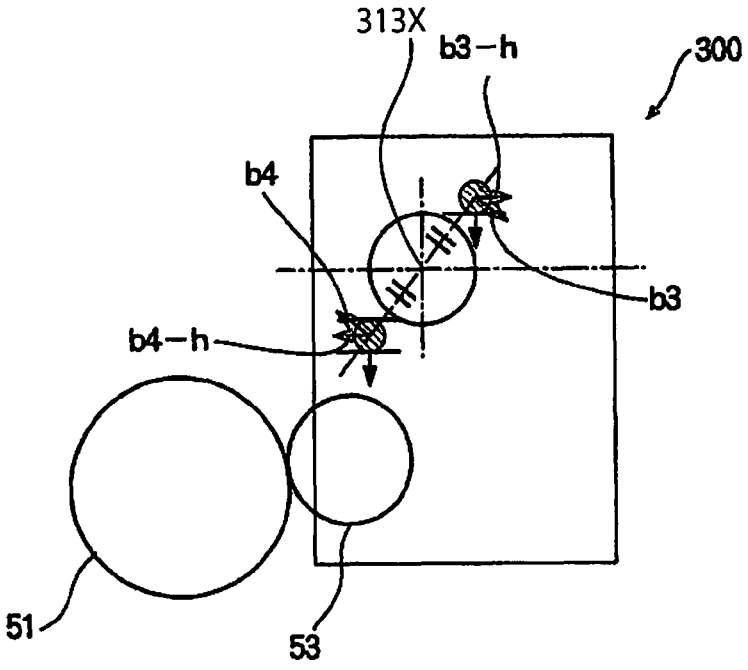

Furthermore, as illustrated in FIG. 16B, even when position limiting holes 221 and 222 are formed so that development unit 300 can slide in the horizontal direction so as to satisfy the second condition, and the center of drive receiving gear 313 and support posts 319 and 315 are aligned on a straight line inclined from the horizontal direction, the first condition can be simultaneously satisfied if the center of drive receiving gear 313 is equally distant from each support post. In this case, since the limiting surfaces are horizontal, horizontal components b3-*h* and b4-*h* of forces b3 and b9 due to rotation moment act on the respective limiting surfaces. Horizontal components b3-*h* and b4-*h* act in the opposite directions to each other and have the same magnitude. Accordingly, the resultant force of horizontal components b3-*h* and b4-*h* does not act in the sliding direction. The above arrangement can therefore satisfy the first condition to be considered.

As described above, it is preferable that drive gear 313 is provided substantially at the middle between support posts 314 and 315 as the first and second engaged portions. To be specific, it is preferable that distance D3 between the center of rotation of drive receiving gear 313 and support post 314 is in a range of 40 to 60% of distance D1 between support posts 314 and 315. In this case, it was confirmed by experiments that such an arrangement could provide a similar effect to the case where distance D3 is 50% of distance D1 (the arrangement illustrated in FIG. 16B).

Accordingly, each of support posts 314, 315, 317, and 318 of development unit 300 is subjected to force components by about one fourth of the rotation moment and one fourth of the gravity force of its own weight, and the resultant force thereof acts on the lower or upper surface of a corresponding one of position limiting holes 221, 222, 226, and 227. However, movements of support posts 314, 315, 317, and 318 in the vertical direction are limited. At this time, the horizontal components are originally not generated or cancel each other even if generated. Accordingly, in the process of printing, the force acting on the development unit 300 in the horizontal direction includes only the bias force by bias member 250.

In the first embodiment, drum unit 200 includes position limiting holes 221, 222, 226, and 227, and development unit 300 includes support posts 314, 315, 317, and 318. The invention is not limited to such a configuration. Image formation apparatus 1 can be configured to provide similar operational effects by providing the support posts and post limiting holes for drum unit 200 and development unit 300, respectively.

As described above, according to the image formation unit of the first embodiment, any force horizontally moving the development unit that is held so as to slide horizontally is prevented from being generated by the force due to the rotation moment caused by the rotation load torque of the development roller during the printing operation and the gravity force by its own weight of the development unit. Accordingly, the pressure of contact between the photosensitive drum 51 and development roller 53 set by the bias unit is less likely to be influenced by changes in the rotation load torque and changes in the gravity force of the development unit associated with the consumption or replenishment of toner, and is stabilized. It is therefore possible to reduce degradation in printing quality such as fog, white spots, gray imbalance, and developer filming.

In this embodiment, position limiting holes 221, 222, 226, and 227 are elongated holes extending substantially in the direction orthogonal to the direction of gravity (horizontal direction). Herein, the range substantially orthogonal to the direction of gravity is a range of 80 to 100 degrees with respect to the direction of gravity.

(Second Embodiment)

Figure 17:
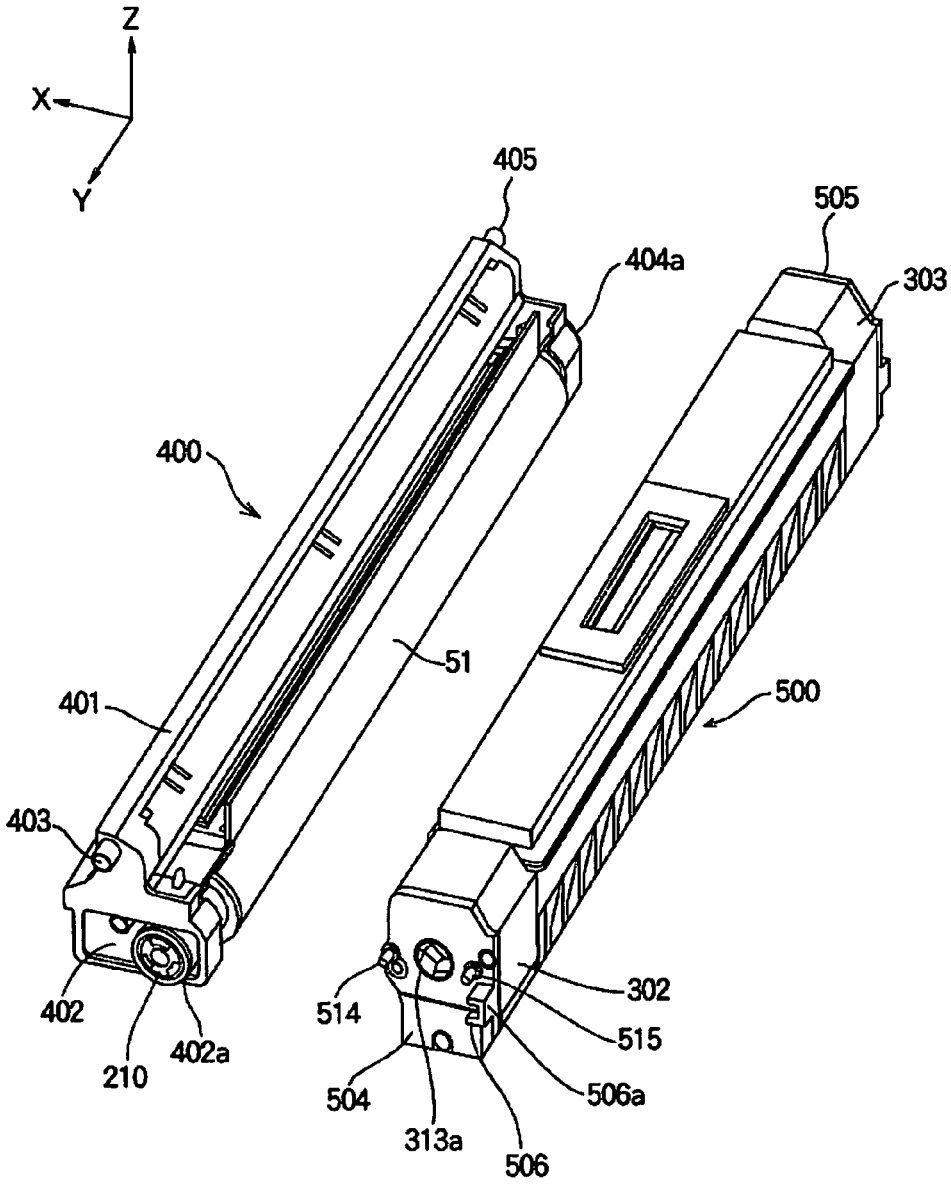
FIG. 17 is an external perspective view of a drum unit and a development unit for use in an image formation apparatus according to a second embodiment of the invention.
Figure 18:
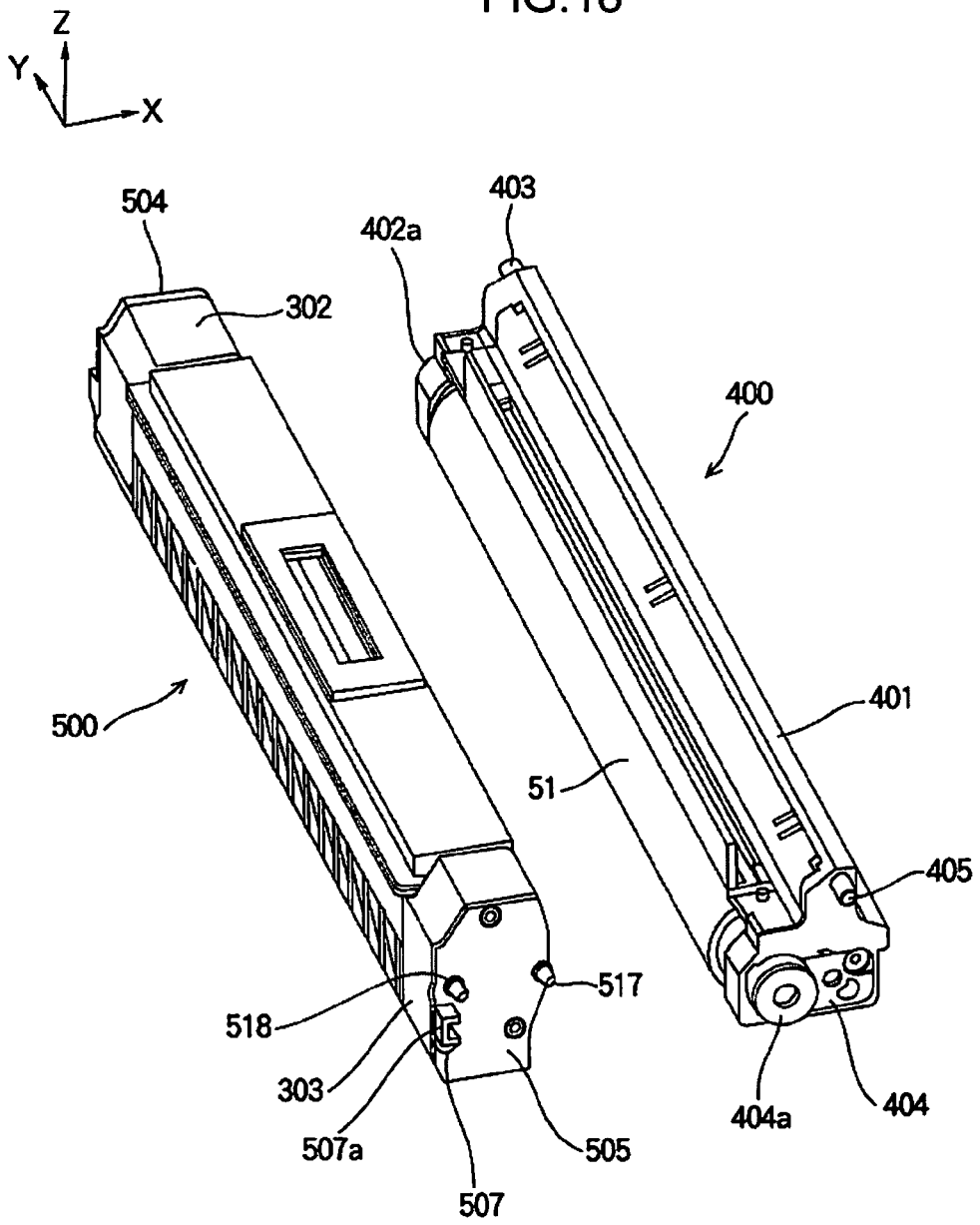
FIG. 18 is an external perspective view of the drum unit and development unit, as seen in a direction different from that of FIG. 17.
Figure 19:
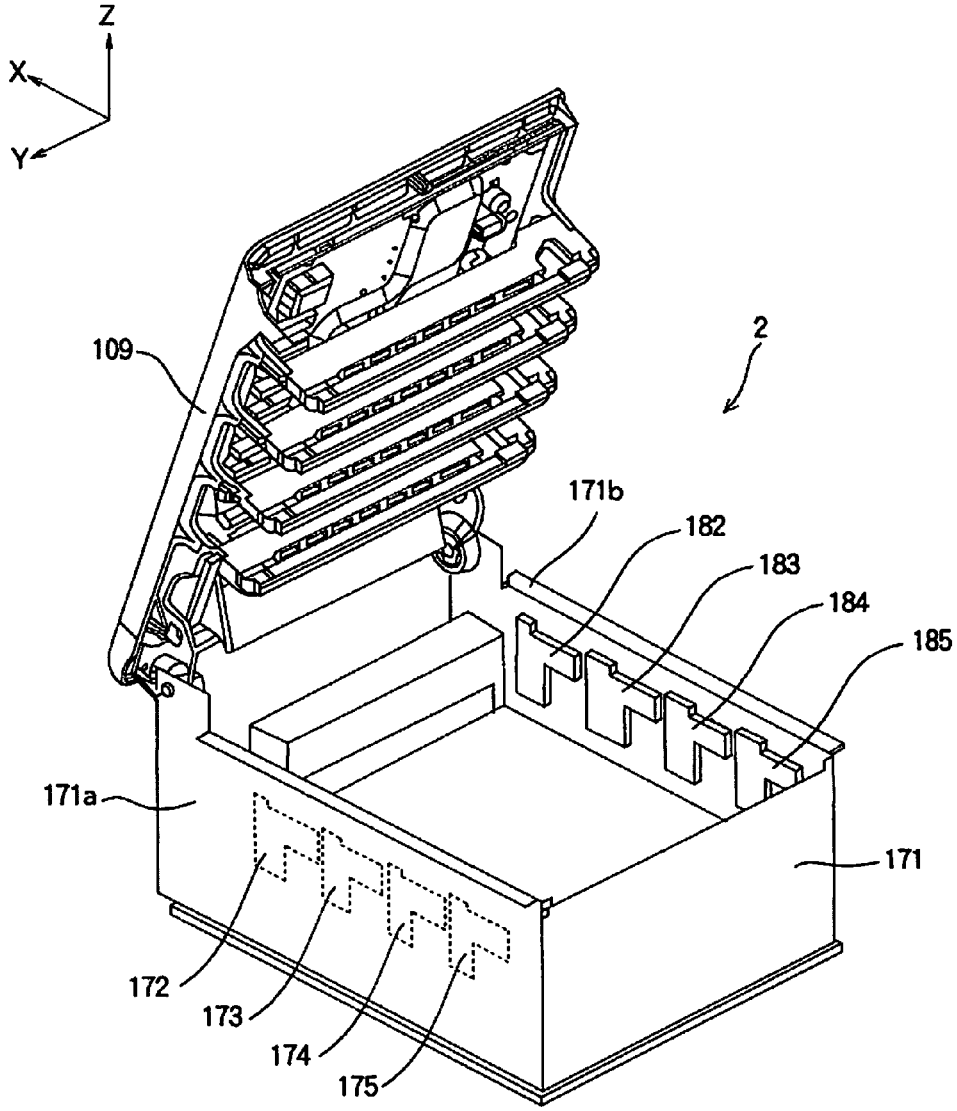
FIG. 19 is an external perspective view illustrating the internal configuration of the body of the image formation apparatus to which the drum and development units are attached.

FIG. 17 is an external perspective view of drum unit 400 and development unit 500 employed in an image formation apparatus of a second embodiment according to the invention. FIG. 18 is an external perspective view of drum unit 400 and development unit 500 in a different direction. FIG. 19 is an external perspective view of the body of image formation apparatus 2 with top cover 109 opened, as seen obliquely from above.

The major different point between image formation apparatus 2 of the second embodiment and image formation apparatus 1 of the first embodiment described above is that drum unit 400 and development unit 500 are individually attached to the body of image formation apparatus 2 instead of being joined to each other to be attached to image formation apparatus 1 like image formation unit 121 of the first embodiment. Accordingly, the same portions are given the same reference numerals as those of image formation apparatus 1 of the first embodiment, or the drawings thereof are omitted. The following description focuses on the different point.

With reference to FIGS. 17 and 18, a description is given of the configuration of drum unit 400 and development unit 500.

Drum side frames 402 and 404 retained to drum main frame 401 are provided on both side surfaces of drum unit 400. In side frames 402 and 404, cylindrical drum unit-support portions 402*a* and 404*a* are integrally formed, respectively. Drum unit-support portions 402*a* and 404*a* are coaxial with the rotation of photosensitive drum 51 and protrudes outward in the direction of the rotational axis. Drum unit-support portions 402*a* and 404*a* include axle holes configured to support the rotation axle of photosensitive drum 51 so that photosensitive drum 51 can rotate. In the drum unit-support portion 402*a* side, drum joint portion 210 fixed to the rotation axle of photosensitive drum 51 protrudes outward in the axial direction. Moreover, columnar drum unit-support posts 403 and 405 are integrally formed on upper parts of both side surfaces of main frame 401. Drum unit-support posts 403 and 405 protrude outward in parallel to the direction of the rotational axis of photosensitive drum 51.

Drum unit-support posts 403 and 405 are located at positions opposite to each other, and drum unit-support portions 402*a* and 404*a* have the same outer diameter.

On the other hand, development unit end frames 504 and 505 are provided in both side surfaces of development unit 500. Development unit end frames 504 and 505 are retained to development unit side frames 302 and 303, respectively. On end frame 504, metallic support posts 514 and 515 having small diameters are fixed at the same positions as those of support posts 314 and 315 described in the first embodiment. On end frame 505, metallic support posts 517 and 518 having small diameters are fixed at the same positions as those of support posts 317 and 318 described in the first embodiment. Joint portion 313*a* of drive receiving gear 313 protrudes to the outside through an opening formed in end frame 504. In development unit 500, the structure which is engaged with drive receiving gear 313 to transmit rotation is the same as that of development unit 300 of the first embodiment.

In end frame 504, bias reception portion 506 is formed at the position corresponding to bias member support post 316 (see FIG. 7) of development unit 300 described in the first embodiment. Bias reception portion 506 includes bias reception surface 506*a* that is vertical and faces the opposite side to photosensitive drum 51. Similarly, in end frame 505, bias reception portion 507 is formed at the position corresponding to bias member support post 319 (see FIG. 8) of development unit 300 described in the first embodiment. Bias reception portion 506 includes bias reception surface 507*a* that is vertical and faces the opposite side to photosensitive drum 51.

It is assumed that support posts 514 and 515 and bias reception portion 506, which are formed in end frame 504, are plane-symmetric to support posts 517 and 518 and bias reception portion 507, which are formed in end frame 505, with respect to a virtual plane perpendicularly intersecting with the rotational axis of development roller 53 at the center of development unit 500.

Figure 20:
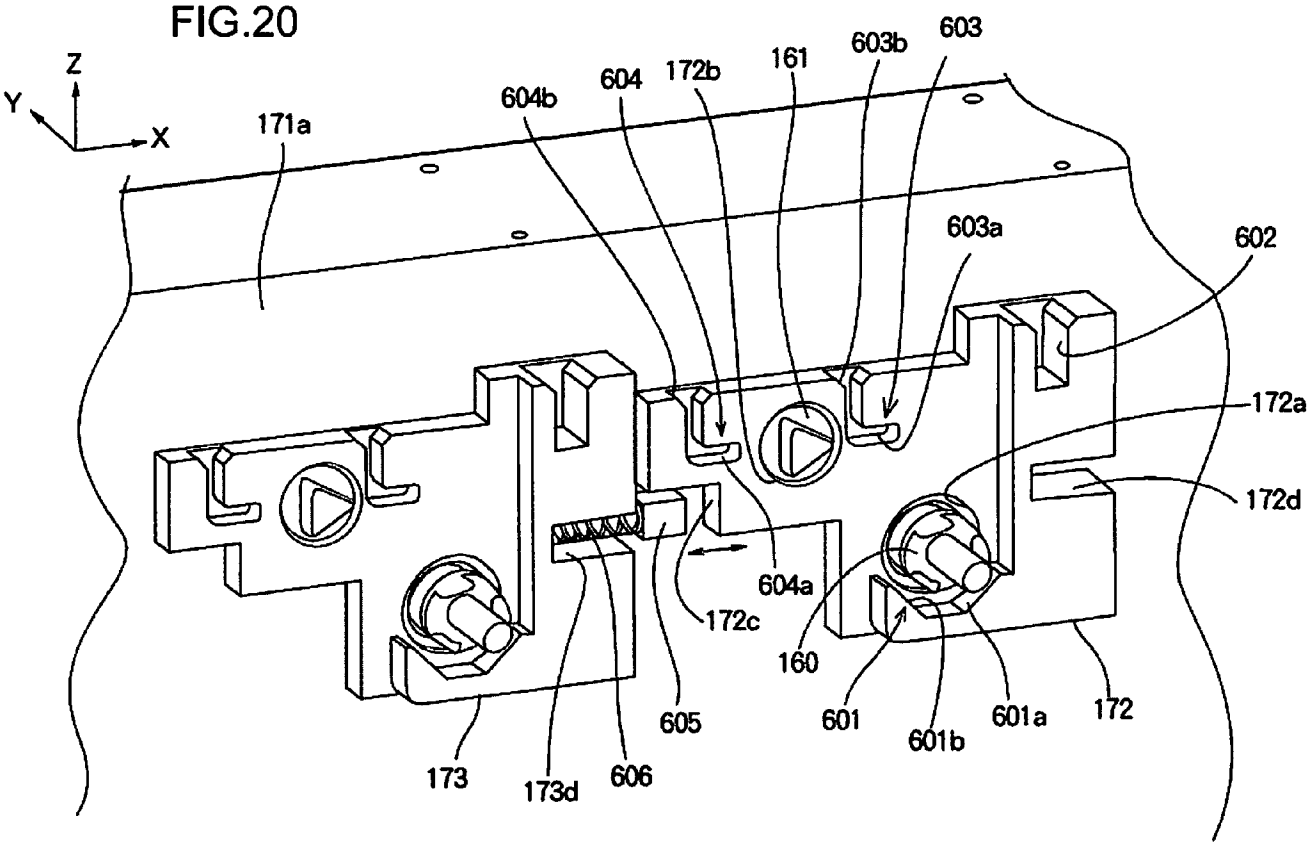
FIG. 20 is an external perspective view of two adjacent left holding frames provided on a left sidewall of a lower frame of the second embodiment, as seen obliquely from above.
Figure 21:
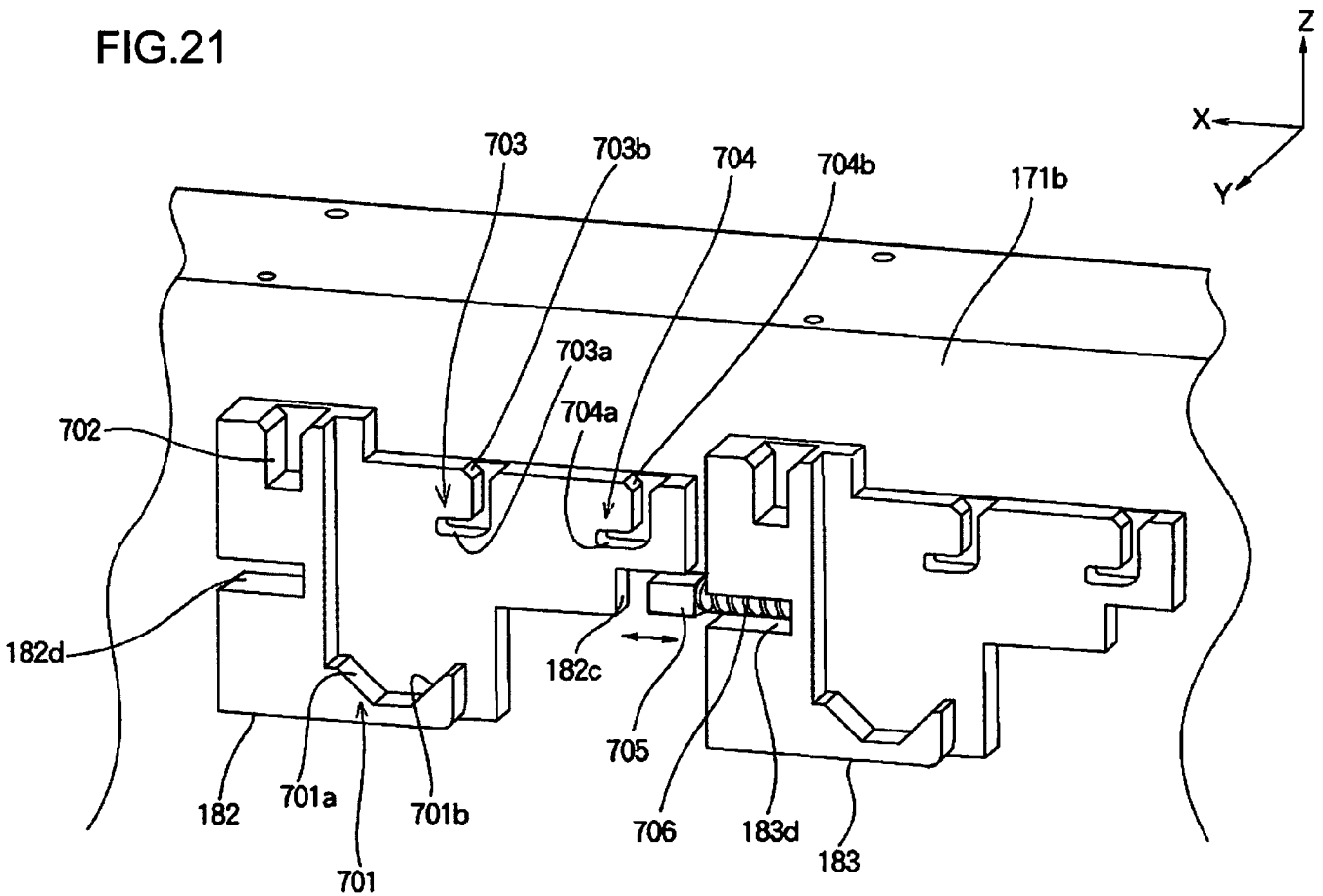
FIG. 21 is an external perspective view of two adjacent right holding frames provided on a right sidewall of the lower frame of the second embodiment, as seen obliquely from above.

Next, a description is given of the configuration of the body of image formation apparatus 2 to which drum unit 400 and development unit 500 are attached with reference to FIGS. 19 to 21.

FIG. 19 is an external perspective view illustrating the internal configuration of the body of image formation apparatus 2 to which drum and development units 400 and 500 are attached. As illustrated in FIG. 19, in the body of image formation apparatus 2, four left holding frames 172, 173, 174, and 175 are provided in line in the direction of the axis X on left sidewall 171*a* within lower frame 171. Four right holding frames 182, 183, 184, and 185 are provided in line in the axis X direction on right sidewall 171*b* so as to face left holding frames 172, 173, 174, and 175, respectively. As described later, the pair of drum unit 400 and development unit 500 is attached to each of those four pairs of holding members facing each other.

FIG. 20 is an external perspective view of two adjacent left holding frames provided for left sidewall 171*a* of lower frame 171, as seen obliquely from above. FIG. 21 is an external perspective view of two adjacent right holding frames provided for right sidewall 171*b* of lower frame 171, as seen obliquely from above. Four left holding frames 172 to 175 have the same shape, and the configuration of left holding frame 172 is described as representative. Four right holding frames 182 to 185 have the same shape, and the configuration of right holding frame 182 is described as representative.

As illustrated in FIG. 20, left holding frame 172 includes: an opening 172*a* through which drum drive output coupling 160 penetrates to be exposed to the inside; and an opening 172*b* through which drum drive output coupling 161 penetrates to be exposed to the inside. Below opening 172*a*, drum unit holding portion 601 is formed. Drum unit holding portion 601 includes inclined planes 601*a* and 601*b* that form a V shape. As described later, each of inclined planes 601*a* and 601*b* comes into linear contact with the outer circumferential surface of drum unit support portion 402*a* (FIG. 17) of drum unit 400 attached corresponding to the same. This determines the attachment position of one side of drum unit 400.

Diagonally above opening 172*a*, groove 602 is formed. Groove 602 is opened at the top in the vertical direction so that drum unit support post 403 (FIG. 17) can be inserted into the groove 602 from above when drum unit 400 is attached. Groove 602 has a width slightly larger than the diameter of drum unit support post 403 so that a predetermined gap is formed between the bottom surface of groove 602 in the vertical direction and drum unit support post 403 in a state where drum unit 400 is attached.

On the other hand, as illustrated in FIG. 21, drum unit holding portion 701 and groove 702, which are formed in right holding frame 182 facing left holding frame 172, are plane-symmetric to drum unit holding portion 601 and groove 602, which are formed in left holding frame 172, with respect to a virtual plane perpendicularly intersecting with the axis Y at the center of lower frame 171. Accordingly, in a similar way that left holding frame 172 is engaged with side frame 402 (FIG. 17), drum unit holding portion 701 and groove 702 of right holding frame 182 are engaged with drum unit support portion 404*a* and drum unit support post 405 of drum side frame 404 (FIG. 18), respectively, so that the position of the other side of drum unit 400 is determined.

As illustrated in FIG. 20, limiting grooves 603 and 604 are formed on both sides of opening 172*a* of left holding frame 172, through which drive output portion 161 penetrates. Limiting groove 603 includes introduction groove portion 603*b* and position limiting portion 603*a*. Introduction groove 603*b* extends vertically and is opened at the top. Position limiting groove 603*a* extends continuously from the lower end of introduction groove 603*b* toward drum unit holding portion 601 in the horizontal direction. Limiting groove 604 also includes introduction groove 604*b* and position limiting portion 604*a*. Introduction groove 604*b* extends vertically and is opened at the top. Position limiting portion 604*a* extends continuously from the lower end of introduction groove 604*b* toward drum unit holding portion 601 in the horizontal direction.

Introduction groove portions 603*b* and 604*b* are opened at the top in the vertical direction so that support posts 514 and 515 provided for development unit end frame 504 (FIG. 17) are respectively inserted into introduction groove portions 603*b* and 604*b* when corresponding development unit 500 is attached. Introduction groove portions 603*b* and 604*b* have widths slightly larger than the diameters of support posts 514 and 515, respectively. Position limiting portions 603*a* and 604*a* are configured to respectively guide support posts 514 and 515 in the horizontal direction in the state where development unit 500 is attached.

On the other hand, as illustrated in FIG. 21, limiting grooves 703 and 704, which are formed in right holding frame 182 facing left holding frame 172, are plane-symmetric to limiting grooves 603 and 604, which are formed in left holding frame 172, with respect to a virtual plane perpendicularly intersecting with the axis Y at the center of lower frame 171. Accordingly, in the same way that left holding frame 172 is engaged with end frame 504 (FIG. 17), limiting grooves 703 and 704 of right holding frame 182 are engaged with support posts 517 and 518 of end frame 505 (FIG. 18), respectively.

The positions and shapes of position limiting portions 603*a*, 604*a*, 703*a*, and 704*a* relative to support posts 514, 515, 517, and 518 are determined under the same conditions as those of position limiting holes 221, 222, 226, and 227 are determined relative to support posts 314, 315, 317, and 318 as described in the first embodiment, respectively. Accordingly, when drum unit 400 and development unit 500 are both attached to the body of image formation apparatus 2, development unit 500 is supported so as to move in the horizontal direction (the direction that development roller 53 and photosensitive drum 51 come close to and separate from each other).

As illustrated in FIG. 20, notch portion 172*c* is formed under limiting groove 604. In notch portion 172*c*, bias reception portion 506 (FIG. 17) of attached development unit 500 is accommodated so as to move in the direction of the arrow (in the horizontal direction). Bias member 606 is accommodated in recess portion 173*d* formed in left holding frame 173 adjacent thereto (corresponding to recess portion 172*d* of left holding frame 172). An end of bias member 606 is supported by a support portion provided for left sidewall 171*a* of lower frame 171, and the other end thereof holds piece 605.

In a similar manner, as illustrated in FIG. 21, notch portion 182*c* is formed below limiting groove 704. In notch portion 182*c*, bias reception portion 507 (FIG. 17) of attached development unit 500 is accommodated so as to move in the direction of the arrow (in the horizontal direction). Bias member 706 is accommodated in recess portion 183*d* formed in right holding frame 183 adjacent thereto (corresponding to recess portion 182*d* of right holding frame 182). An end of bias member 706 is supported by a link mechanism provided for right sidewall 171*b* of lower frame 171, and the other end thereof holds piece 705.

Accordingly, drum unit 400 and development unit 500 are both attached to the body of image formation apparatus 2, and piece 605 biased by bias member 606 comes into pressure contact with bias reception surface 506*a* of bias reception portion 506 while piece 705 biased by bias member 706 comes into pressure contact with bias reception surface 507*a* of bias reception portion 507. Development roller 53 is thus biased to a predetermined pressure of contact between photosensitive drum 51 and development roller 53.

Herein, pieces 605 and 705 switch between first and second states in conjunction with the opening and closing operation of top cover 109 by a not-illustrated link mechanism. To be specific, in the state where the top cover 109 is opened, piece 605 is separated from bias reception surface 506*a* and is horizontally moved to be accommodated in recess portion 173*d* of adjacent left holding frame 173, and the movement thereof is limited. Piece 705 is also separated from bias reception surface 507*a* and is horizontally moved to be accommodated in recess portion 183*d* of adjacent right holding frame 183, and the movement thereof is limited. In the state where the top cover 109 is closed, the limitation on movements of pieces 605 and 705 is eliminated, and pieces 605 and 705 come into contact with bias reception surfaces 506*a* and 507*a* of bias reception portions 506 and 507, respectively, as described above.

As described in the first embodiment, drive output portion 161 and drum drive output coupling 160 (FIG. 20) work in conjunction with the opening and closing operation of top cover 109 (FIG. 19) by a not-illustrated link mechanism, and the position of drum drive output coupling 160 in the direction of the rotational axis of photosensitive drum 51 and the position of development unit drive output portion 161 in the direction of the rotational axis of drive receiving gear 313 vary between when the top cover 109 is opened and when the top cover 109 is closed.

To be specific, when the top cover 109 is opened, drum drive output coupling 160 and development unit drive output portion 161 are moved to respective retraction positions at which drum drive output coupling 160 and development unit drive output portion 161 are respectively separated from drum joint portion 210 and joint portion 313*a* of drive gear 313 and do not transmit rotational force. When the top cover 109 is closed, drum drive output coupling 160 and development unit drive output portion 161 are moved to respective operating positions at which drum drive output coupling 160 and development unit drive output portion 161 are respectively engaged with drum joint portion 210 and joint portion 313*a* of drive gear 313 to transmit rotational force. The retraction positions are set so that drum drive output coupling 160 and development drive output unit 161 do not interfere with the movement of drum unit 400 and development unit 500 for attachment or detachment.

Furthermore, in the second embodiment, a not-illustrated link mechanism and a pressurization member are provided to pressurize drum unit support portions 402*a* and 404*a* in conjunction with the opening and closing operation of top cover 109. To be specific, the pressurization member is retracted to the outside in the direction of the rotational axis of photosensitive drum 51 when top cover 109 is opened. This pressurizes drum unit support portions 402*a* and 404*a* of drum unit 400 from above in the vertical direction when top cover 109 is closed.

A description is next given of the attachment and detachment operation of detach drum unit 400 and development unit 500 to the body of image formation apparatus 2. The engagement relationships between right holding frame 182 and drum unit side frame 404, and between piece 705 and development unit end frame 505 (FIG. 18), are the same as those between left holding frame 172 and drum unit side frame 402, and between piece 605 and development unit end frame 504 (FIG. 17), respectively. The description is therefore given of only the relationships between left holding frame 172 and drum unit side frame 402 between piece 605 and development unit end frame 504 as an example.

Figure 22A:
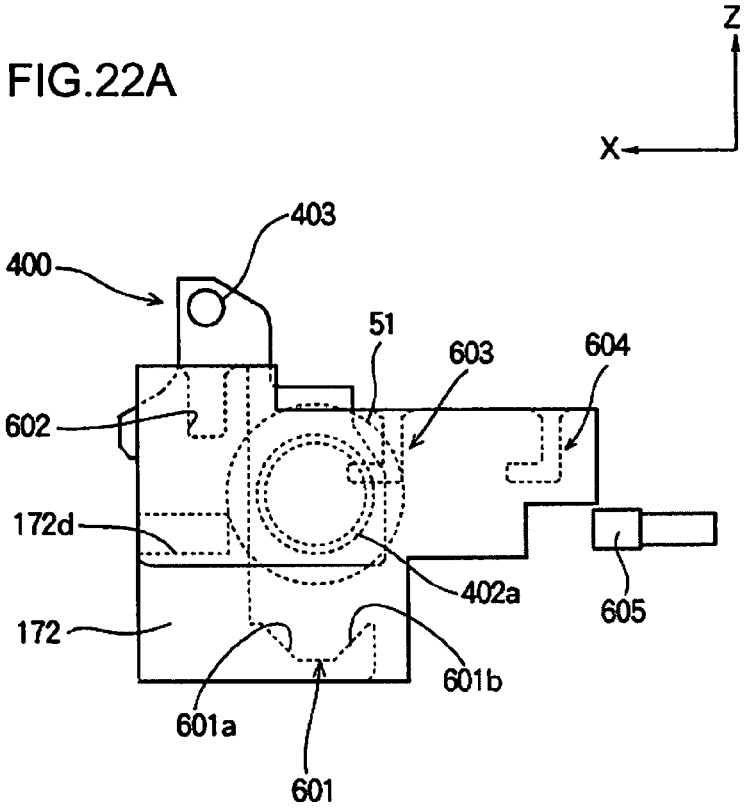
FIGS. 22A and 22B are operation explanatory views for explaining the operation of attaching and detaching the drum unit to and from the body of the image formation apparatus, FIG. 22A illustrating a state where the drum unit is separated from the body of the image formation apparatus, FIG. 22B illustrating a state where the drum unit is attached to the body of the image formation apparatus.
Figure 22B:
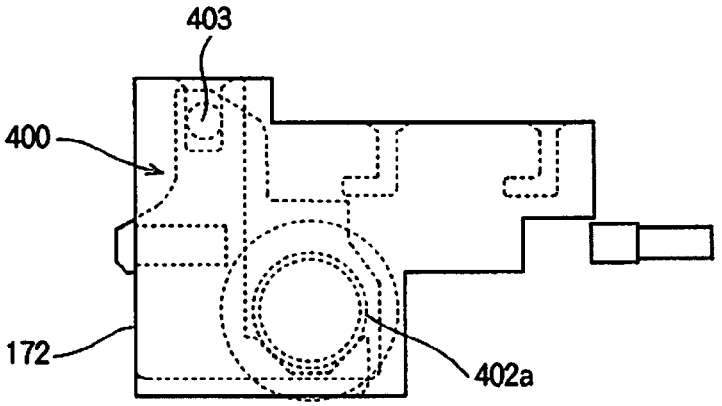
Figure 23A:
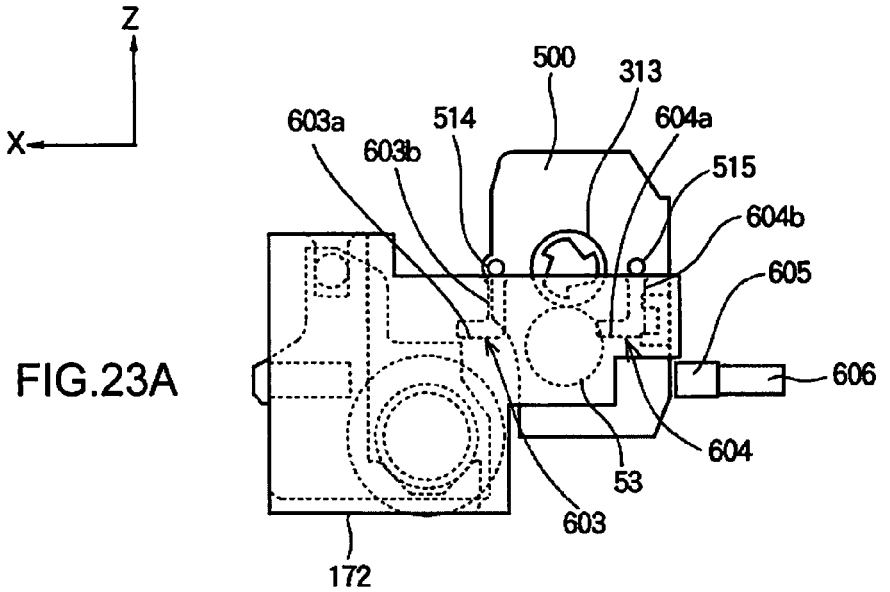
FIGS. 23A and 23B are operation explanatory views for explaining operation of attaching and detaching the development unit to and from the body of the image formation apparatus, with FIG. 23A illustrating the state where the development unit is separated from the body of the image formation apparatus, FIG. 23B illustrating the state where the development unit is attached to the body of the image formation apparatus with a piece separated from the drum unit, and FIG. 23C illustrating the state where the drum unit is pressed by the piece.
Figure 23B:
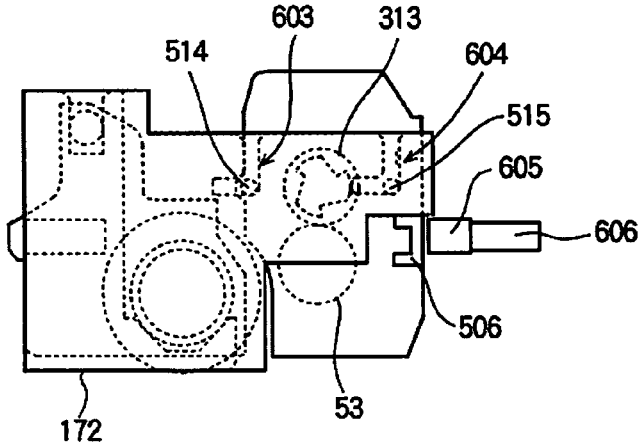
Figure 23C:
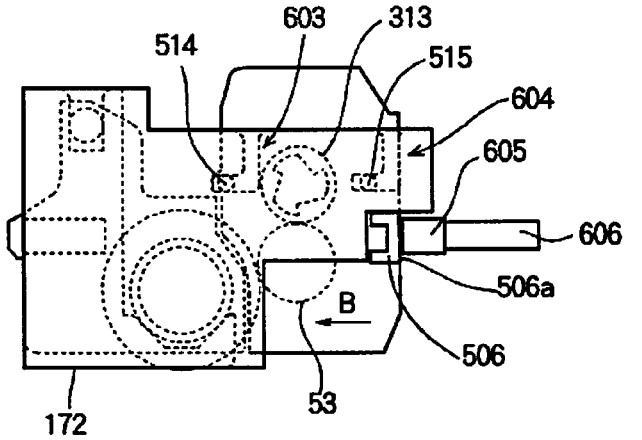

FIGS. 22A and 22B are operation explanatory views for explaining the operation of attaching and detaching detach drum unit 400 to the body of image formation apparatus 2. FIG. 22A illustrates the state where drum unit 400 is separated from the body of image formation apparatus 2. FIG. 22B illustrates the state where drum unit 400 is attached to the body of image formation apparatus 2. FIGS. 23A, 23B, and 23C are operation explanatory views for explaining the operation of attaching and detaching development unit 500 from the body of image formation apparatus 2. FIG. 23A illustrates the state where development unit 500 is separated from the body of image formation apparatus 2. FIG. 23B illustrates the state where development unit 500 is attached to the body of image formation apparatus 2 but pieces 605 and 705 are separated from development unit 500. FIG. 23C illustrates the state where development unit 500 is biased by pieces 605 and 705.

In FIGS. 22A and 22B, as drum unit 400 is moved downward from above the attachment position in the vertical direction (the state of FIG. 22A) in the state where the top cover 109 of image formation apparatus 2 is opened, drum unit support portion 402*a* of drum unit 400 comes into line contact with each of inclined surfaces 601*a* and 601*b* of drum unit holding portion 601 of left holding frame 172 provided for the body of image formation apparatus 2. At the same time, drum unit support post 403 of drum unit 400 is inserted into groove 602 for limiting the horizontal movement of drum unit 400. The attachment operation is thus completed (the state of FIG. 22B).

In FIGS. 23A to 23C, as development unit 500 is moved downward in the vertical direction in the state where the top cover 109 of image formation apparatus 2 is opened, support post 514 of development unit 500 is inserted into introduction groove portion 603*b* of limiting groove 603 of left holding frame 172, and support post 515 of development unit 500 is also inserted into introduction groove portion 604*b* of limiting groove 604 of left holding frame 172 (the state of FIG. 23A). When development unit 500 is further moved downward in the vertical direction, support posts 514 and 515 reach the bottoms of introduction groove portions 603*b* and 604*b*, respectively. The attachment operation is thus completed (the state of FIG. 23B).

When the top cover 109 is closed in this state, drum drive output coupling 160 moves to the positions where drum driver output coupling 160 and development unit drive output portion 161 are respectively joined with drum joint portion 210 and joint portion 313*a* of drive receiving gear 313 to transmit rotation. At the same time, drum unit support portion 402*a* is pressurized by the pressurization member from above in the vertical direction so that drum unit 400 is fixed. Furthermore, the limitation on movement of piece 605 is removed, and piece 605 comes into pressure contact with bias reception surface 506*a* of bias reception portion 506 to bias development roller 53 so that photosensitive 51 and development roller 53 are in contact at a predetermined pressure (the state of FIG. 23C).

In the second embodiment, drum unit 400 and development unit 500 are put in and out of the body of image formation apparatus 2 from above. Accordingly, toner supply unit 801 (FIG. 1) fixed to the body of image formation apparatus 2 interferes with the attachment and detachment operations. In the second embodiment, it is assumed that toner supply unit 801 is detachable from the body of image formation apparatus, and drum and development units 400 and 500 are put in and out of the body with toner supply unit 801 removed.

Upon receiving a print instruction from a not-illustrated instruction device, image formation apparatus 2 starts the printing operation. The forces acting on development unit 500 and interaction operations between the support posts 514, 515, 517, and 518 and respective position limiting portion 603*a*, 604*a*, 703*a*, and 704*a* (FIGS. 20 and 21) during the printing operation are the same as those of the first embodiment, and the description thereof is thus omitted herein. Accordingly, development unit 500 is subjected to only the horizontal force by bias forces from bias members 606 and 706 without being subjected to the horizontal force due to the rotation moment caused by the rotation load torque during the printing operation and the horizontal force due to its own weight and is, therefore, brought into contact with photosensitive drum 51 with a predetermined pressure of contact maintained.

As described above, according to the image formation unit of the second embodiment, the force horizontally moving the development unit that is held so as to slide horizontally is prevented from being generated by the force due to the rotation moment caused by the rotation load torque of the development roller during the printing operation and the force by its own weight of the development unit. Accordingly, the pressure of contact between the photosensitive drum 51 and development roller 53 set by the bias member is less likely to be influenced by a change in rotation load torque and a change in the gravity force of the development unit associated with consumption and replenishment of toner, and is therefore stabilized. It is therefore possible to reduce degradation in printing quality such as fog, white spots, gray imbalance, and developer filming.

Furthermore, the drum unit and development unit are configured to be independently attached and detached from the body of the image formation apparatus. Accordingly, each unit can be individually replaced at its own end of life. It is therefore possible to efficiently keep high-quality printing without waste.

(Third Embodiment)

Figure 24:
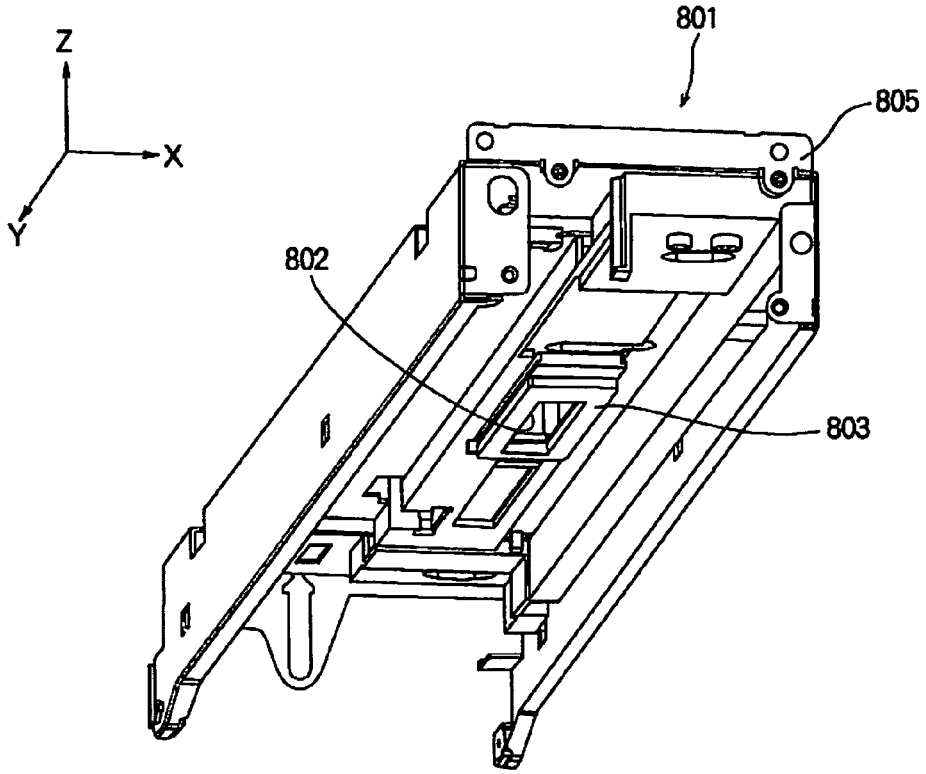
FIG. 24 is an external perspective view of a toner supply unit employed in the image formation apparatus according to the invention in a third embodiment, as seen obliquely from below.

FIG. 24 is an external perspective view of toner supply unit 801 employed in image formation apparatus 1 according to the invention, as seen obliquely from below.

As illustrated in FIG. 24, toner supply unit 801 is fixed to the body of image formation apparatus 1 between image formation unit 121 and developer cartridge 131, and developer cartridge 131 is detachably attached to toner supply unit 801. Toner supply unit 801 supplies toner to image formation unit 121 through rectangular toner outlet 802 formed in toner supply unit 801.

In toner supply unit 801 illustrated in FIG. 24, toner outlet 802 is spatially connected to outlet 131*a* of developer cartridge 131 (FIG. 2) attached to the upper surface of the toner supply unit 801, and toner seal member 803 is provided around exit 131*a* on the lower surface thereof.

Figure 25:
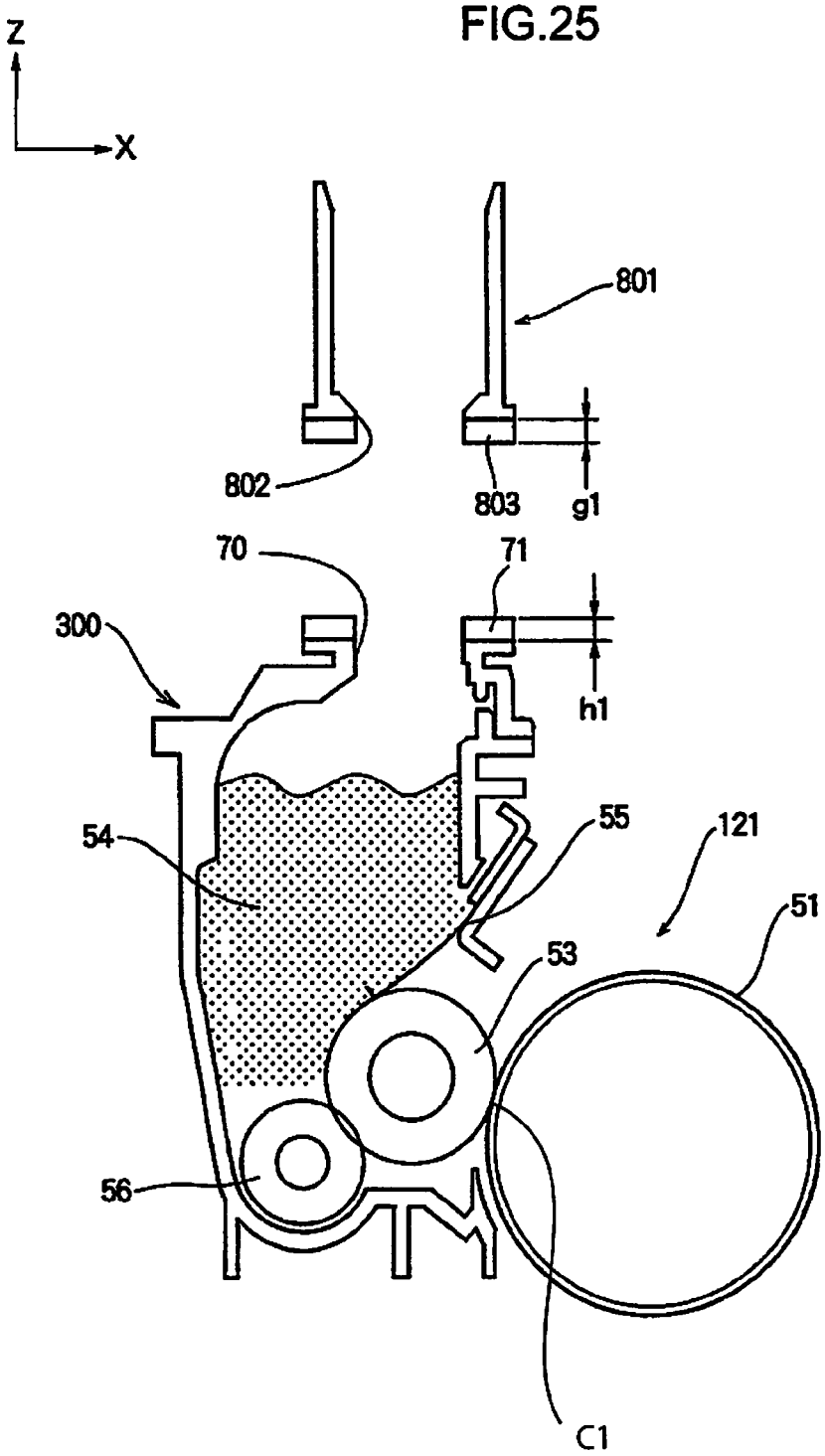
FIG. 25 is a configuration view of a main part in which a toner supply port formed in the development unit of the image formation unit of the image formation apparatus is virtually placed to face the toner supply port of a toner supply unit.
Figure 26:
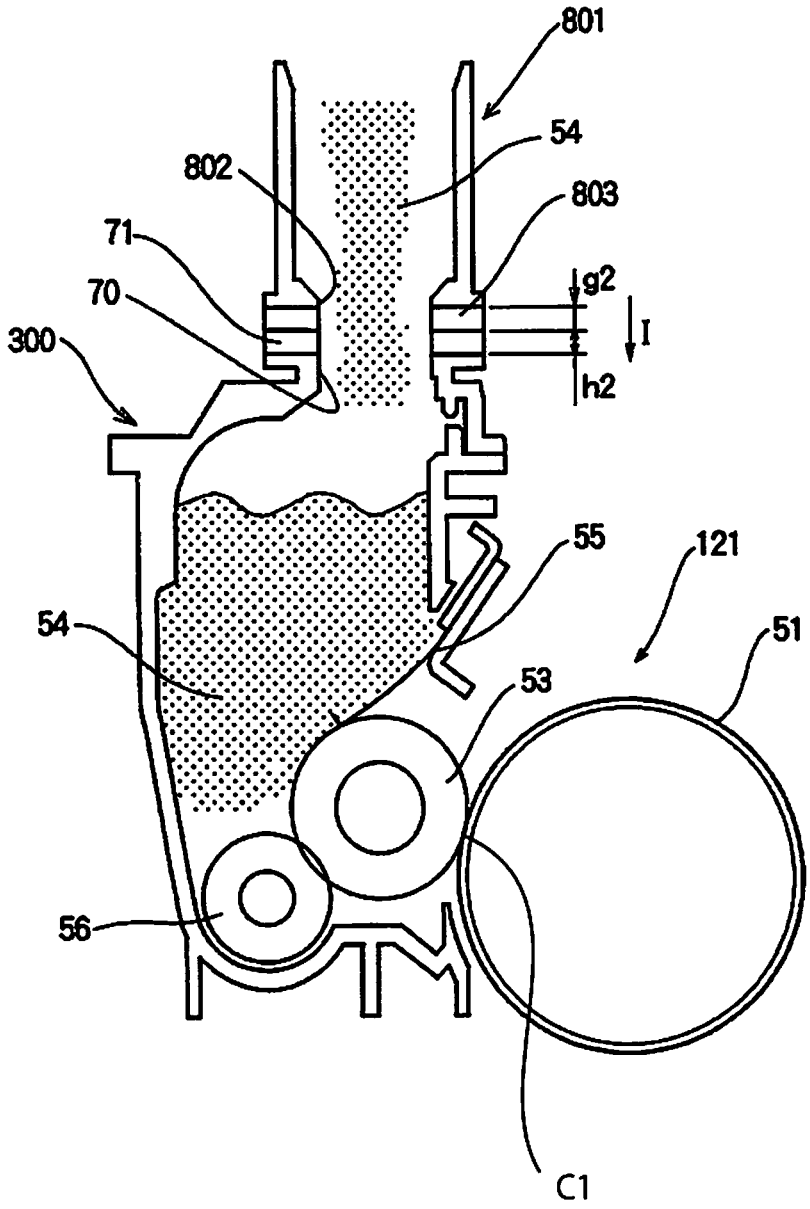
FIG. 26 is an arrangement view of the image formation unit attached to the normal position of the toner supply unit in the third embodiment.

FIG. 25 is a configuration view of a main part in which toner supply port 70 formed in development unit 300 of image formation unit 121 and toner outlet 802 of toner supply unit 801 are virtually positioned opposite to each other. FIG. 26 is an arrangement view when image formation unit 121 is attached to a normal position of toner supply unit 801.

Toner supply port 70 provided for development unit 300 of image formation unit 121 coincides with toner outlet 802 of toner supply unit 801 fixed to the body of image formation apparatus 1 in the vertical direction. As for the relationship of vertical positions thereof, toner outlet 802 of toner supply unit 801 is above toner supply port 70 of development unit 300.

In the state where toner supply port 70 is spatially connected to toner outlet 802 as illustrated in FIG. 26, toner seal member 71 provided around toner supply port 70, and toner seal member 803 provided around toner outlet 802, are compressed into pressure contact with each other so as not to leak toner. Such pressure contact generates contact pressure I downward in the vertical direction, and the contact pressure I acts on development unit 300.

Toner seal member 71 at toner supply port 70 and toner seal member 803 at toner outlet 802 are made of a sponge which is an elastically compressed foam of urethane or the like. When such a sponge is employed as one of toner seal members 71 and 803, the other member may be made of a rigid material made of resin, metal, or the like. The magnitude of contact pressure I in the state where toner supply port 70 and toner outlet 802 are spatially connected depends on the amounts of compression of toner seal members 71 and 803 set enough to prevent leakage of toner.

In the case where toner seal members 71 and 803 are both made of a urethane sponge of the same material, as illustrated in FIG. 25, thicknesses g2 and h2 of toner seal members 71 and 803 at toner supply port 70 and toner outlet 802 when toner supply port 70 and toner outlet 802 are spatially connected are about $g2=(2/3)\times g1$ and $h2=(2/3)\times h1$ where g1 and h1 are thicknesses of toner seal members 71 and 803 that are not compressed and are in a natural state. By compression to such a degree, toner seal member 71 and toner seal member 803 come into close contact with each other to keep the good toner seal performance.

Figure 27:
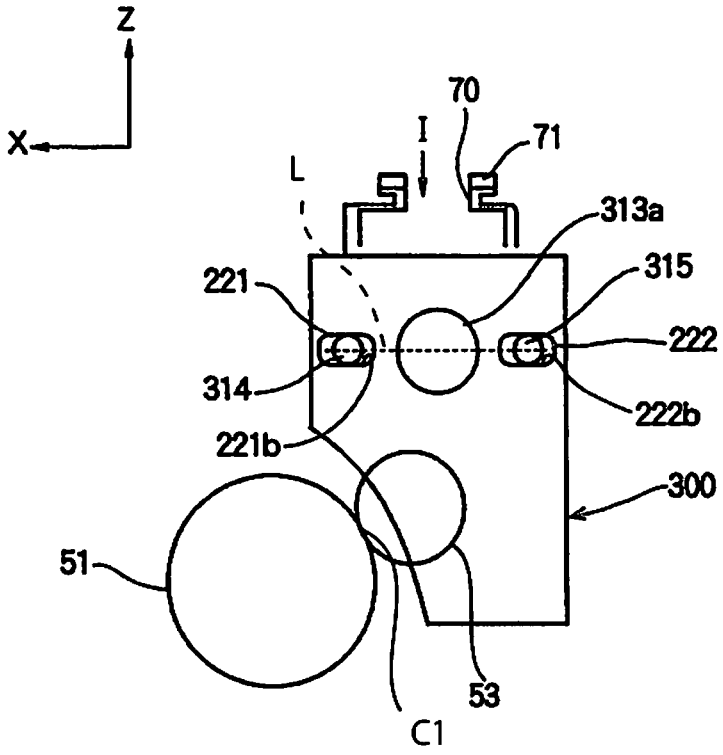
FIG. 27 is a configuration view of the main part for explaining the positional relationship between the toner supply port of the development unit and support posts located on both sides of the development unit.

FIG. 27 is a configuration view of a main part for explaining the positional relationships between the toner supply port 70 of development unit 300 and support posts 314 and 315 provided for one side of development unit 300, and the positional relationship between the toner supply port 70 and support posts 317 and 318 provided for the other side thereof. The positional relationship among the drive receiving gear 313 and support posts 314 and 315 is the same as described in the first embodiment, and the description thereof is thus omitted. Support posts 314 and 315 and support posts 317 and 318 are plane-symmetrical to each other as described in the first embodiment, and the following description is given of support posts 314 and 314 as an example.

As illustrated in FIG. 27, the toner supply port 70 and the pressure contact between toner seal member 71 and toner seal member 803 are formed between support posts 314 and 315 in the direction of the axis X. Accordingly, the direction of contact pressure I which is caused by seal member 71 provided around toner supply port 70 and is applied to development unit 300 is vertical to the centerline (horizontal direction) passing through each center of support posts 314 and 315.

Accordingly, the contact pressure I is cancelled by support post 314 abutting on lower surface 221*b* of position limiting hole 221 that is kept horizontal and support post 315 abutting on lower surface 222*b* of position limiting hole 222 that is kept horizontal, and does not generate a force pressing against development unit 300 in the horizontal direction. Accordingly, contact pressure I does not influence the pressure of contact between photosensitive drum 51 and development roller 53.

As described above, according to image formation unit of the third embodiment, pressure contact I caused by toner seal members to prevent toner leakage is configured not to produce a horizontal force that would otherwise move the development unit held so as to slide in horizontal direction. Accordingly, the pressure of contact between the photosensitive drum 51 and development roller 53 set by the bias members is less likely to be influenced by a change in the rotation load torque and a change in the force of gravity of the development unit associated with consumption and replenishment of toner, and is stabilized. It is therefore possible to reduce degradation in printing quality such as fog, white spots, gray imbalance, and developer filming.

(Fourth Embodiment)

Figure 28:
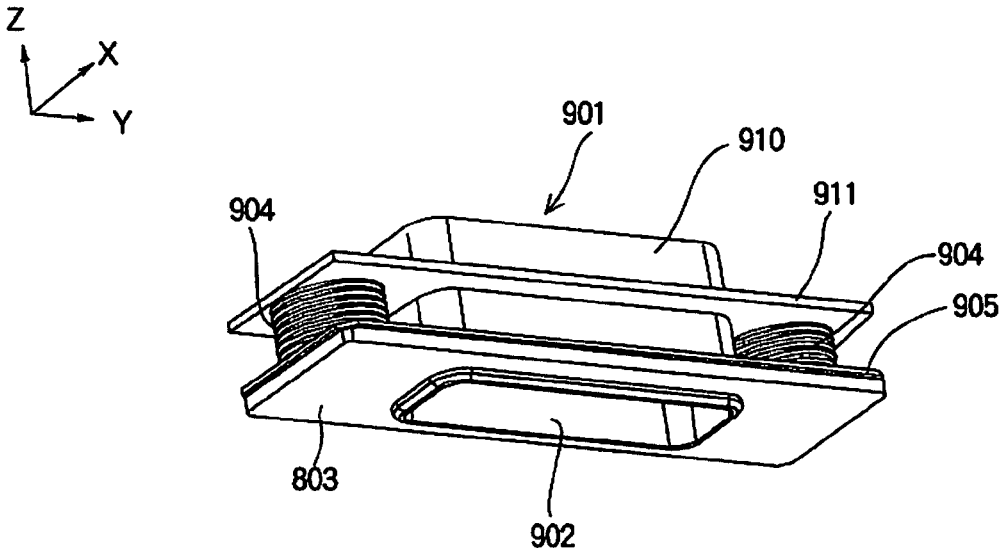
FIG. 28 is an external perspective view around a toner outlet of a toner supply unit of employed in the image formation apparatus according to a fourth embodiment of the invention, as seen obliquely from below.

FIG. 28 is an external perspective view around toner outlet 902 of toner supply unit 901 of a fourth embodiment employed in an image formation apparatus of the invention, as seen obliquely from below. In the above-described third embodiment, toner seal member 803 is directly provided around toner outlet 802 as illustrated in FIG. 24. In the fourth embodiment, on the other hand, toner seal member 803 is provided for holding plate 905 biased by bias spring 904.

In the fourth embodiment, toner outlet 902 corresponds to a top opening portion of hollow frame-shaped portion 910 extending downward from the body of toner supply unit 901 in the vertical direction. On the outside of the middle part of the frame-shape portion 910, base portion 911 is formed horizontally expanded. Holding plate 905 is provided below the base portion 911. Holding plate 905 is guided by frame-shape portion 910 penetrating the same in the vertical direction and held by a pair of bias springs 904 so as to slide in the vertical direction. An end of each bias spring 904 is held by base portion 911. Toner seal member 803 is provided on the lower surface of the holding plate 905.

Figure 29:
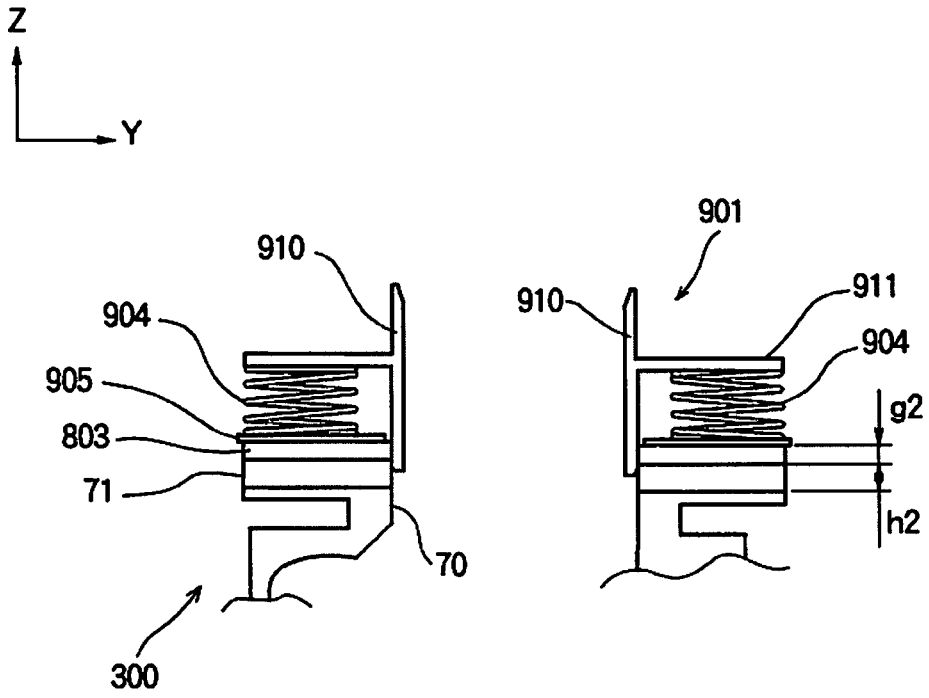
FIG. 29 is an arrangement view where the image formation unit is attached to the normal position of the toner supply unit in the fourth embodiment.

FIG. 29 is an arrangement view when image formation unit 121 is attached to the normal position of toner supply unit 901. As illustrated in FIG. 29, the end of frame-shaped portion 910 is fitted in toner supply port 70 of development unit 300. Toner seal member 803 provided for holding plate 905 and toner seal member 71 provided around toner supply port 70 are compressed into pressure contact with each other. At this time, thicknesses g2 and h2 of toner seal members 803 and 71 are determined by bias force J produced by bias springs 904.

When image formation unit 121 is attached to the normal position of toner supply unit 901, the relative positional relationship between the image formation unit 121 and toner supply unit 901 in the vertical direction varies because of structural variations in the vertical direction. Such variations are absorbed by bias springs 904 and rarely influence bias force J. Accordingly, even if the relative positional relationship between the units in the vertical direction changes, thicknesses g2 and h2 change little.

In the configuration of the third embodiment, if the relative positional relationship between the units in the vertical direction changes, the sum of thicknesses h2 and g2 directly changes, and the contact pressure I changes. In such a case, if toner seal members 803 and 71 are compressed by an amount exceeding the elastic region and are turned into the condition of interference, the contact pressure I increases. This generates non-negligible friction between support post 314 and lower surface 221*b* and between support post 315 and lower surface 222*b*, which are illustrated in FIG. 27. The generated frictional forces influence the pressure of contact between photosensitive drum 51 and development roller 53.

As described above, according to the image formation unit of the fourth embodiment, even if the relative positional relationship between the units in the vertical direction changes in a range of structural variations, the change can be absorbed by bias springs 904, and the thicknesses g2 and h2 of toner seal member 803 and 71 hardly change. Accordingly, even if the variations are generated, the toner seal members 71 and 803 can come into proper close contact with each other to keep good toner seal performance. Furthermore, the structural variations in the vertical direction do not influence the pressure of contact between photosensitive drum 51 and development roller 53 that is set by the bias members.

(Fifth Embodiment)

Figure 30:
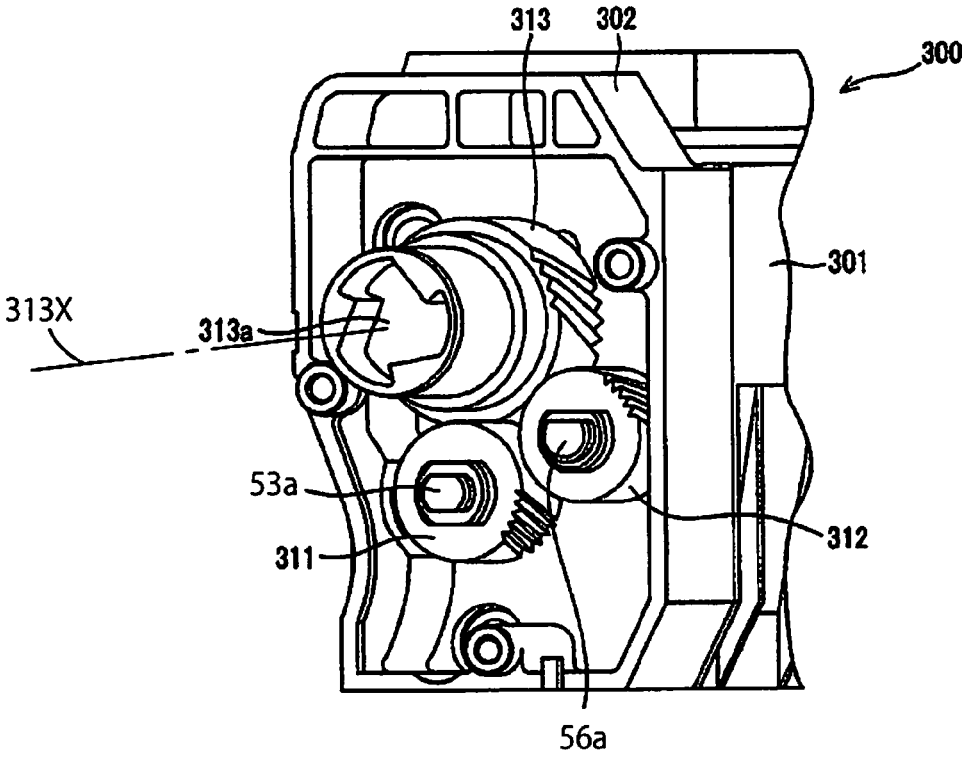
FIG. 30 is a perspective view of a development roller drive portion of a development unit in a fifth embodiment.
Figure 31:
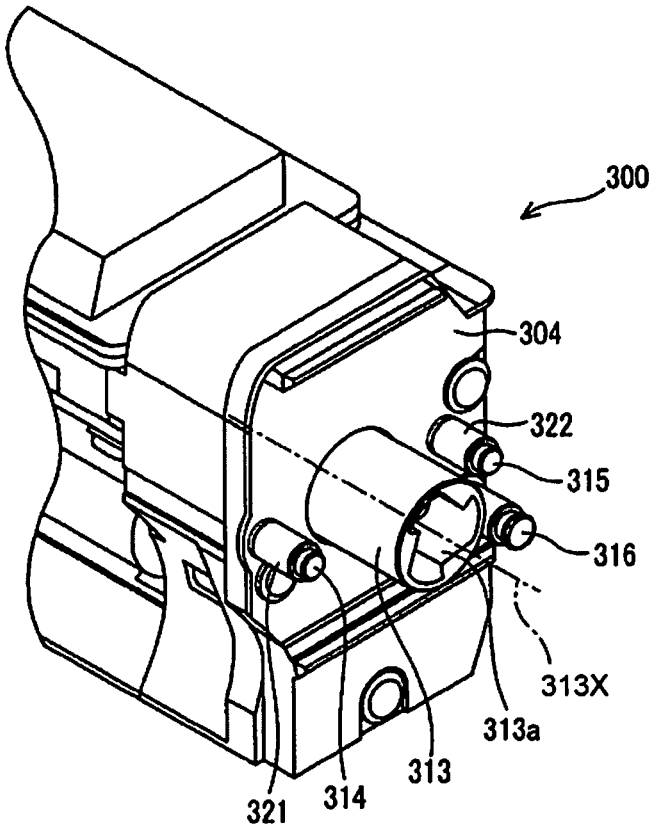
FIG. 31 is a perspective view of the drive receiving side of the development unit in the fifth embodiment.
Figure 32:
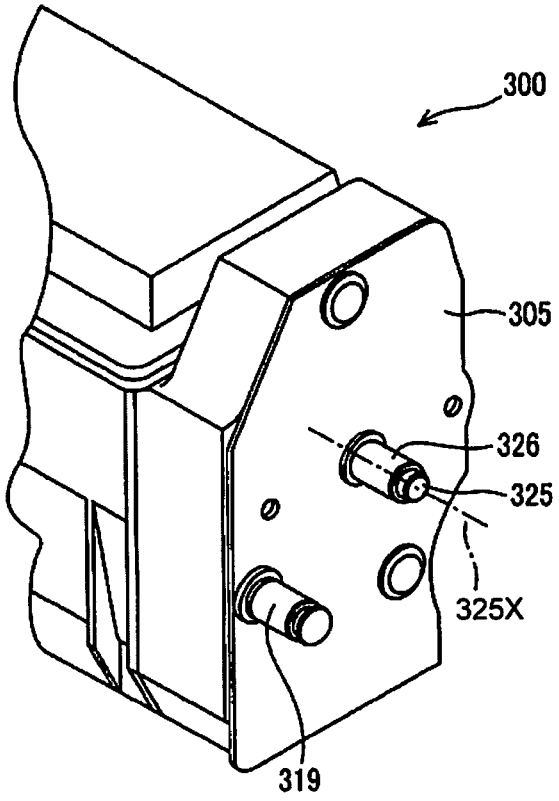
FIG. 32 is a perspective view of the opposite drive receiving side of the development unit in the fifth embodiment.
Figure 43:
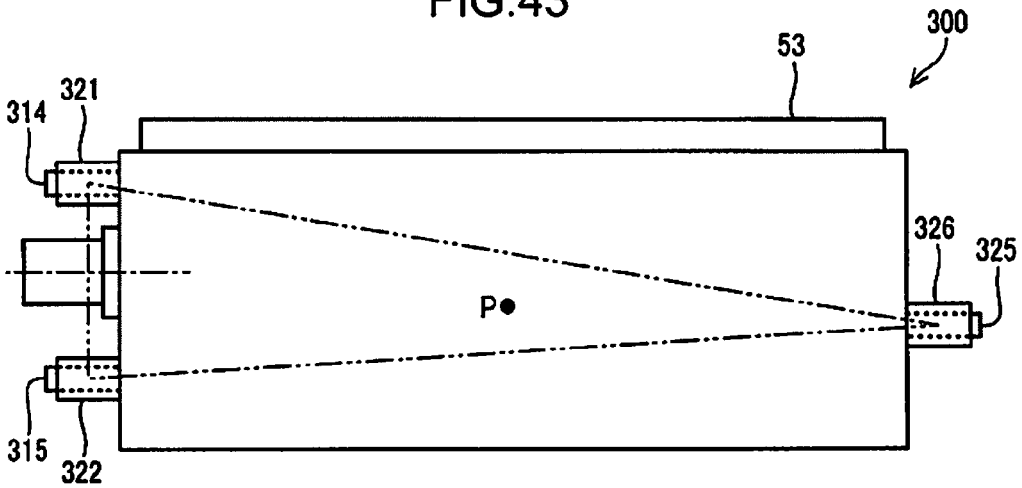
FIG. 43 is a first schematic top view of the development unit in the fifth embodiment.

Next, a description is given of the configuration of development unit 300 of a fifth embodiment in detail. FIG. 30 is a perspective view of a development roller drive portion of a development unit in the fifth embodiment. FIG. 31 is a perspective view of the drive receiving side of the development unit of the fifth embodiment. FIG. 32 is a perspective view of the opposite drive receiving side of the development unit in the fifth embodiment. FIG. 43 is a schematic top view of the development unit in the fifth embodiment.

In FIG. 30, a gear train provided within development unit side frame 302 is composed of development roller gear 311, supply roller gear 312, and drive receiving gear 313. Development roller gear 311 and supply roller gear 312 are fixed to a shaft as the rotational axle of development roller 53 and supply roller 56.

Drive receiving gear 313 is engaged with both roller gears 311 and 312. Drive receiving gear 313 as the drive input portion includes joint portion 313*a* configured to fit to development unit drive output portion 161 of the body of image formation apparatus and protrudes from the side surface of development unit 300.

Development unit drive output portion 161 is provided for the body of the image formation apparatus as illustrated in FIG. 12 and is composed of a general Oldham's shaft coupling, in which no self-aligning mechanism works even if there is a slight misalignment between the centers of development unit drive output portion 161 and joint portion 313*a* of drive receiving gear 313. Moreover, in the outsides of development unit side frames 302 and 303 in the direction of the rotational axis, development unit end frames 304 and 305 are provided retained to development unit side frames 302 and 303, respectively, as illustrated in FIG. 5.

In FIG. 31, in development unit end frame 304 provided at an end of development unit 300 in the axial direction of development roller 53, paired support posts 314 and 315 are integrally formed on both sides of drive receiving gear 313. Support posts 314 and 315 protrude from development unit end frame 304 in parallel to rotational axis 53*a* of development roller 53, outwardly in the direction of the rotational axis. On paired support posts 314 and 315, rollers 321 and 322 are provided so as to rotate about support posts 314 and 315, respectively.

The positions of paired support posts 314 and 315 are provided on a horizontal line, which is substantially vertical to the direction of gravity passing rotational axis 313X of drive receiving gear 313, and are on both sides of the center of gravity of development unit 300 illustrated in FIG. 7 in the horizontal direction. Herein, the substantially vertical range refers to a range of 80 to 110 degrees. In other words, the center of gravity of development unit 300 is located between support posts 314 and 315. The positions of support posts 314 and 315 in the horizontal direction may be non-symmetric with respect to the rotational axis 313X of drive receiving gear 313. Moreover, when support posts 314 and 315 are located at an equal distance from rotational axis 313X of drive receiving gear 313, support posts 314 and 315 may be located so that the straight line passing through the centers of support posts 314 and 315 is at an angle from the horizontal line passing through rotational axis 313X of drive receiving gear 313.

Below support post 315, metallic bias member support post 316, on which later-described bias member 250 is hooked, is provided. In the fifth embodiment, support posts 314 and 315 are formed on development unit end frame 304. However, the support post may be a metallic post fixed to development unit end frame 304, or the support post may be formed in development unit side frame 302 as illustrated in FIG. 7.

Furthermore, as illustrated in FIG. 32, in development unit end frame 305 provided at the other end of development unit 300 in the axial direction of development roller 53, support post 325 is integrally formed. As illustrated in FIG. 43, when image formation unit 121 (FIG. 1) attached to the image formation apparatus is viewed downward from above in the direction of gravity, support post 325 is provided so that the center P of gravity of development unit 300 is located within a triangle formed by connecting three support posts 314, 315, and 325 when viewed in the direction of gravity. In a view of development unit 300 in the axial direction of development roller 53, support post 325 is located between support posts 314 and 315. In the fifth embodiment, the position of support post 325 in the direction of gravity (vertical direction) is the same as the positions of support posts 314 and 315 in the direction of gravity (the vertical direction). However, the position of support post 325 in the direction of gravity (the vertical direction) is not limited to those of the fifth embodiment as long as the center P of gravity of development unit 300 satisfies the aforementioned condition. In a similar manner to support posts 314 and 314 described above, support post 325 is provided with a roller 326, which can rotate around support post 325.

In the fifth embodiment, rotational axis 313X of drive receiving gear 313 illustrated in FIG. 31 is substantially coincident with axis 325X of support post 325 forming a third engaged portion as illustrated in FIG. 32. However, the configuration is not limited to this, and provision of axis 325X of support post 325 in the vicinity of rotational axis 313*b* of drive receiving gear 313 can provide a similar effect. More specifically, axis 325X of support post 325 only needs to be located within a circle having a radius r (=0.3×D1) around rotational axis 313X when development 300 is viewed in the axial direction of rotational axis 313X. Herein, D1 is a distance between the central axis of support post 314 forming a first engaged portion and the central axis of support post 315 forming a second engaged portion.

Figure 33:
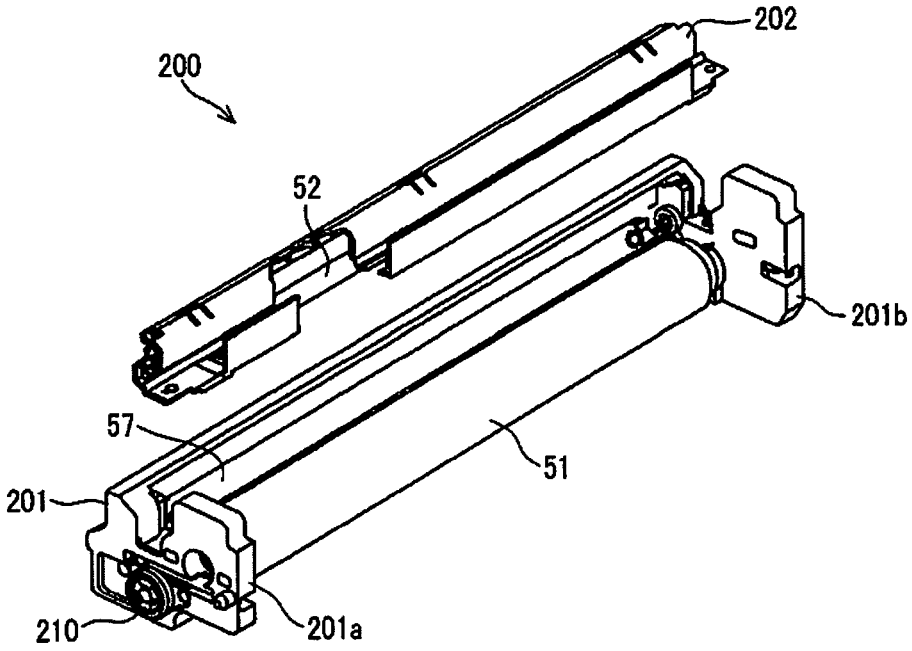
FIG. 33 is an exploded perspective view of a drum unit in the fifth embodiment.
Figure 34:
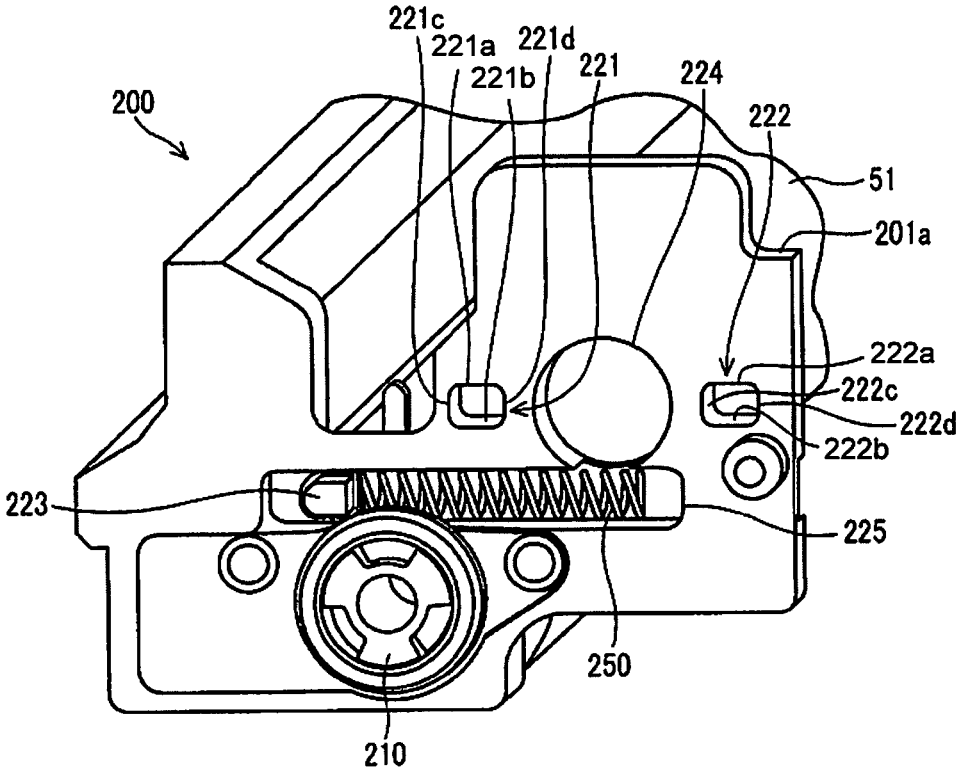
FIG. 34 is a perspective view of the drive receiving side of the drum unit in the fifth embodiment.
Figure 35:
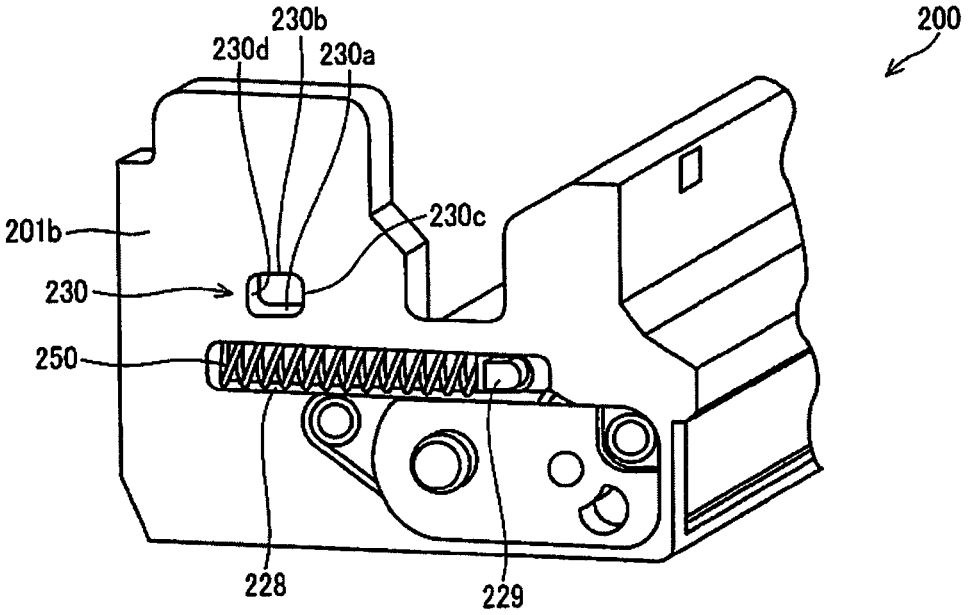
FIG. 35 is a perspective view of the opposite drive receiving side of the drum unit in the fifth embodiment.

Next, a description is given of the configuration of drum unit 200 based on FIGS. 33 to 35 in detail. FIG. 33 is an exploded perspective view of drum unit 200 of the fifth embodiment. FIG. 34 is a perspective view of the drive receiving side of drum unit 200 in the fifth embodiment. FIG. 35 is a perspective view of the opposite drive receiving side of drum unit 200 in the fifth embodiment. In FIG. 33, in drum unit 200, drum frame 201 is provided. Drum frame 201 covers charge device 52 and cleaner 57 and extends to the outside of each end of photosensitive drum 51 in the direction of the rotational axis. Drum frame 201 includes sidewalls 201*a* and 201*b* at both ends of photosensitive drum 51 in the direction of the rotational axis. Sidewalls 201*a* and 201*b* are orthogonal to the rotational axis and extended in the vertical direction and support photosensitive drum 51 so that photosensitive drum 51 can rotate.

At an end of photosensitive drum 51 in the direction of the rotational axis thereof, the flange of photosensitive drum 51 penetrates through sidewall portion 201*a* of drum frame 201 and protrudes outward in the direction of the rotational axis. Drum joint portion 210 is formed on the end surface thereof, and is configured to fit to drum unit drive output coupling 160 of the image formation apparatus, as illustrated in FIG. 2. Hole 224 is formed in sidewall portion 201*a* with a gap from the outer diameter of drive receiving gear 313, as illustrated In FIGS. 34 and 35. Drive receiving gear 313, that is provided for development unit 300 illustrated in FIG. 30, penetrates through the hole 224.

On both sides of hole 224, a pair of position limiting hole 221 as the first engagement portion and position limiting hole 222 as the second engagement portion is formed. Position limiting holes 221 and 222 fit on rollers 321 and 322 (see FIG. 31) located on support posts 314 and 315 provided for development unit 300, respectively. The first engaged portion engaged with position limiting hole 221 includes support post 314 and roller 321, and the second engaged portion engaged with position limiting hole 222 includes support post 315 and roller 322.

In the state where image formation unit 121 illustrated in FIG. 2 is attached to the image formation apparatus, limiting surfaces 221*a* to 221*d* and limiting surfaces 222*a* to 222*d* are formed within position limiting holes 221 and 222, respectively. Limiting surfaces 221*a* and 221*b* are parallel to each other, and limiting surfaces 222*a* and 222*b* are parallel to each other. Lower surfaces 221*a* and 222*a* and upper surfaces 221*b* and 222*n* are horizontal surfaces in the direction of gravity. The distance between the lower and upper surfaces 221*a* and 221*b* and the distance between the lower and upper surfaces 222*a* and 222*b* are a small amount greater than the outer diameters of rollers 321 and 322, respectively. Desirably, the small amount is 0.01 to 0.05 mm.

On the other hand, the surfaces of position limiting holes 221 and 222, opposite to each other in the horizontal direction, are not limited in terms of direction and angle. Position limiting holes 221 and 222 are configured to have such sizes that provide large gaps from rollers 321 and 322, respectively. The gaps are desirably not less than 1 mm. Groove 225 and bias member fixing post 223 are provided below position limiting hole 221. To groove 225, bias member 250 is attached. An end of bias member 250 is fixed to bias member fixing post 223. In sidewall portion 201*b* on the other side, position limiting hole 230 as a third engagement portion is provided at a position symmetric to the position of hole 224 of sidewalls 201*a*. Groove 228 with the same shape as that of groove 225, and bias member fixing post 229, are provided at the symmetric positions to the positions of groove 225 and bias member fixing post 223, thus constituting drum unit 200. The third engaged portion engaged with position limiting hole 230 is composed of support post 325 and roller 326.

In the fifth embodiment, limiting surfaces 221*c* and 221*d* of position limiting hole 221 are substantially vertical to upper surface 221*a* and are parallel to each other. The distance between limiting surfaces 221*c* and 221*d* is greater than the outer diameter of the support posts so that development unit 300 slides on position limiting holes 221, 222, and 230. Development roller 53 is biased toward photosensitive drum 51 by bias member 250. Herein, the distance is set 1 to 5 mm larger than the outer diameter of the support posts. The position limiting holes 222 and 230 have similar configurations.

Herein, position limiting holes 221, 222, and 230 are elongated holes with the longitudinal direction set to the horizontal direction substantially vertical to the direction of gravity. The long sides of the elongated holes extend in the direction that bias member 250 biases development unit 300 toward drum unit 200. The center of position limiting hole 230 is set on a straight line connecting the centers of position limiting holes 221 and 222 and is located at the midpoint of the straight line connecting the centers of position limiting holes 221 and 222.

Figure 36:
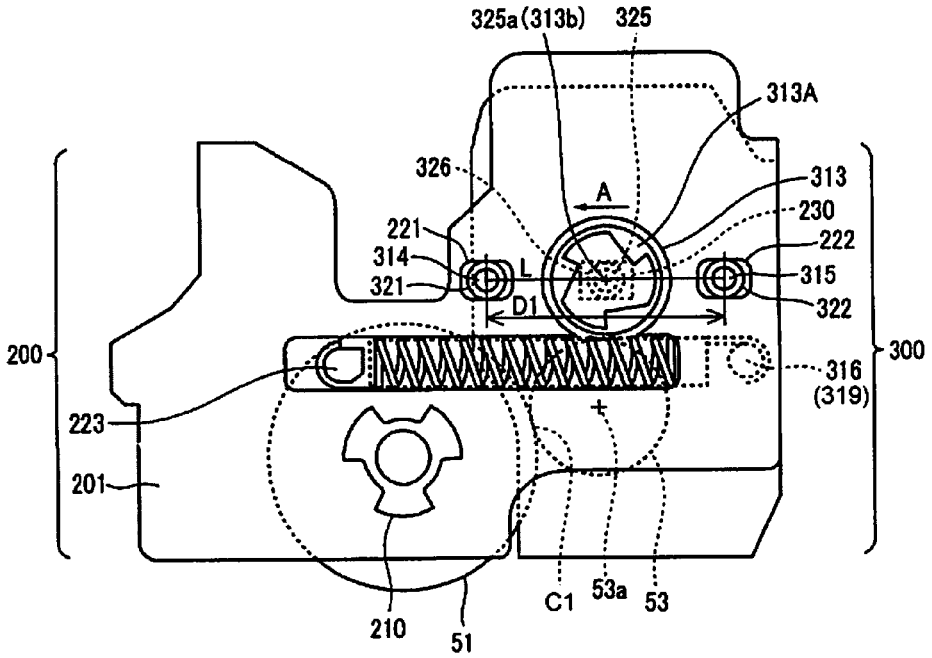
FIG. 36 is a side view illustrating the drum unit and development unit joined together in the fifth embodiment.

Next, a description is given of the state where the drum unit and development unit are joined in detail using FIG. 36. FIG. 36 is a side view illustrating the state where the drum unit is joined with the development unit in the fifth embodiment. As illustrated in FIG. 36, when drum unit 200 is joined with development unit 300, rollers 321, 322, and 326 provided for support posts 314, 315, and 325 on both side surfaces of development unit 300 fit in position limiting holes 221, 222, and 230 of drum frame 201, respectively. Support posts 314, 315, and 325 come into contact with the opposite surfaces of position limiting holes 221, 222, and 230 in the vertical direction and roll on the same. Development unit 300 rolls on the opposite surfaces to be supported by drum unit 200 so as to move horizontally.

When development unit 300 is viewed in the direction of the rotational axis of development roller 53, position limiting holes 221 and 222 are formed at an end in the axial direction, and position limiting hole 230 is formed at the other end. Moreover, when development unit 300 is viewed in the direction of the rotational axis of development roller 53, position limiting hole 230 is formed between position limiting hole 221 and position limiting hole 222 that is formed at a predetermined distance from position limiting hole 221. Positional relationship among support posts 314, 315, and 325 are the same as that among the position limiting holes 221, 222, and 230. Such an arrangement can reduce the change in pressing force between development roller 53 and photosensitive drum 51.

An end of each of bias members 250 provided on both sides of drum unit 200 and development unit 300 is fixed to bias member fixing post 223 of drum frame 201 or bias member fixing post 229 illustrated in FIG. 35, and the other end thereof is fixed to bias member support post 316 or 319 of development unit 300. Bias members 250 bias development unit 300 in the direction indicated by arrow A in FIG. 36 to bring photosensitive drum 51 and development roller 53 into contact with each other at contact position C1.

The vertical position of each bias member 250 is located between the vertical position of support posts 314 and 315 and drive receiving gear 313 and contact portion 51*a* at which photosensitive drum 51 and development roller 53 are in contact. By applying a bias force of bias members 250 at such a position, the development unit 300 can be moved without being subjected to other rotation moment and force acting thereon. Therefore, development unit 300 is subjected to a bias force toward drum unit 200 in the direction indicated by arrow A in FIG. 36 and moves in a horizontal direction, so that photosensitive drum 51 and development roller 53 come into contact at a predetermined pressure.

Next, a description is given of the force acting when development unit 300 is in operation. There are three kinds of forces acting on development unit 300: a rotational force around drive receiving gear 313 due to the load torque of development unit 300; the gravity force due to the weight of development unit 300; and a frictional force at contact portion 51*a* between photosensitive drum 51 and development roller 53. As for the magnitudes of forces acting at the position of development roller 53 due to the respective kinds of forces, the force due to the rotational force is about 1.5 to 2.5 Kgf; the force due to gravity is about 1 to 2 Kgf, and the frictional force is about 0.3 Kgf. The rotational and gravity forces are large, and the force due to the frictional force is very small among the three forces. The variation and change in frictional force are further small, and there is no problem even if the influence of the frictional force on the pressure of contact between photosensitive drum 51 and development roller 53 is ignored.

Figure 37:
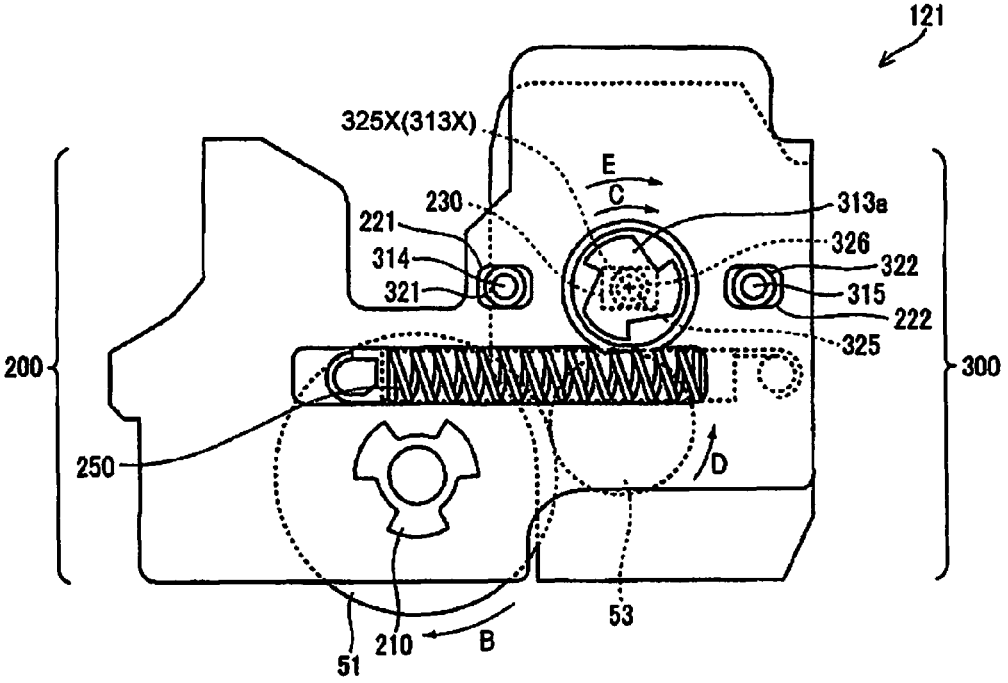
FIG. 37 is a side view of an image formation unit including the drum unit and development unit joined together in the fifth embodiment.

Accordingly, the force influencing the pressure of contact between photosensitive drum 51 and development roller 53 can be considered to include the aforementioned rotational force and gravity. By reducing the influence of the rotational and gravity forces, change in the pressure of contact between photosensitive drum 51 and development roller 53 can be reduced. The operation of the aforementioned configuration is described below. The operation of the image formation unit is described based on FIG. 37, which is a side vide of the image formation unit including the drum unit joined with development unit in the fifth embodiment.

First, upon receiving a print instruction from a not-illustrated instruction unit, image formation apparatus starts the printing operation. When the printing operation starts, drum unit drive output coupling 160 (see FIG. 2) and development unit drive output portion 161 (see FIG. 12) of the image formation apparatus are rotated by a not-illustrated controller and a not-illustrated drive motor of the image formation apparatus. Drive output coupling 160 of image formation apparatus is fit to the drum joint portion 210, and drive output portion 161 is fit to joint portion 313*a*. The drive is transmitted to image formation unit 121 through rotation of drive output coupling 160 and drive output portion 161.

By the transmitted drive being received in image formation unit 121, photosensitive drum 51 rotates in the direction indicated by arrow B in the drawing. Development roller 53 receives the drive through rotation of drive receiving gear 313 in the direction indicated by arrow C in the drawing and rotates in the direction indicated by arrow D in the drawing, thus starting the printing operation. In this process, development unit 300 is subjected to the force of gravity due to its own weight and to the rotational force due to the rotation moment caused by its own load torque around drive receiving gear 313 in the direction indicated by arrow E in the drawing.

Herein, a description is given of a way of cancelling the rotational force and gravity acting on development unit 300 using FIGS. 38A to 41B and FIGS. 44 to 46. FIGS. 38A, 39A, 40A, and 41A are side views of the drive receiving side of development unit 300. FIGS. 38B, 39B, 40B, and 41B are side views of an opposite drive receiving side that is the side opposite to the drive receiving side in development unit 300. FIGS. 38B to 41B and FIGS. 44 to 46, Q1, Q2, R1, R2, S1, S2, T1, T2, U1, and U2 indicate the positions of the support posts on the drive receiving side that support development unit 300. Q3, R3, S1, S3, T3, and U3 indicate the positions of the support posts on the opposite drive receiving side corresponding to the support posts on the drive receiving side.

Figure 38A:
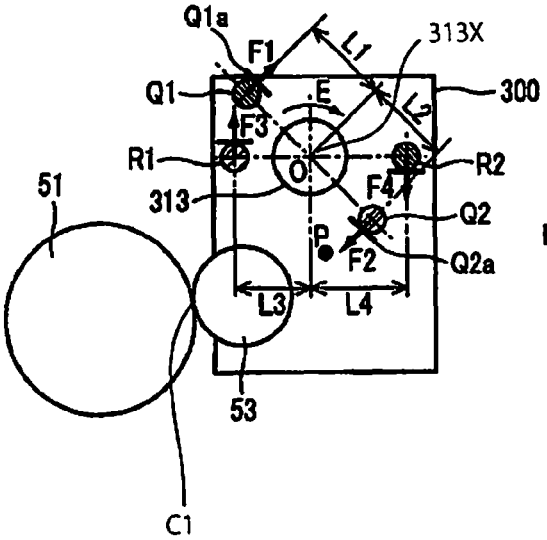
FIGS. 38A and 38B are first explanatory views for force acting on the development unit in the fifth embodiment.
Figure 38B:
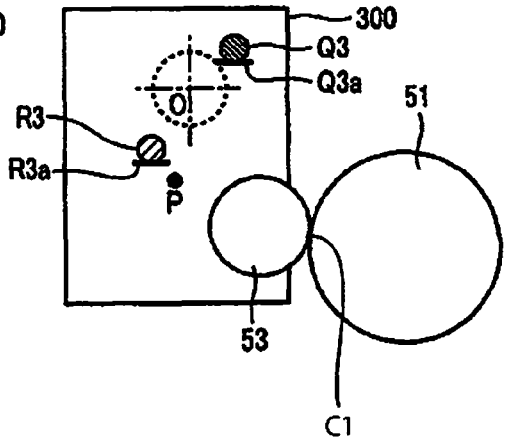

First, using FIGS. 38A and 38B, a description is given of a way of cancelling the horizontal component of the force acting on development unit 300 by the rotational force. In order to cancel the rotational force, the position of development unit 300 needs to be limited at two places if the rotation center O of drive receiving gear 313 as the drive input portion is not fixed. This can be implemented by an arrangement of the pair of support posts on the two-point support side in the three-point support, and by placing a limitation on the angle of the limiting surfaces.

First, paired support posts Q1 and Q2 are arranged to be point-symmetric about the rotation center O of drive receiving gear 313. At this time, distance L1 between support post Q1 and the rotation center O is equal to distance L2 between support post Q2 and the rotation center O (distance L1=distance L2). Limiting surfaces Q1*a* and Q2*a* are set along the directions orthogonal to the tangent directions of the circumference around drive receiving gear 313. The limiting surfaces are located downstream in the direction of rotation of drive receiving gear 313 (indicated by arrow E in FIG. 38A). Limiting surfaces Q1*a* and Q2*a* are therefore subjected to vertical forces F1 and F2 acting on support posts Q1 and Q2 by the rotational force, respectively, so that the rotational force can be cancelled.

In other words, as illustrated in the fifth embodiment, it is preferable that drive receiving gear 313 illustrated in FIG. 36 is provided substantially at the middle between the support post 314 as the first engaged portion and support post 315 as the second engaged portion. To be specific, it is preferable that distance D2 between the rotation center of drive receiving gear 313 and support post 314 is in a range of 40 to 60% of distance D1 between support posts 319 and 315. The arrangement with distance D2 set in the above range can provide a similar effect.

As described above, the rotational force is canceled by paired support posts Q1 and Q2 on the drive receiving side, and the support post Q3 on the opposite drive receiving side is therefore not subjected to rotational force. Accordingly, the position of support post Q3 of one-point support on the opposite drive receiving side is not limited. In FIG. 38B, the lower surface of support post Q3 is limited by horizontal surface Q3*a*. However, the angle of control surface Q3*a* is also not limited.

Furthermore, even when rotational center O of drive receiving gear 313 is located on the line segment connecting the pair of support posts but the pair of support posts are located at the positions not point-symmetrical with respect to the rotational center O of drive receiving gear 313, that is, even when distance L3 between support post R1 and rotational center is not equal to distance L9 between support post R2 and rotational center O (distance L3≅a distance L4), the rotational force can be cancelled if support posts R1 and R2 are located on a horizontal line. In such a case, similarly to the aforementioned support post Q3, support post R3 on the opposite drive receiving side is not subjected to a rotational force, and the position of support post R3 and the angle of the limiting surface R3*a* are not limited.

Figure 39A:
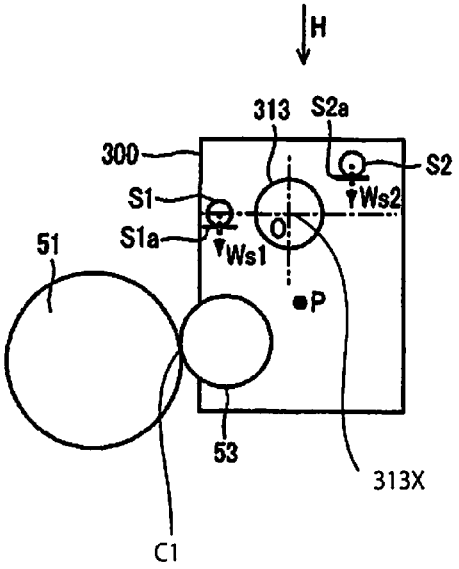
FIGS. 39A and 39B are second explanatory views for force acting on the development unit in the fifth embodiment.
Figure 39B:
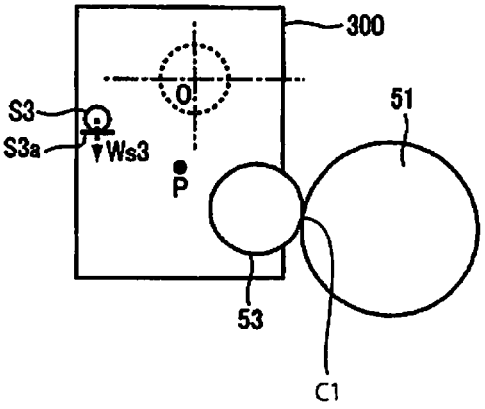
Figure 44:
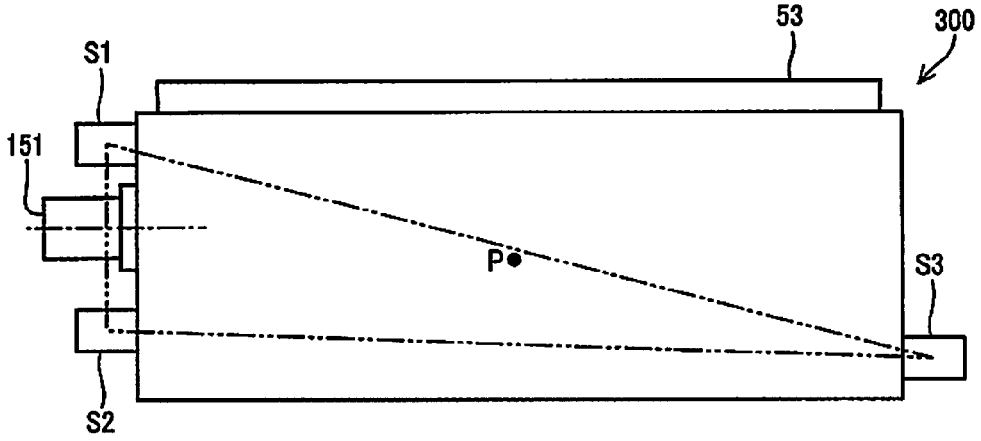
FIG. 44 is a second schematic top view of the development unit in the fifth embodiment.

Next, a description is given of the way to cancel the gravity force using FIGS. 39A, 39B, and 44. FIG. 44 is a view of development unit 300 in the direction indicated by arrow H in FIG. 39A, that is, a top view in the vertical direction. In order to cancel the gravity force, as illustrated in FIG. 44, support posts S1, S2, and S3 are arranged so that the center P of gravity is located within a triangle formed by pair of support posts S1 and S2 on the drive receiving side and support post S3 on the opposite drive receiving side (that is, within a region surrounded by lines connecting the first to third engaged portions) when viewed in the direction of gravity. At this time, the vertical positions of support posts S1 to S3 are not limited and may be different from one another as illustrated in FIGS. 39A and 39B. Moreover, the vertical position of the center P of gravity is also not limited.

Furthermore, by limiting the lower surfaces of support posts S1 to S3 at all the three points to horizontal surfaces S1*a*, S2*a*, and S3*a*, respectively, all of forces Ws1, Ws2, and Ws3 that act on respective support posts 51 to S3 downward in the vertical direction by the weight of development unit 300 are cancelled. In other words, as illustrated in the fifth embodiment, it is preferable that the rotational center of drive receiving gear 313 illustrated in FIG. 36 is located in the vicinity of straight line L connecting the centers of support post 314 as the first engaged portion and support post 315 as the second engaged portion. To be specific, it is preferable that distance D3 between the rotational center of drive receiving gear 313 and straight line L is not more than 20% of distance D1 between support posts 314 and 315. Such an arrangement can also provide a similar effect.

Figure 40A:
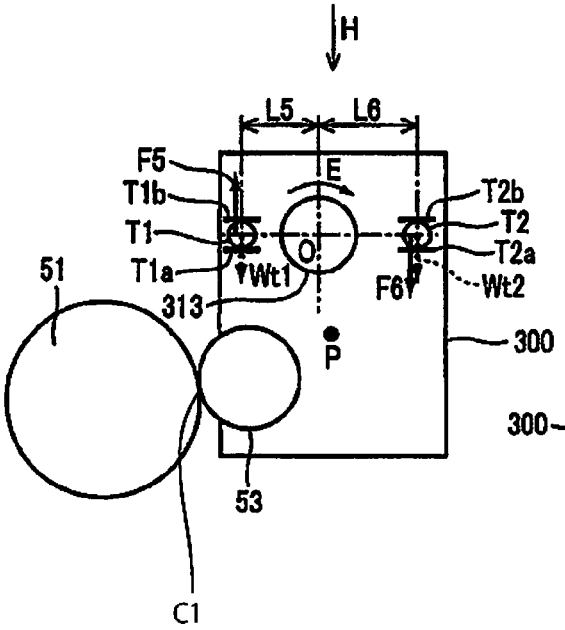
FIGS. 40A and 40B are third explanatory views for force acting on the development unit in the fifth embodiment.
Figure 40B:
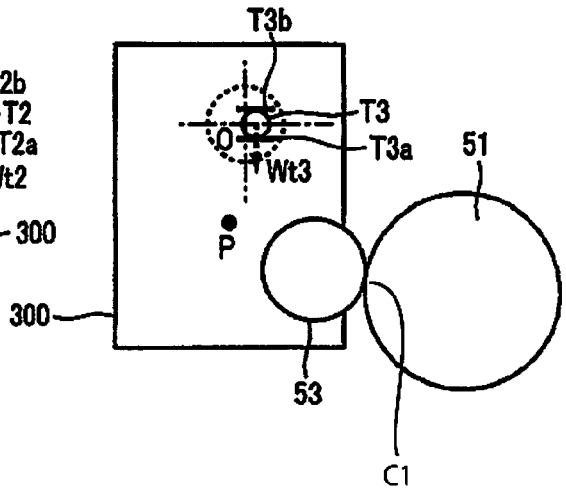
Figure 45:
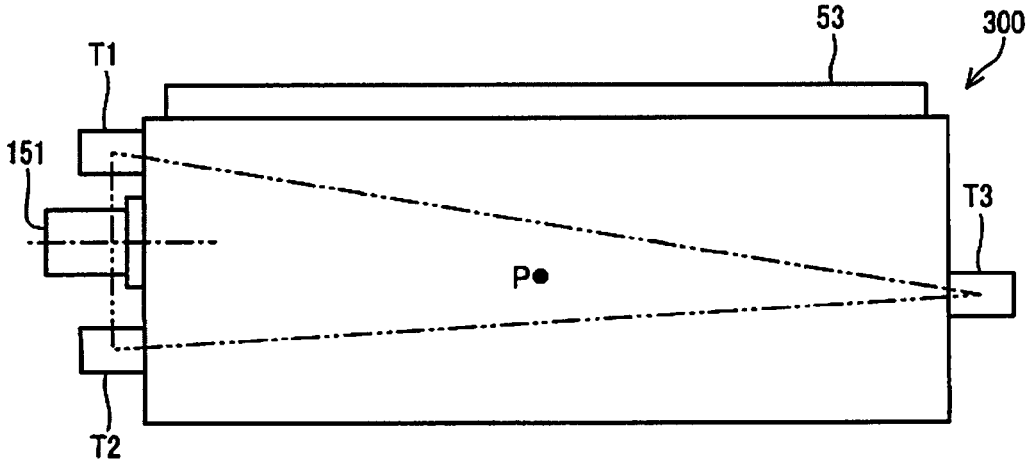
FIG. 45 is a third schematic top view of the development unit in the fifth embodiment.

Next, a description is given of the way to simultaneously cancel the two forces of rotation and gravity. First, in order to cancel the gravity force, as illustrated in FIG. 45 that is a view of development unit 300 in the direction indicated by arrow H of FIG. 40, support posts T1, T2, and T3 are arranged so that the center P of gravity of development unit 300 is located within a triangle formed by the support posts at three points when viewed in the direction of gravity. As illustrated in FIGS. 40A and 40B, to cancel gravity forces Wt1, Wt2, and Wt3 acting on support posts T1, T2, and T3, respectively, lower surfaces of support posts T1, T2, and T3 at all of the three points need to be limited to horizontal surfaces T1*a*, T2*a*, and Tia.

For development unit 300 to be supported so as to move in the horizontal direction, the horizontal components of the rotational force need to be canceled. The limiting surfaces are limited to horizontal surfaces T1*b*, T2*b*, and T3*b* which are opposite to horizontal surfaces T1*a*, T2*a*, and T3*a* in the vertical direction. Paired support posts T1 and T2 of the drive receiving side illustrated in FIG. 40A are located on a horizontal line so that the rotational center O of drive receiving gear 313 is located on a line segment connecting support posts T1 and T2.

In the aforementioned arrangement, forces F5 and F6 respectively acting on support posts T1 and T2 are vertically applied to horizontal surfaces T1*b* and T2*a* as the limiting surfaces and are therefore cancelled. In this case, distances L5 and L6 between the rotational center O of drive receiving gear 313 and the respective support posts T1 and T2 are not limited. Furthermore, in FIGS. 40A and 40B, support post T3 on the opposite drive side is located at the same vertical position as the positions of support posts T1 and T2. However, the vertical position is not limited to this.

Figure 46:
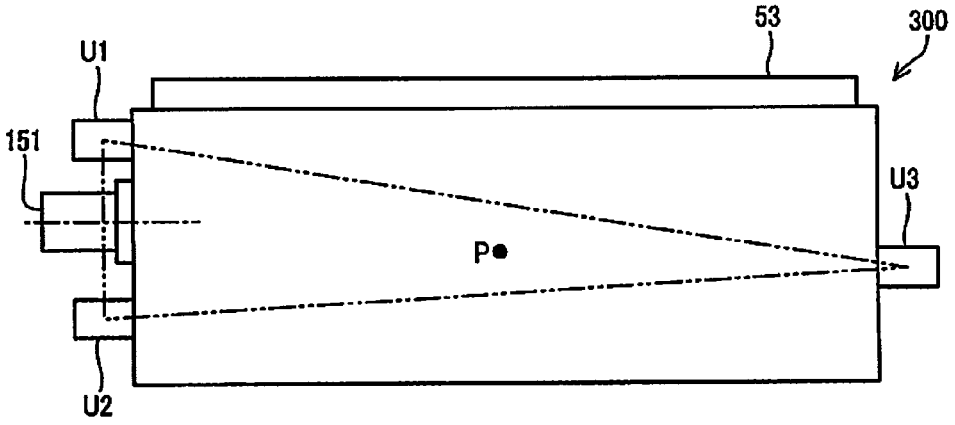
FIG. 46 is a fourth schematic top view of the development unit in the fifth embodiment.

Next, a description is given of a case where the pair of support posts on the drive receiving side are at a distance from each other in the vertical direction. First, in order to cancel the force of gravity, as illustrated in FIG. 46 which is a view of development unit 300 in the direction indicated by arrow H in FIG. 41A, support posts U1, U2, and U3 are arranged so that the center P of gravity of development unit 300 is located within a triangle formed by the support posts at the three points when viewed in the direction of gravity.

Figure 41A:
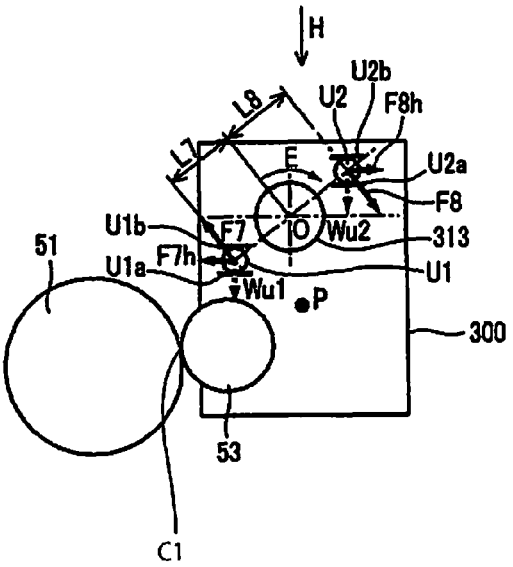
FIGS. 41A and 41B are fourth explanatory views for force acting on the development unit in the fifth embodiment.
Figure 41B:
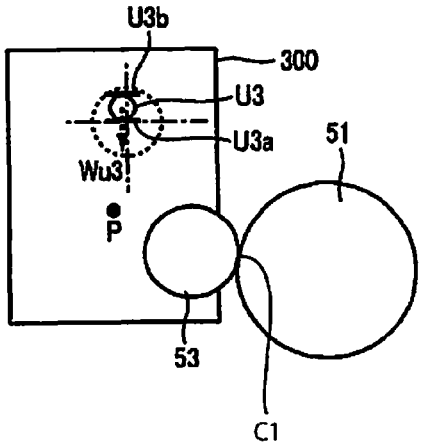

In order to cancel gravity forces Wu1, Wu2, and Wu3 respectively acting on support posts U1, U2, and U3, the lower surfaces of support posts U1, U2, and U3 at all the three points are limited by horizontal surfaces U1*a*, U2*a*, and U3*a*, as illustrated in FIGS. 41A and 41B. For development unit 300 to be supported so as to move in the horizontal direction, the horizontal component of the rotational force needs to be canceled. The limiting surfaces are therefore composed of horizontal surfaces U1*b*, U2*b*, and U3*b* which are opposite to horizontal surfaces U1*a*, U2*a*, and U3*a* in the vertical direction. At this time, forces F7 and F8 due to rotational force act on support posts U1 and U2, respectively. The limiting surfaces are horizontal as described above, and horizontal components F7*h* and F8*h* are therefore generated.

However, two forces F7*h* and F8*h* act in the directions opposite to each other. If distances L7 and L8 between the rotational center O of drive receiving gear 313 and respective support posts U1 and U2 are set equal to each other, forces F7*h* and H8*h* are equal to each other in magnitude and cancel each other. Accordingly, even when the pair of support posts on the drive receiving side are distant from each other in the vertical direction, the rotational and gravity forces can be cancelled. At this time, the vertical position of support post U3 on the opposite drive receiving side is not limited with respect to the vertical positions of support posts U1 and U2 on the drive receiving side.

Figure 42A:
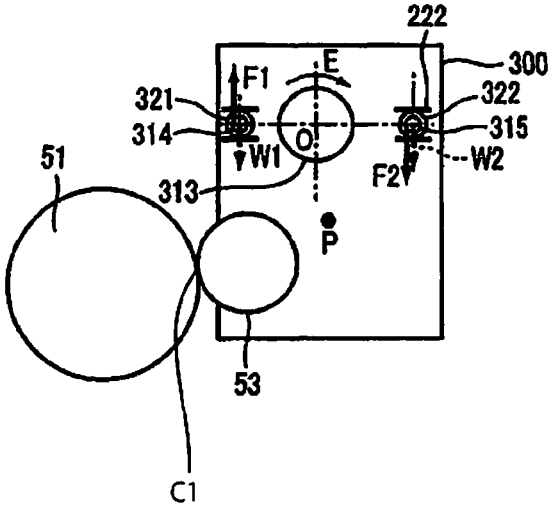
FIGS. 42A and 42B are fifth explanatory views for force acting on the development unit in the fifth embodiment.
Figure 42B:
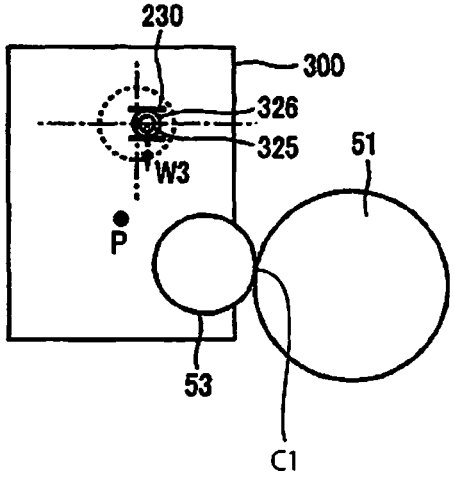

Herein, using FIGS. 42A, 42B, and 43, a description is given of operations of development unit 300 in the fifth embodiment and forces acting on support posts 314 and 315 on the drive receiving side and support post 325 on the opposite drive receiving side. The fifth embodiment describes the way to cancel the rotational force and the gravity force by arranging the support posts as illustrated in FIGS. 40A, 40B, and 45. First, support posts 314 and 315 on the drive receiving side and support post 325 on the opposite drive receiving side are subjected to gravity forces W1, W2, and W3 due to the weight of development unit 300 downward in the vertical direction and are limited by the lower surfaces of position limiting holes 221, 222, and 230 through rollers 321, 322, and 326 attached to support posts 314, 315, and 325. At this time position limiting holes 221, 222, and 230, each having a horizontal surface, can be perpendicularly subjected to the aforementioned gravity forces W1, W2, and W3, respectively. Accordingly, the development unit 300 is not subjected to the force due to gravity.

Next, when drive receiving gear 313 illustrated in FIGS. 42A and 92B is subjected to a drive force by development unit drive output portion 161 (see FIG. 12) to rotate in the direction indicated by arrow E of FIG. 42A, support post 314 is subjected to force F1 due to the rotation moment upward in the vertical direction, and support post 315 is subjected to force F2 due to the rotation moment downward in the vertical direction.

Movements of support posts 319 and 315 are then respectively limited by the upper surface of position limiting hole 221 and the lower surface of position limiting hole 222 through the rollers 321 and 322 attached to the respective support posts. However, position limiting holes 221 and 222 are composed of horizontal surfaces and are subjected to forces F1 and F2 due to the rotation moment in the perpendicular direction. Accordingly, the rotational force does not act on development unit 300. The aforementioned rotational force is canceled by support posts 314 and 315 on the drive receiving side, and the force due to rotation moment does not act on support post 325 on the opposite drive receiving side.

In such a manner, the horizontal components of the rotational force and the gravity force in development unit 300 are cancelled, and the rotation of development unit 300 about the rotational axis of development roller 53 with respect to drum unit 200 is limited. Moreover, development unit 300 is subjected to a horizontal force that includes only the bias force by bias member 250 illustrated in FIG. 36, so that development roller 53 come into contact with photosensitive drum 51 with a predetermined pressure for the printing operation.

Herein, a description is given of the relationship of forces acting on the support posts on the opposite drive receiving side when the support posts on the opposite drive receiving side are positioned symmetrically to the support posts on the drive receiving side. In this case, the total number of support posts on the drive receiving side and on the opposite drive receiving side is four, and all of the four support posts need to be limited in movement. This requires a very high dimensional accuracy of the positions of the support posts and position limiting holes, the diameters of rollers, and the like. If any one of the support posts does not come into contact with the position limiting hole and is not limited in position because of the lack of dimensional accuracy of the above members, the support post is influenced by changes in rotational force and gravity force during the printing operation, and the position of the development unit becomes unstable. This can change the pressure of contact between the photosensitive drum and development roller on the same support post's side, thus degrading the quality of print images.

In the fifth embodiment, as illustrated in FIG. 36, drive receiving gear 313 as the drive input portion is located between the engagement portion of position limiting hole 221 as the first engagement portion and support post 314 as the first engaged portion, and the engagement portion of position limiting hole 222 as the second engagement portion and support post 315 as the second engaged portion. This can reduce any change in pressure of contact between the photosensitive drum 51 and development roller 53.

As described above, in the fifth embodiment, the rotational force due to load torque that acts on the development unit during the operation and the gravity force due to its own weight can be stably canceled without requiring high dimensional accuracy of constituent components of the image formation unit. Accordingly, by bringing the development roller into contact with the photosensitive drum with only the bias force of the bias member, the fifth embodiment can provide the effect of reducing changes in the pressure of contact between the photosensitive drum and development roller so to stabilize the pressure of contact. Moreover, even if the load torque acting on the development unit varies or changes, or the development unit changes in weight, the pressure of contact between the photosensitive drum and development roller can be stabilized. It is therefore possible to provide an effect on preventing degradation in printing quality such as fog, white spots, gray imbalance, and developer filming.

(Sixth Embodiment)

Figure 47:
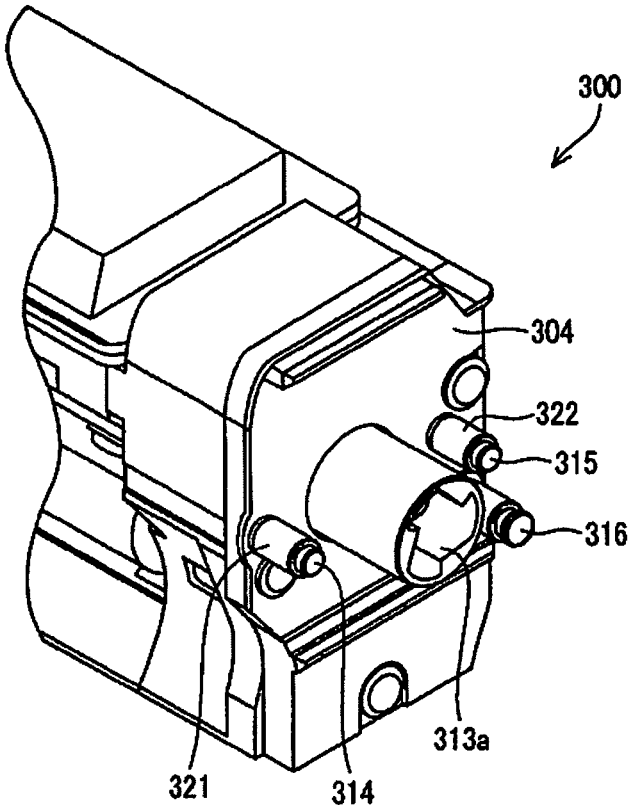
FIG. 47 is a perspective view of the drive receiving side of the development unit in a sixth embodiment.
Figure 48:
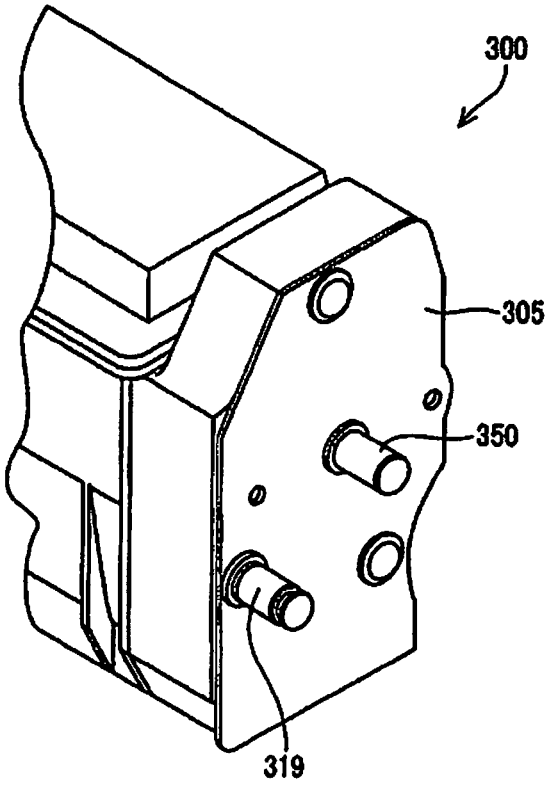
FIG. 48 is a perspective view of the opposite drive receiving side of the development unit in the sixth embodiment.
Figure 49:
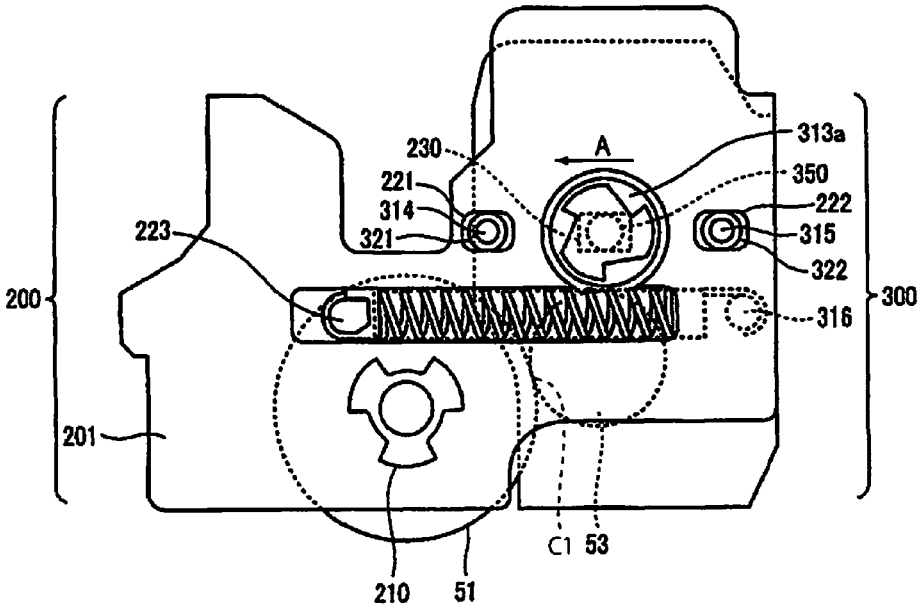
FIG. 49 is a side view illustrating the drum unit and development unit joined together in the sixth embodiment.

The configuration of the sixth embodiment differs from that of the fifth embodiment in the configuration of support posts of the development unit. The configuration thereof is described based on FIGS. 47 to 49. The same portions as those of the above-described fifth embodiment are given the same reference numerals, and the description thereof is thus omitted. FIG. 47 is a perspective view of the drive receiving side of the development unit in the sixth embodiment. FIG. 48 is a perspective view of the opposite drive receiving side of the development unit in the sixth embodiment. FIG. 49 is a side view illustrating the state where the drum unit is joined with the development unit in the sixth embodiment.

In FIGS. 47 to 49, support posts 314 and 315 on the drive receiving side of development unit 300 and rollers 321 and 322 are provided. Rollers 321 and 322 can respectively rotate with respect to support posts 314 and 315. Moreover, in position limiting holes 221 and 222, the lower and upper surfaces of the inside are horizontal surfaces, and the distances between the lower and upper surfaces are a small amount greater than the outer diameters of rollers 321 and 322, respectively. Desirably, the small amount is 0.01 to 0.05 mm.

On the other hand, in the sixth embodiment, support post 350 on the opposite drive receiving side of development unit 300 is not provided with a roller and has the same outer diameter as those of rollers 321 and 322. The gap between support post 350 and position limiting hole 230 is the same as the gaps between rollers 321 and 322 and respective position limiting holes 221 and 222 on the drive receiving side. Desirably, support post 350 is made of slippery metal, such as stainless steel, when the drum frame 201 is made of a molded resin.

Figure 50:
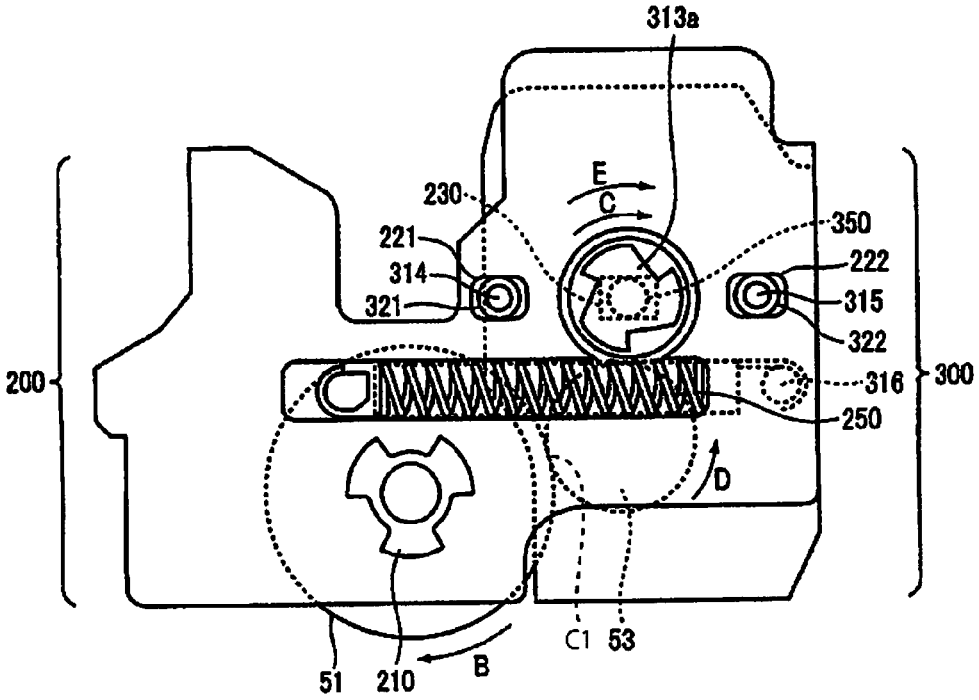
FIG. 50 is a side view of an image formation unit including the drum unit and development unit joined together in the sixth embodiment.

The operation of the aforementioned configuration is described using FIG. 50. FIG. 50 is a side view of an image formation unit including the drum unit joined with the development unit in the sixth embodiment. In the sixth embodiment, support posts 314 and 315 supporting development unit 300 on the drive receiving side are in rolling contact with position limiting holes 221 and 222 with rollers 321 and 322 interposed therebetween, respectively. On the other hand, support post 350 on the opposite drive receiving side is not provided with a roller and is therefore in sliding contact with position limiting hole 230.

However, as described in the fifth embodiment, support post 350 on the opposite drive receiving side is subjected to only the force due to gravity, which is small. Accordingly, the sliding contact with position limiting hole 230 does not inhibit the bias force by the bias member. Accordingly, the sixth embodiment can provide the same bias force by the bias member as that in the case where the support post 350 is provided with a roller and is brought into rolling contact with position limiting hole 230 with the roller interposed therebetween.

As described above, in addition to the effect of the fifth embodiment, the sixth embodiment can provide an effect on reducing the product cost without degrading the printing quality because the bias force by the bias member is not damaged even if the number of parts is reduced. The invention is applicable to image formation units, such as copiers, electrophotographic printers, facsimiles, and multifunction printers (MFPs), including contact or non-contact development-type image formation units.

Industrial Applicability

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation unit, comprising:

a first unit rotatably supporting an image carrier on which an electrostatic latent image is to be formed; and a second unit rotatably supporting a developer carrier configured to develop the electrostatic latent image with a developer, wherein the first unit includes:

a first engagement portion formed at one end side in a direction of a rotational axis of the image carrier; and a second engagement portion provided at a predetermined distance from the first engagement portion at the one end side, and the second unit includes:

a first engaged portion engaged with the first engagement portion;

a second engaged portion engaged with the second engagement portion; and a drive input portion provided between the first and second engaged portions and configured to rotate the developer carrier, wherein a rotational axis of the drive input portion is provided substantially at a midpoint between the first and second engaged portions.

2. The image formation unit according to claim 1, wherein the engagement of the first engagement portion and first engaged portion and the engagement of the second engagement portion and second engaged portion are configured to limit a rotation of the second unit about the rotational axis of the drive input portion with respect to the first unit.

3. The image formation unit according to claim 1, wherein the first engaged portion and second engaged portion are post members, the first engagement portion and second engagement portion include limiting surfaces with which the post members come into contact with so as to limit the rotation of the second unit about the rotational axis of the drive input portion with respect to the first unit.

4. The image formation unit according to claim 1, wherein the rotational axis of the drive input portion is located in a vicinity of a virtual straight line connecting the first and second engaged portions.

5. The image formation unit according to claim 1, further comprising a bias member configured to bring the image carrier into contact with the developer carrier, wherein the bias member is located between a virtual straight line and a contact portion between the image carrier and the developer carrier, wherein the virtual straight line connects the first and second engaged portions.

6. The image formation unit according to claim 1, wherein the first and second engagement portions are located substantially symmetrically with respect to the rotational axis of the drive input portion.

7. The image formation unit according to claim 1, wherein one of the first engaged portion and first engagement portion is a first post member while the other is a first limiting hole in which the first post member is to be inserted, wherein the first limiting hole includes a first limiting surface extending in a substantially horizontal direction below the first post member and in contact with the first post member, one of a second engaged portion and second engagement portion is a second post member, while the other is a second limiting hole in which the second post member is to be inserted, wherein the second limiting hole includes a second limiting surface extending in a substantially horizontal direction below the second post member and in contact with the second post member.

8. The image formation unit according to claim 1, wherein the second unit includes an inlet through which the developer is supplied, the inlet is provided between a first virtual vertical plane and a second virtual vertical plane, wherein the first virtual vertical plane is parallel to the rotational axis of the image carrier and passing through the first engaged portion, and the second virtual vertical lane is parallel to the first virtual vertical plane and passing through the second engaged portion.

9. The image formation unit according to claim 7, wherein the second unit includes:

an inlet through which the developer is supplied; and a seal member provided around the inlet, wherein the seal member is pressed in a direction substantially vertical to a direction of protrusion of the first and second post members.

10. The image formation unit according to claim 8, wherein the second unit includes a seal member provided around the inlet port, wherein the seal member is pressed downwardly in a vertical direction.

11. The image formation unit according to claim 1, wherein the first unit further includes a third engagement portion formed at a position between a first virtual straight line and a second virtual straight line in the other end side opposite to the one end side in the direction of the rotational axis of the image carrier, wherein the first virtual straight line is parallel to the rotational axis of the image carrier and passes through a center of the first engagement portion, and the second virtual straight line is parallel to the rotational axis of the image carrier and passes through a center of the second engagement portion, and the second unit further includes a third engaged portion engaged with the third engagement portion.

12. The image formation unit according to claim 11, wherein the third engaged portion is located on an extension of the rotational axis of the drive input portion.

13. The image formation unit according to claim 11, wherein a center of gravity of the second unit is located within a region defined by a line connecting the first, second, and third engaged portions when viewed in a direction of gravity.

14. The image formation unit according to claim 11, wherein a center of gravity of the second unit is located within a region defined by a line connecting the first, second, and third engaged portions, when viewed in a direction substantially orthogonal to a plane including the first, second, and third engaged portions.

15. The image formation unit according to claim 1, further comprising a bias member configured to bring the image carrier and the developer carrier in contact with each other, wherein the bias member is located between the drive input portion and a contact portion between the image carrier and the developer carrier.

16. An image formation apparatus including the image formation unit according to claim 1.

17. The image formation apparatus according to claim 16, wherein an image formation apparatus body separately holds the first unit and the second unit, and includes a bias member biasing the second unit toward the first unit.

18. The image formation apparatus according to claim 1, wherein a distance between the first engaged portion and the rotational axis of the drive input portion is in a range of 40 to 60% of a distance between the first engaged portion and the second engaged portion.

19. The image formation apparatus according to claim 4, wherein a distance between the virtual straight line and the rotational axis of the drive input portion is not more than 20% of a distance between the first engaged portion and the second engaged portion.

20. An image formation unit, comprising:

a first unit rotatably supporting an image carrier on which an electrostatic latent image is to be formed; and a second unit rotatably supporting a developer carrier configured to develop the electrostatic latent image with a developer, wherein the first unit includes:

a first engagement portion formed at one end side in a direction of a rotational axis of the image carrier; and a second engagement portion provided at a predetermined distance from the first engagement portion at the one end side, and the second unit includes:

a first engaged portion engaged with the first engagement portion;

a second engaged portion engaged with the second engagement portion; and a drive input portion provided between the first and second engaged portions and configured to rotate the developer carrier, wherein the first and second engagement portions are located substantially symmetrically with respect to a center of rotation of the drive input portion.

* * * * *